US011248836B2

(12) United States Patent
Kang et al.

(10) Patent No.: US 11,248,836 B2
(45) Date of Patent: Feb. 15, 2022

(54) REFRIGERATOR

(71) Applicant: LG Electronics Inc., Seoul (KR)

(72) Inventors: Chanuk Kang, Seoul (KR); Hyuk Kwon, Seoul (KR); Sangmyung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/241,776

(22) Filed: Apr. 27, 2021

(65) Prior Publication Data

US 2021/0247133 A1 Aug. 12, 2021

Related U.S. Application Data

(63) Continuation of application No. 16/856,665, filed on Apr. 23, 2020, now Pat. No. 11,015,864, which is a (Continued)

(30) Foreign Application Priority Data

Mar. 24, 2017 (KR) ..... 10-2017-0037839

(51) Int. Cl.
*F25D 27/00* (2006.01)
*A47F 3/04* (2006.01)
(Continued)

(52) U.S. Cl.
CPC ..... *F25D 27/005* (2013.01); *A47F 3/0434* (2013.01); *F25D 11/00* (2013.01);
(Continued)

(58) Field of Classification Search
None
See application file for complete search history.

(56) References Cited

U.S. PATENT DOCUMENTS 6,401,428 B1 6/2002 Glover et al.
2017/0211874 A1 7/2017 Kim et al.

FOREIGN PATENT DOCUMENTS

EP 3086061 10/2016
JP 2004069114 12/2005
(Continued)

OTHER PUBLICATIONS

EP Extended European Search Report in European Appln. No. 18150574.4, dated Aug. 17, 2018, 9 pages.
(Continued)

*Primary Examiner* — Britt D Hanley
(74) *Attorney, Agent, or Firm* — Fish & Richardson P.C.

(57) ABSTRACT

A refrigerator includes a cabinet, a door configured to open/close the cabinet, an outer plate defining a front surface of the door and having an opening formed therein to pass through the door, a door liner defining a rear surface of the door, lighting members configured to illuminate storage spaces of the door and the cabinet, a transparent panel assembly mounted to shield the opening and allowing the storage spaces to be selectively seen according to an ON/OFF state of the lighting members, an insulator filled between the outer plate and the door liner, and a blocking part arranged inside the door along a periphery of the transparent panel assembly and detachably coupled to a peripheral surface of the transparent panel assembly to fix the transparent panel assembly.

20 Claims, 40 Drawing Sheets

Related U.S. Application Data continuation of application No. 15/838,642, filed on Dec. 12, 2017, now Pat. No. 10,670,329.

(51) Int. Cl.
*F25D 23/02* (2006.01)
*F25D 11/00* (2006.01)

(52) U.S. Cl.
CPC ..... *F25D 23/02* (2013.01); *F25D 23/025* (2013.01); *F25D 23/028* (2013.01); *F25D 2201/10* (2013.01); *F25D 2323/023* (2013.01); *F25D 2400/361* (2013.01)

(56) References Cited

FOREIGN PATENT DOCUMENTS

| | | |
|---|---|---|
| JP | 2005331221 | 11/2017 |
| KR | 1020170008458 | 1/2017 |
| WO | WO2011010828 | 8/2011 |
| WO | WO2011093614 | 2/2014 |
| WO | WO2014019281 | 10/2016 |

OTHER PUBLICATIONS

PCT International Search Report in International Appln. No. PCT/KR2018/003321, dated Jul. 10, 2018, 3 pages.

REFRIGERATOR

CROSS-REFERENCE TO RELATED APPLICATIONS

This application is a continuation of U.S. application Ser. No. 16/856,665, filed on Apr. 23, 2020, which is a continuation of U.S. application Ser. No. 15/838,642, filed on Dec. 12, 2017, now U.S. Pat. No. 10,670,329, which claims priority under 35 U.S.C. 119 and 35 U.S.C. 365 to Korean Patent Application No. 10-2017-0037839 filed on Mar. 24, 2017. The disclosures of the prior applications are incorporated by reference in their entirety.

BACKGROUND

The present disclosure relates to a refrigerator.

In general, a refrigerator refers to a home appliance in which food may be stored in an internal storage space, which is shielded by a door, at a low temperature. To achieve this, the refrigerator is configured to accommodate the stored food in an optimum state by cooling the internal storage space using cold air generated through heat exchange with a refrigerant circulating in a refrigeration cycle.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. Further, the refrigerator may be classified into various types according to arrangement of the storage space and a structure of the door configured to open/close the storage space.

In general, the refrigerator has a problem in that when the door is not opened, internal food cannot be identified. That is, the door should be opened to identify whether desired food is received in a space in the refrigerator or in a separate storage space provided in the door. Further, when a user does not exactly know where the food is stored, an opening time of the door may increase or the number of times the door is opened may increase. At this time, unnecessary outflow of cold air may occur.

In recent years, to solve the above-described problem, a refrigerator in which a portion of a door is transparent or an interior of the refrigerator may be viewed, has been developed.

SUMMARY

An aspect of the present disclosure is to provide a refrigerator on which an out case constituting a door of the refrigerator and a transparent panel assembly that may selectively visualize an interior of the refrigerator are easily mounted.

Another aspect of the present disclosure is to provide a refrigerator in which an outer appearance is improved through a coupling structure of an out case formed of metal, which defines a front appearance of a door, and a front panel formed of glass, which visualizes an interior of the refrigerator.

Yet another aspect of the present disclosure is to provide a refrigerator in which detachable performance of a transparent panel assembly which constitutes a portion of a door and through which an interior of the door may be viewed is improved, so that serviceability may be improved.

Yet another aspect of the present disclosure is to provide a refrigerator in which a transparent panel assembly may be prevented from being polluted and damaged, by foam liquid inside a door.

Yet another aspect of the present disclosure is to provide a refrigerator in which condensed dew may be prevented from being formed on a front panel defining a front surface of a door.

A refrigerator according to an embodiment of the present disclosure may include a cabinet, a door configured to open/close the cabinet, an outer plate defining a front surface of the door and having an opening formed therein to pass through the door, a door liner defining a rear surface of the door, lighting members configured to illuminate storage spaces of the door and the cabinet, a transparent panel assembly mounted to shield the opening and allowing the storage spaces to be selectively seen according to an ON/OFF state of the lighting members, an insulator filled between the outer plate and the door liner, and a blocking part arranged inside the door along a periphery of the transparent panel assembly and detachably coupled to a peripheral surface of the transparent panel assembly to fix the transparent panel assembly.

The transparent panel assembly may include a front panel defining the front surface of the door, the front surface being exposed through the opening, a rear panel spaced apart from the front panel and defining the rear surface of the door, and a spacer defining a peripheral surface connecting the front panel and the rear panel between the front panel and the rear panel, and defining an airtight space between the front panel and the rear panel.

Coupling members passing through the blocking part to be fastened to the spacer may be included on an inner side of the door.

A spacer protrusion which protrudes to the same height as the rear panel along the spacer and to which the coupling members are fastened may be formed on an outer surface of the spacer, and a sealant may be filled in spaces between the spacer protrusion, and the front panel and the rear panel at a height corresponding to a height of the spacer protrusion.

A transparent display configured to output a screen may be provided on a rear surface of the front panel inside the spacer, and a cable connected to the transparent display may pass through the sealant to be arranged along a periphery of the spacer.

A shielding member connecting the blocking part and the rear panel between the blocking part and the rear panel may be further provided inside the door, and the shielding member may be arranged to prevent foam liquid injected to form the insulator from permeating along the peripheral surface of the transparent panel assembly.

The spacer may include an outer spacer connecting the front panel and the rear panel, and coupled to the blocking part, and an inner spacer provided inside an airtight space defined by the outer spacer, and configured to support an additional panel between the front panel and the rear panel, and a source board connected to the display and the cable may be arranged between the outer spacer and the inner spacer.

A panel may be further provided between the front panel and the rear panel, the spacer may be plural, and the front panel, the panel, and the rear panel may be spaced apart from each other and may be supported by the spacers, respectively.

The front panel may protrude more outward than the rear panel, and the rear panel may be formed to be smaller than the opening, so that the rear plate is inserted through the opening from a front side of the door, and a bezel opaquely printed along a periphery of the front panel to shield the spacer may be formed on a rear surface of the front panel.

A support frame may be provided inside the door, the support frame may include a plate support fixed to a rear surface of the outer plate, and a panel support extending to an inside of the opening to support the periphery of the front panel, and the blocking part may extend from an end of the panel support.

A heater accommodating groove in which a heater configured to heat the periphery of the front panel may be accommodated is formed in the panel support.

The plate support and the panel support may be stepped with respect to each other by a height corresponding to a thickness of the front panel.

A bent plate part inward bent to define the opening may be formed in the outer plate, and a depressed plate accommodating groove into which the bent plate part is inserted may be formed between the plate support and the panel support.

A guide rib protruding toward the panel support and when the bent plate part is inserted into the plate accommodating groove, being in contact with the bent plate part to guide the bent plate part such that the bent plate part is moved to be in contact with an end of the front panel may be formed inside the plate accommodating groove.

The support frame may have a rectangular frame shape and may be arranged along a periphery of the opening, an outer end of the support frame may be larger than the opening, and an inner end of the support frame may be smaller than the front panel.

The outer plate may include a front surface part defining an outer appearance of the front surface of the door, and a mounting part which is stepped with respect to an end of the front surface part and on which the front panel is seated, and the blocking part extends from an end of the mounting part.

The mounting part may be stepped by a height corresponding to a thickness of the front panel so that the front surface part and a front surface of the front panel are arranged on the same plane The front panel may be formed to correspond to a size of the opening, and the rear panel may be formed to be larger than the front panel and to be smaller than a liner opening formed in the door liner, so that the transparent panel assembly is inserted and mounted from a rear side of the door.

The door liner may include a mounting part which is stepped to define a periphery of the liner opening, and on which the rear panel is seated, and the blocking part may extend from an end of the mounting part.

The mounting part may be stepped such that a front surface of the front plate and a front surface of the outer plate are arranged on the same plane.

In a refrigerator according to an embodiment of the present disclosure, a see-through part is selectively switched to a transparent state or an opaque state, so that an interior of the refrigerator may be selectively visualized, and thus, a user may identify the interior without opening a door, so that use convenience may be improved and power consumption may be reduced.

In the refrigerator according to the embodiment of the present disclosure, in a state in which a transparent panel assembly is mounted, the front surface of an outer plate and the front surface of the transparent panel assembly may be arranged on the same plane. Thus, when the door is viewed from the front side, the front surface of the door is located on the same plate without being stepped, so that a sense of unity may be achieved.

Further, as an end of the outer plate defining an opening and an outer end of the transparent panel assembly are in close contact with each other. Thus, when the door is viewed from the front side, the outer end of the outer plate and the outer end of the transparent panel assembly are virtually represented by one line, so that the sense of unity of the front surface of the door may be further improved.

In the refrigerator according to the embodiment of the present disclosure, the transparent panel assembly may be coupled to a blocking part through coupling members. Thus, there is an advantage in that due to separation of the coupling members, the transparent panel assembly itself is easily separated, and a follow-up service is easy.

In particular, there is an advantage in case of the expensive transparent panel assembly having a display, when the transparent panel assembly is reused through the follow-up service, a lot of costs may be saved. Further, there is an advantage in that when other parts of the door not the transparent panel assembly is abnormal, the transparent panel assembly is separated and is then reused.

Further, the heavy transparent panel assembly configured by a plurality of panels is stably fixed using the coupling members, so that the transparent panel assembly may be maintained in a stably mounted state even when the door is opened/closed.

In the refrigerator according to the embodiment of the present disclosure, the blocking part is formed to prevent foam liquid injected to form an insulator inside the door from being introduced toward the transparent panel assembly.

Thus, the transparent panel assembly may be prevented from being polluted by the foam liquid. In particular, cables arranged along a periphery of the transparent panel assembly so as not to be exposed through the transparent panel assembly may be prevented from being damaged or polluted by the foam liquid being stained with the cables.

In the refrigerator according to the embodiment of the present disclosure, there is an advantage in that a support frame is provided inside the door, and the outer plate and the transparent panel assembly are simultaneously supported by the support frame, so that a coupling structure of the outer plate and the transparent panel assembly may be provided through a simple configuration.

Further, a heater may be provided in the support frame, and a peripheral surface of the front panel, which is vulnerable to insulation, and the heater may be in contact with each other, so that dew condensation may be prevented from being generated in the periphery of the front panel.

BRIEF DESCRIPTION OF THE DRAWINGS

Embodiments will be described in detail with reference to the following drawings in which like reference numerals refer to like elements, and wherein.

DETAILED DESCRIPTION OF THE EMBODIMENTS

Hereinafter, detailed embodiments of the present disclosure will be described in detail with reference to the accompanying drawings. However, the scope of the present disclosure is not limited to proposed embodiments, and other regressive inventions or other embodiments included in the scope of the spirits of the present disclosure may be easily proposed through addition, change, deletion, and the like of other elements.

Figure 1:
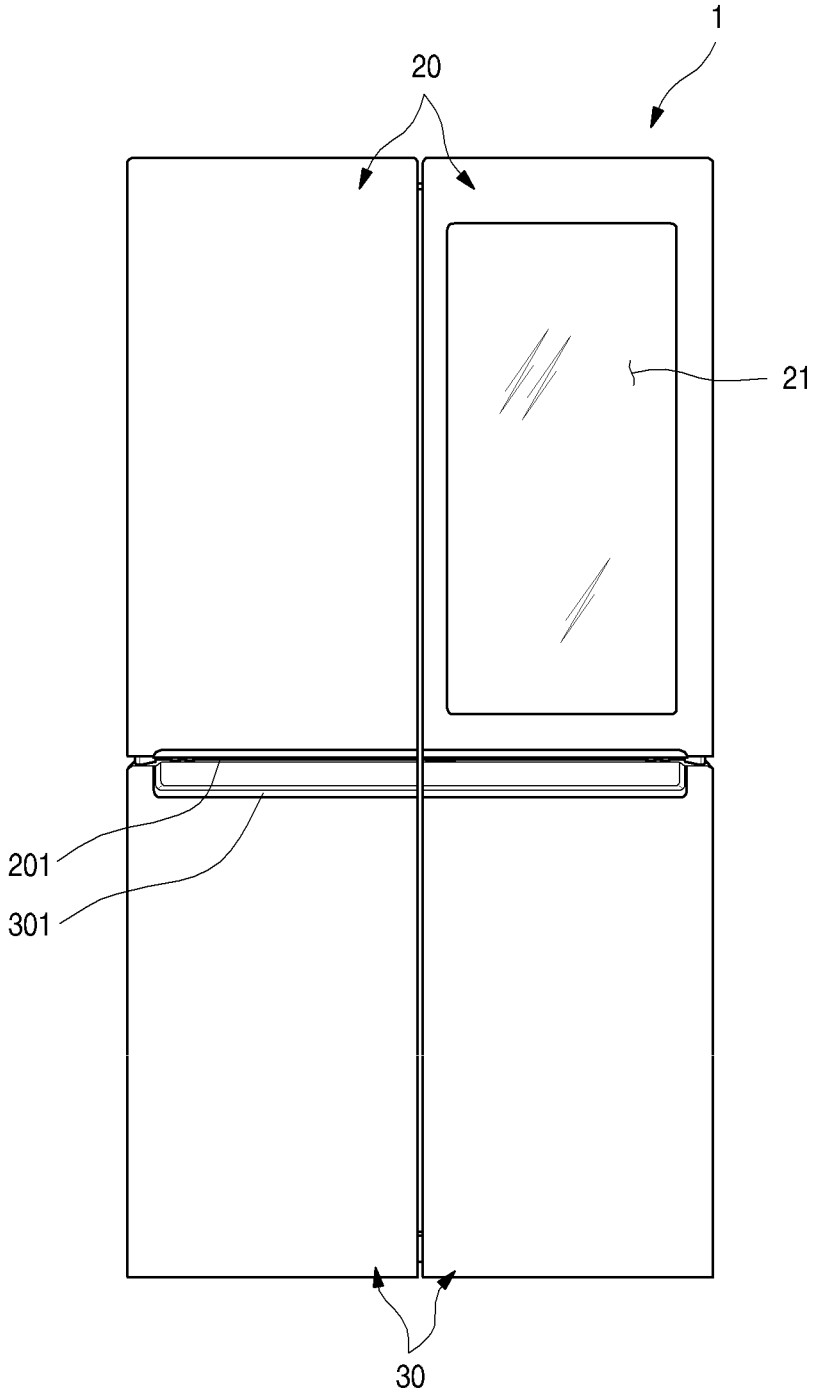
FIG. 1 is a front view illustrating a refrigerator according to a first embodiment of the present disclosure.
Figure 2:
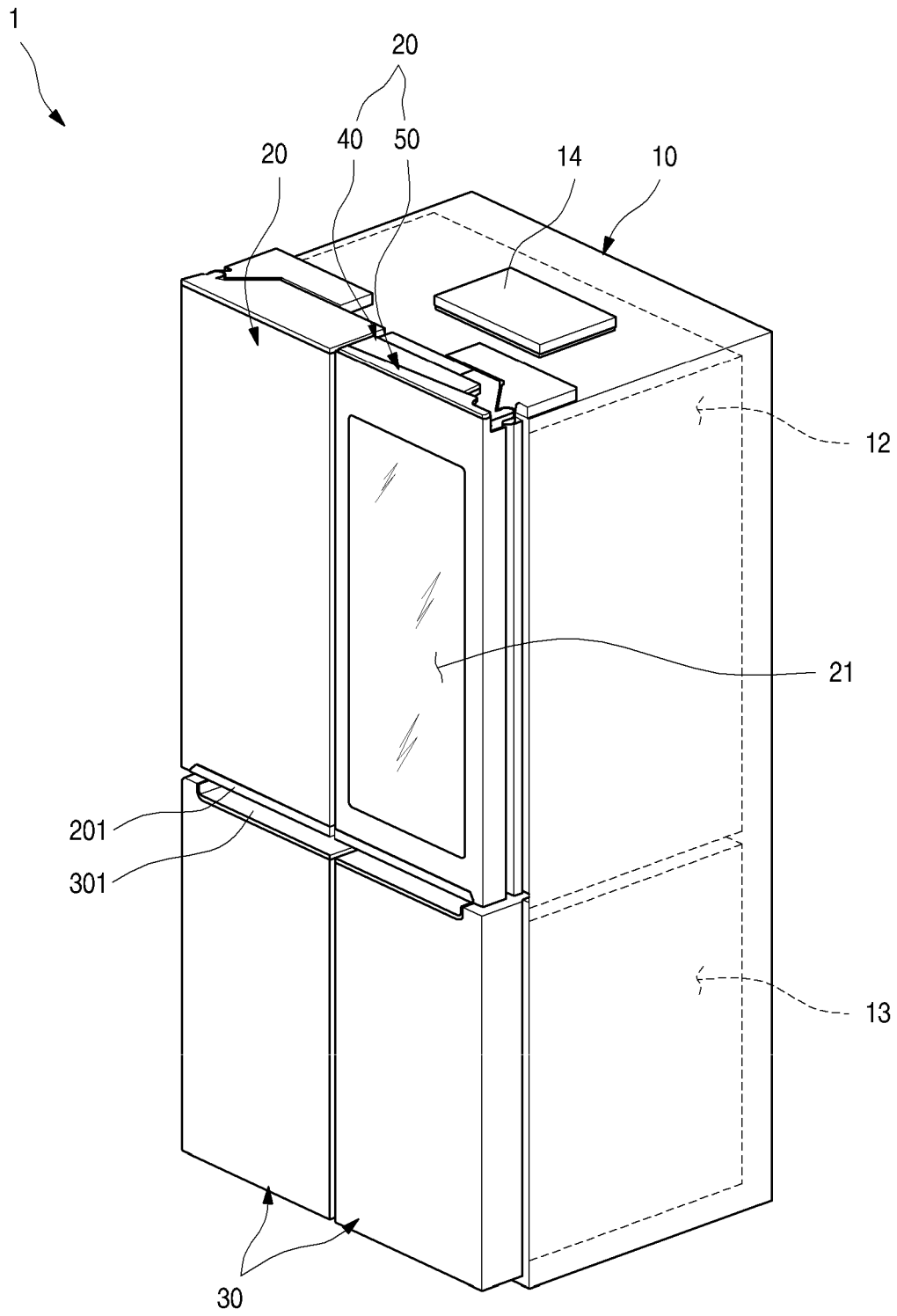
FIG. 2 is a perspective view illustrating the refrigerator.

FIG. 1 is a front view illustrating a refrigerator according to a first embodiment of the present disclosure. Further, FIG. 2 is a perspective view illustrating the refrigerator.

As illustrated in the drawings, an outer appearance of a refrigerator 1 according to the first embodiment of the present disclosure may be formed by a cabinet 10 defining a storage space and doors configured to open/close the storage space.

An interior of the cabinet 10 may be vertically partitioned by a barrier 11 (in FIG. 4), a refrigerating chamber 12 may be formed above the cabinet 10, and a freezing chamber 13 may be formed below the cabinet 10.

Further, a control unit 14 configured to control an overall operation of the refrigerator 1 is formed on an upper surface of the cabinet 10. The control unit 14 may be configured to control electrical components for selectively seeing through a see-through part 21 and outputting a screen as well as a cooling operation of the refrigerator 1.

The doors may include refrigerating chamber doors 20 and freezing chamber doors 30. The refrigerating chamber doors 20 may be configured to open/close an opened front surface of the refrigerating chamber 12 through pivoting, and the freezing chamber doors 30 may be configured to open/close an opened front surface of the freezing chamber 13 through pivoting.

Further, the pair of refrigerating chamber doors 20 are provided on left and right sides, and the refrigerator chamber 12 may be shielded by the pair of doors. Further, the pair of freezing chamber doors 30 are provided on left and right sides, and the freezing chamber 13 may be opened/closed by the pair of doors. Of course, the freezing chamber doors 30 may be configured to be drawable in a drawer form if necessary, and one or more freezing chamber doors 30 may be configured.

Meanwhile, although an example where a French-type door that includes a pair of doors and opens/closes one space by rotating the doors is applied to a bottom freeze-type refrigerator in which a freezing chamber 13 is provided below is illustratively described in the embodiment of the present disclosure, the present disclosure may be applied to all types of refrigerators having doors regardless of types of the refrigerators.

Further, depressed handle grooves 201 and 301 may be formed at a lower end of the refrigerating chamber doors 20 and an upper end of the freezing chamber doors 30. A user inserts a hand into the handle grooves 201 and 301 to open/close the refrigerating chamber doors 20 or the freezing chamber doors 30.

Meanwhile, at least one door may be formed to see through an interior of the refrigerator 1. The see-through part 21, through which a storage space on a rear surface of the door and/r an internal space of the refrigerator 1 may be seen, may be formed in the refrigerating chamber door 20. The see-through part may form at least a part of the front surface of the refrigerating chamber door 20. The see-through part 21 may be selectively transparent or opaque depending on manipulation by the user, and the user may accurately identify food accommodated in the refrigerator 1 through the see-through part 21.

Further, in the embodiment of the present disclosure, a case where the see-through part 21 is formed in the refrigerating chamber door 20 is described as an example. However, the see-through part 21 may be provided in various other types of refrigerator doors including the freezing chamber doors 30 according to the structure and shape of the refrigerator 1.

Figure 3:
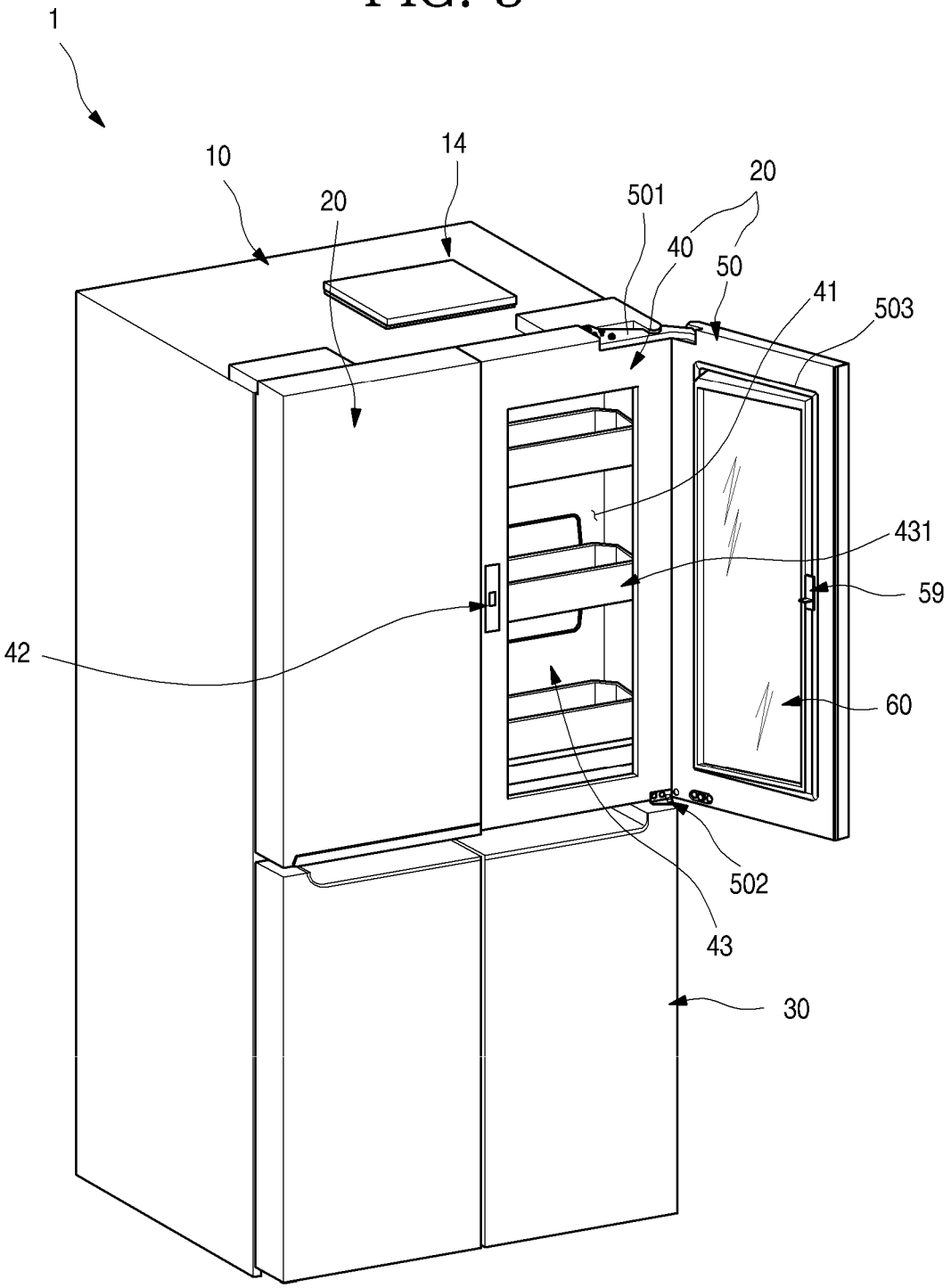
FIG. 3 is a perspective view illustrating a state in which a sub-door of the refrigerator is opened.
Figure 4:
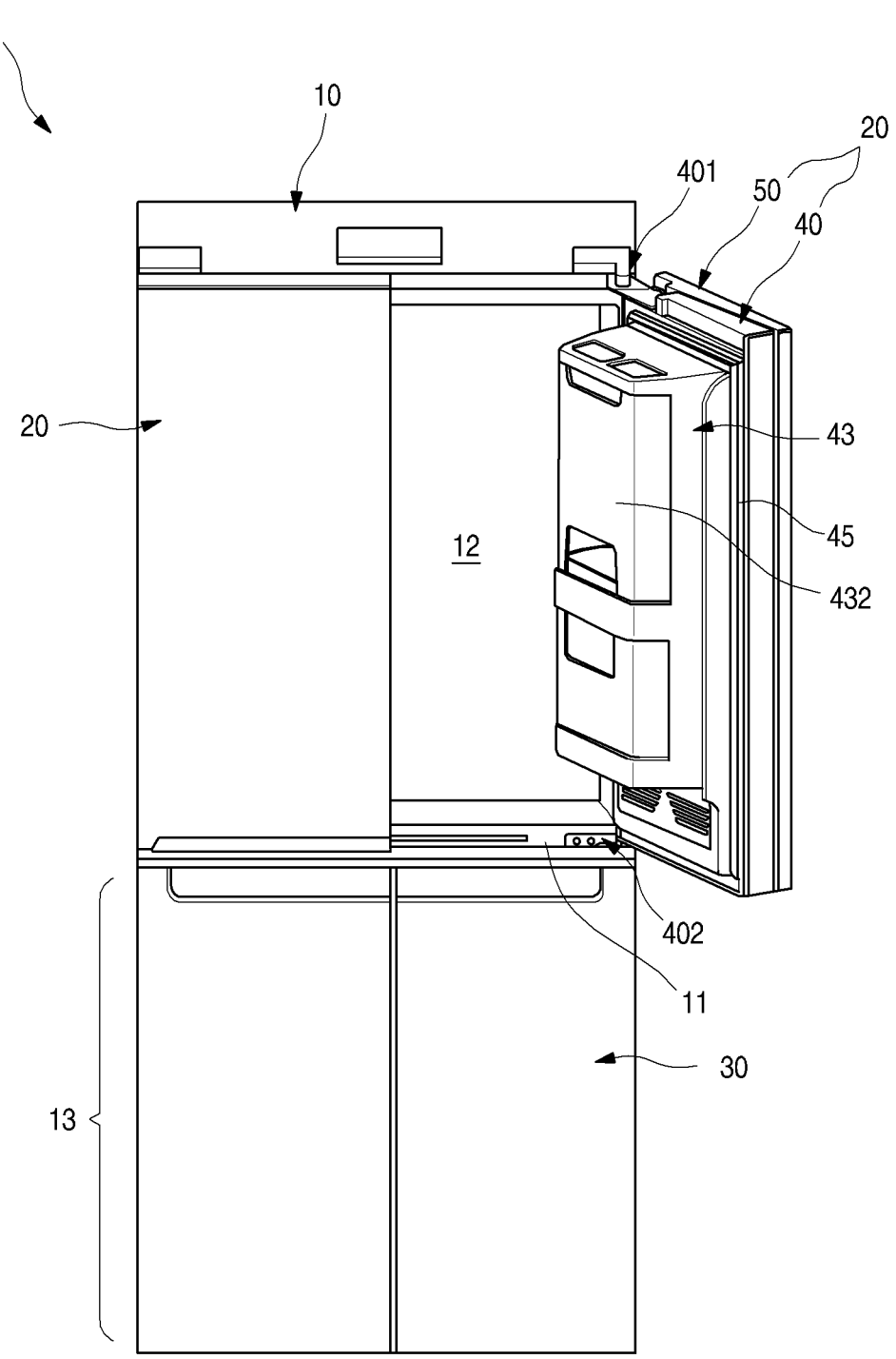
FIG. 4 is a perspective view illustrating a state in which a main door of the refrigerator is opened.

FIG. 3 is a perspective view illustrating a state in which a sub-door of the refrigerator is opened. Further, FIG. 4 is a perspective view illustrating a state in which a main door of the refrigerator is opened.

As illustrated in the drawings, the right refrigerating chamber door 20 (when viewed in FIG. 3) of the pair of the refrigerating chamber doors 20 may be dually opened/closed. In detail, the right refrigerating chamber door 20 may include a main door 40 configured to open/close the refrigerating chamber 12 and a sub-door 50 rotatably arranged in the main door 40 to open/close an opening 41 of the main door 40.

The main door 40 may have the same size as that of the left refrigerating chamber door 20 (when viewed in FIG. 1) of the pair of refrigerating chamber doors 20 and may be rotatably mounted on the cabinet 10 by an upper hinge 401 and a lower hinge 402 to open/close at least a portion of the refrigerating chamber 12.

Further, an opening 41 opened to have a predetermined size is formed in the main door 40. Door baskets 431 may be mounted on a rear surface of the main door 40 as well as inside the opening 41. At this time, the opening 41 may be formed to occupy most of the front surface of the main door 40 except for a portion of the periphery of the main door 40.

Further, a main gasket 45 is provided at a periphery of the rear surface of the main door 40 to prevent cold air inside the cabinet 10 from being leaked when the main door 40 is opened/closed.

The sub-door 50 may be pivotably mounted on the front surface of the main door 40 to open/close the opening 41. Thus, the opening 41 may be exposed through opening the sub-door 50.

The size of the sub-door 50 is equal to the size of the main door 40 so that the sub-door 50 may shield the entire front surface of the main door 40. Further, in a state in which the sub-door 50 is closed, the main door 40 and the sub-door 50 are coupled to each other, so that the size and the shape of the coupled main door 40 and the sub-door is equal to the size and the shape of the left refrigerating chamber door 20. Further, a sub-gasket 503 is provided on the rear surface of the sub-door 50 to seal a space between the main door 40 and the sub-door.

A transparent panel assembly 60, through which an interior of the refrigerator may be selectively seen and which may output a screen, is provided at a center of the sub-door 50. Thus, even in a state in which the sub-door 50 is closed, the inner side of the opening 41 may be seen and an image may be output. The see-through part 21 may be defined as a portion on the sub-door 50, through which the interior of the refrigerator 1 is seen, and may not necessarily coincide with the entire transparent panel assembly 60.

The transparent panel assembly 60 may be changed to a transparent state or an opaque state depending on manipulation by the user. Thus, only when the user wants to make the transparent panel assembly 60 be transparent, the transparent panel assembly 60 becomes transparent so that the interior of the refrigerator 1 is visualized, and when the user does not want to make the transparent panel assembly 60 be transparent, the transparent panel assembly 60 may be maintained in an opaque state. Further, the screen may be output in a state in which the transparent panel assembly 60 is in a transparent state or an opaque state.

In the embodiment of the present disclosure, the transparent panel assembly 60 is configured to shield an opened portion of the sub-door 50. However, according to types of the door, even when one door is configured as in the right door 20 of the refrigerating chamber 12, an opening may be formed in the door 20, and the transparent panel assembly may be mounted to shield the opening of the door 20. That is, it is noted that the transparent panel assembly 60 may be applied to all types of doors, through which an opening is formed, regardless of the shape of the refrigerator and the shape of the door.

As a sub-upper hinge 501 and a sub-lower hinge 502 are provided at an upper end and a lower end of the sub-door 50, respectively, the sub-door 50 may be pivotably mounted on the front surface of the main door 40. Further, an opening device 59 may be provided in the sub-door 50, and a locking unit 42 may be provided in the main door 40 corresponding to the opening device 59. Thus, the sub-door 50 may be maintained in a closed state by coupling between the opening device 59 and the locking unit 42, and when the opening device 59 and the locking unit 42 is uncoupled from each other by manipulation of the opening device 59, the sub-door 50 may be opened with respect to the main door 40.

Further, a damping device 504 (in FIG. 6) may be provided at a lower end of the sub-door 50. The damping device 504 may be located at a lower lateral edge of the sub-door 50, which is adjacent to the sub-lower hinge 502 such that an impact when the heavy sub-door 50 having is closed is absorbed by the transparent panel assembly 60.

Meanwhile, a storage case 43 may be provided on the rear surface of the main door 40. The plurality of door baskets 431 may be arranged in the storage case 43, and case doors 432 may be provided in the storage case 43.

Figure 5:
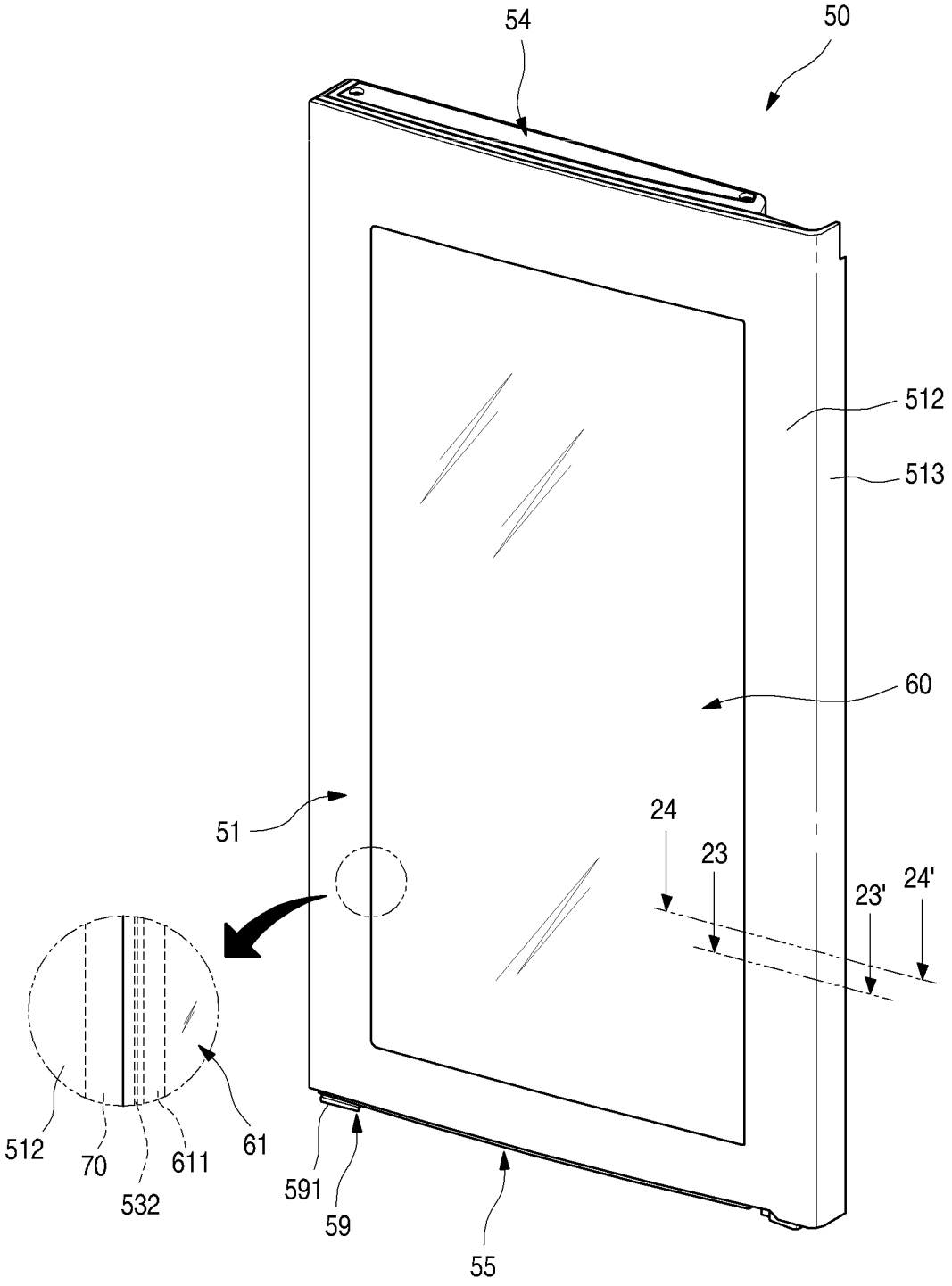
FIG. 5 is a perspective view illustrating the sub-door when viewed from the front side.
Figure 6:
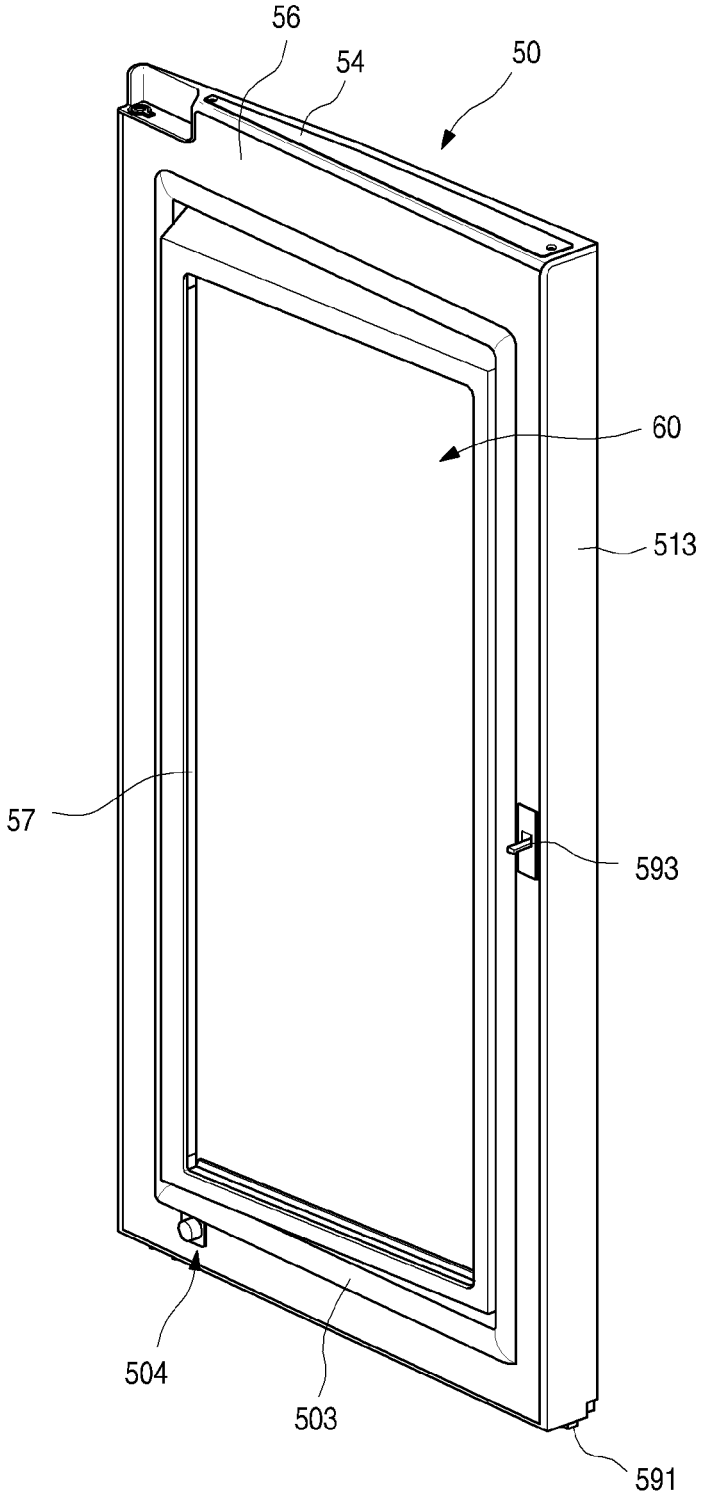
FIG. 6 is a perspective view illustrating the sub-door when viewed from the rear side.
Figure 7:
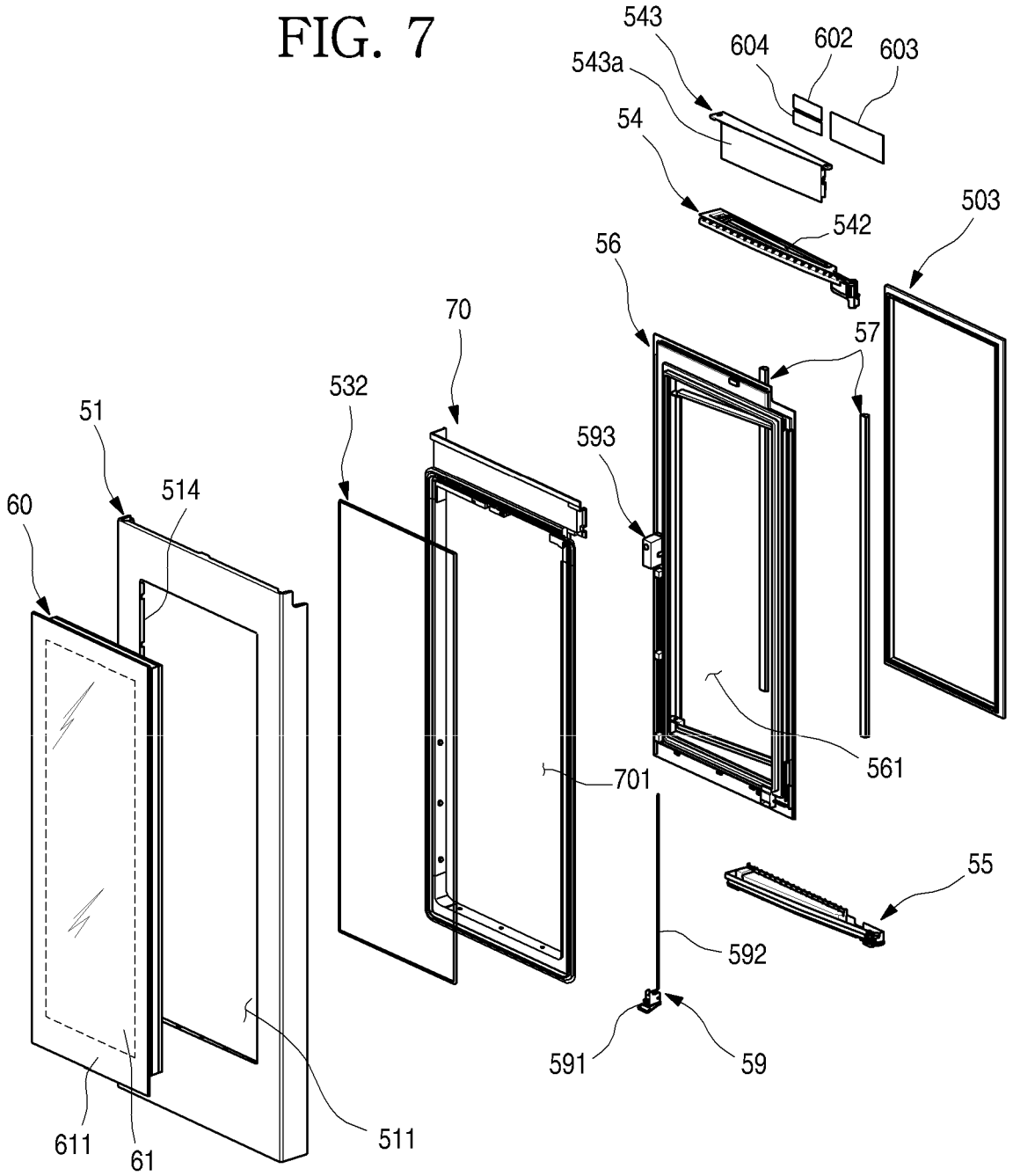
FIG. 7 is an exploded perspective view illustrating the sub-door.

FIG. 5 is a perspective view illustrating the sub-door when viewed from the front side. FIG. 6 is a perspective view illustrating the sub-door when viewed from the rear side. Further, FIG. 7 is an exploded perspective view illustrating the sub-door.

As illustrated in the drawings, the sub-door 50 may include an out plate 51 defining an outer appearance, a door liner 56 spaced apart from the out plate 51, the transparent panel assembly 60 mounted on an opening of the out plate 51 and the door liner 56, and an upper cap decoration 54 and a lower cap decoration 55 defining an upper surface and a lower surface of the sub-door 50, and an outer appearance of the sub-door 50 may be defined by a combination of them.

The out plate 51, which defines the front surface and a portion of a peripheral surface of the sub-door 50, may be formed of a plate-shaped stainless material. The out plate 51 may define a portion of the outer appearance of the sub-door 50 as well as the front surface of the sub-door 50. Further, the out plate 51 may be formed of the same material as that of the front surfaces of the refrigerating chamber door 20 and the freezing chamber door 30. The front surface of the outer plate 51 may be subjected to various surface treatments such as anti-fingerprint coating, a hair line, coating for realizing a color or a pattern, and attachment of a film.

The outer plate 51 may include a front surface part 512 defining an outer appearance of the front surface thereof, and side surface parts 513 defining outer appearances of side surfaces thereof exposed to the outside. Further, a plate opening 511 may be formed at the center of the front surface part 512, and the plate opening 511 may be shielded by the transparent panel assembly 60. Further, because the interior of the refrigerator 1 may be seen through the transparent panel assembly 60 configured to shield the plate opening 511, the inner side of the plate opening 511 may be referred to as the see-through part 21.

The front surface part 512 may be formed to have a curvature such that the front surface part 512 is lowered as it goes from the central side to the outer side of the refrigerator 1. The front surface part 512 may be rounded to correspond to the front surface of the neighboring refrigerating chamber door 20, and an outer appearance of the front surface of the refrigerator may be overall seen to be in three dimensions.

Further, a bent plate part 514 which is bent rearwards may be formed along a peripheral surface of the plate opening 511. The bent plate part 514 may be formed along the periphery of the plate opening 511, and may extend in a predetermined length such that the bent plate part 514 may be inserted into and fixed to a support frame 70, which will be described below in detail. Thus, the plate opening 511 may be also defined by the bent plate part 514.

The side surface parts 513 which are bent rearwards may be formed at opposite ends of the front surface part 512. The side surface parts 513 may define outer appearances of the side surfaces of the sub-door 50. Further, ends of the side surface parts 513 may be bent inwards to be coupled to the door liner 56. Further, an upper end and a lower end of the front surface part 512 may be also bent inwards to be coupled to the upper cap decoration 54 and the lower cap decoration 55.

Meanwhile, an upper end and a lower end of the outer plate 51 may be also bent, and may be coupled to the upper cap decoration 54 and the lower cap decoration 55. Thus, the outer plate 51 may be coupled to the door liner 56, the upper cap decoration 54, and the lower cap decoration 55, to define an outer appearance of the sub-door 50.

The door liner 56 defines the rear surface of the sub-door 50, and a liner opening 561 is formed in an area in which the transparent panel assembly 60 is arranged. Further, a sub-gasket 503 configured to seal a gap between the sub-door 50 and the main door 40 may be mounted on the rear surface of the door liner 56.

Further, door lights 57 may be provided on opposite sides of the liner opening 561. The door lights 57 may be configured to illuminate the rear surface of the sub-door 50 and the rear side of the transparent panel assembly 60. The door lights 57 may be referred to as lighting members, and the lighting members may include another light provided inside the storage space to illuminate the interior of the refrigerator 1 as well as the door lights 57.

Thus, the door lights 57 may illuminate the internal space of the storage case 43, and at the same time, may functions as auxiliary backlights for the transparent panel assembly 60 to make the screen clearer when the screen of the transparent panel assembly 60 is output. When the door lights 57 are lighted, an interior of the storage case 43 becomes brighter. Thus, the interior of the refrigerator 1 is brighter than an exterior of the refrigerator 1, so that a rear space of the sub-door 50 may be visualized through the transparent panel assembly 60.

The door lights 57 may be arranged on opposite sides of the transparent panel assembly 60 to face each other. The door lights 57 may be arranged at various positions as long as the rear side of the sub-door 50 may have a sufficient brightness.

Further, the opening device 59 may be mounted on the door liner 56. The opening device 59 may include a manipulation member 591 exposed to the lower end of the sub-door 50, a rod 592 extending from the manipulation member 591, and a locking member 593 protruding from the rear surface of the door liner 56. The rod 592 moves the locking member 593 by manipulation of the manipulation member 592 by the user, so that the sub-door 50 is selectively restrained to the main door 40, and opening/closing of the sub-door 50 may be manipulated.

The upper cap decoration 54, which defines an upper surface of the sub-door 50, is coupled to upper ends of the outer plate 51 and the door liner 56. The upper surface of the upper cap decoration 54 is opened so that a decoration opening 542 communicating with an upper space of the transparent panel assembly 60 is formed, and is shielded by a decoration cover 543. Further, a printed circuit board (PCB) mounting part 543*a* is formed in the decoration cover 543, so that PCBs 602, 603, and 604 for operating electrical components inside the transparent panel assembly 60 and the sub-door 50 may be mounted on the PCB mounting part 543*a*. The PCBs 602, 603, and 604 may be configured in at least one module form, and may be provided in a closed space on an upper side of the sub-door 50.

At this time, the space on the upper side of the sub-door 50 may be partitioned into front and rear spaces by an upper portion of the support frame 70, an insulator 531*a* may be arranged in the front space, and the PCBs 602, 603, and 604 may be arranged in the rear space. The structure of the space on the upper side of the sub-door 50 will be described with reference to FIG. 27.

The lower cap decoration 55, which defines a lower surface of the sub-door 50, is coupled to lower ends of the outer plate 51 and the door liner 56.

The transparent panel assembly 60 may be arranged between the outer plate 51 and the door liner 56. Further, the transparent panel assembly 60 may be configured to shield the plate opening 511 and tee door liner opening 561. Further, the transparent panel assembly 60 may be selectively manipulated by the user in one of a transparent state, a translucent state, an opaque state, and a screen outputting state.

Thus, the user may selectively see through the internal space of the sub-door 50 through the transparent panel assembly 60, and may view the screen output through the transparent panel assembly 60 as well.

Of course, the transparent panel assembly 60 may not include a display 62 for outputting a screen, and the transparent panel assembly 60 without the display 62 may have the same outer appearance as that of the transparent panel display 60 having the display 62 only with a difference in that the screen is not output.

The support frame 70 configured to support the transparent panel assembly 60 is mounted on a periphery of the plate opening 511 of the outer plate 51. The transparent panel assembly 60 may be fixed and mounted to the outer plate 51 by the support frame 70. In particular, the front surface of the outer plate 51 and the front surface of the transparent panel assembly 60 are arranged on the same extension line, so that the front surface of the sub-door 50 may have a sense of unity.

The support frame 70 has a frame opening 701 formed at a center thereof, and the frame opening 701 is formed to be slightly smaller than the plate opening 511, so as to provide a structure on which the transparent panel assembly 60 may be seated. Further, the frame opening 701 may be formed to be smaller than a front panel 61 and to be larger than a rear panel 65. Thus, when the transparent panel assembly 60 is mounted, the rear panel 65 may sequentially pass through the plate opening 511 and the frame opening 701, and then may be seated on the door liner 56.

Further, the support frame 70 has a coupling structure with the outer plate 51, and the outer plate 51 and an end of the transparent panel assembly 60 may be mounted in close contact with each other. Thus, when the sub-door 50 is viewed from the front side, an end of the outer plate 51 and a periphery of the transparent panel assembly 60 are in close contact with each other, so that a gap between the out plate 51 and the transparent panel assembly 60 is rarely viewed or is viewed in a form of a line, and the outer appearance of the front surface may be viewed as having senses of continuity and unity.

The support frame 70 supports the outer plate 51 and the transparent panel assembly 60 and, at the same time, also has a fixing structure for a heater 532 arranged on the rear surface of the transparent panel assembly 60. Thus, the heater 532 may be arranged on the rear surface of the transparent panel assembly 60 while being mounted on the support frame 70, and at this time, may be arranged on a bezel 611 formed along a periphery of the front panel 61, so that structures of the heater 532 and the support frame 70 may not be exposed to the outside.

Hereinafter, the structures of the transparent panel assembly and the support frame will be described in more detail.

Figure 8:
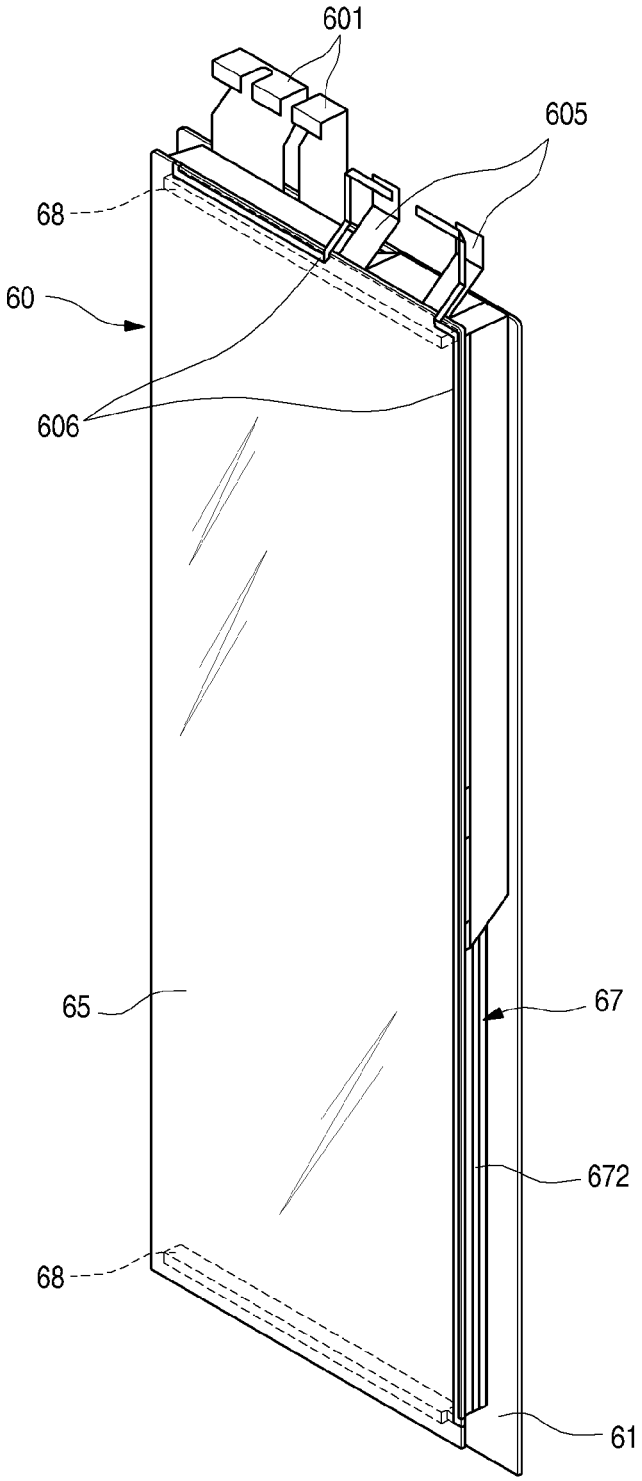
FIG. 8 is a perspective view illustrating a transparent panel assembly according to the first embodiment of the present disclosure.
Figure 9:
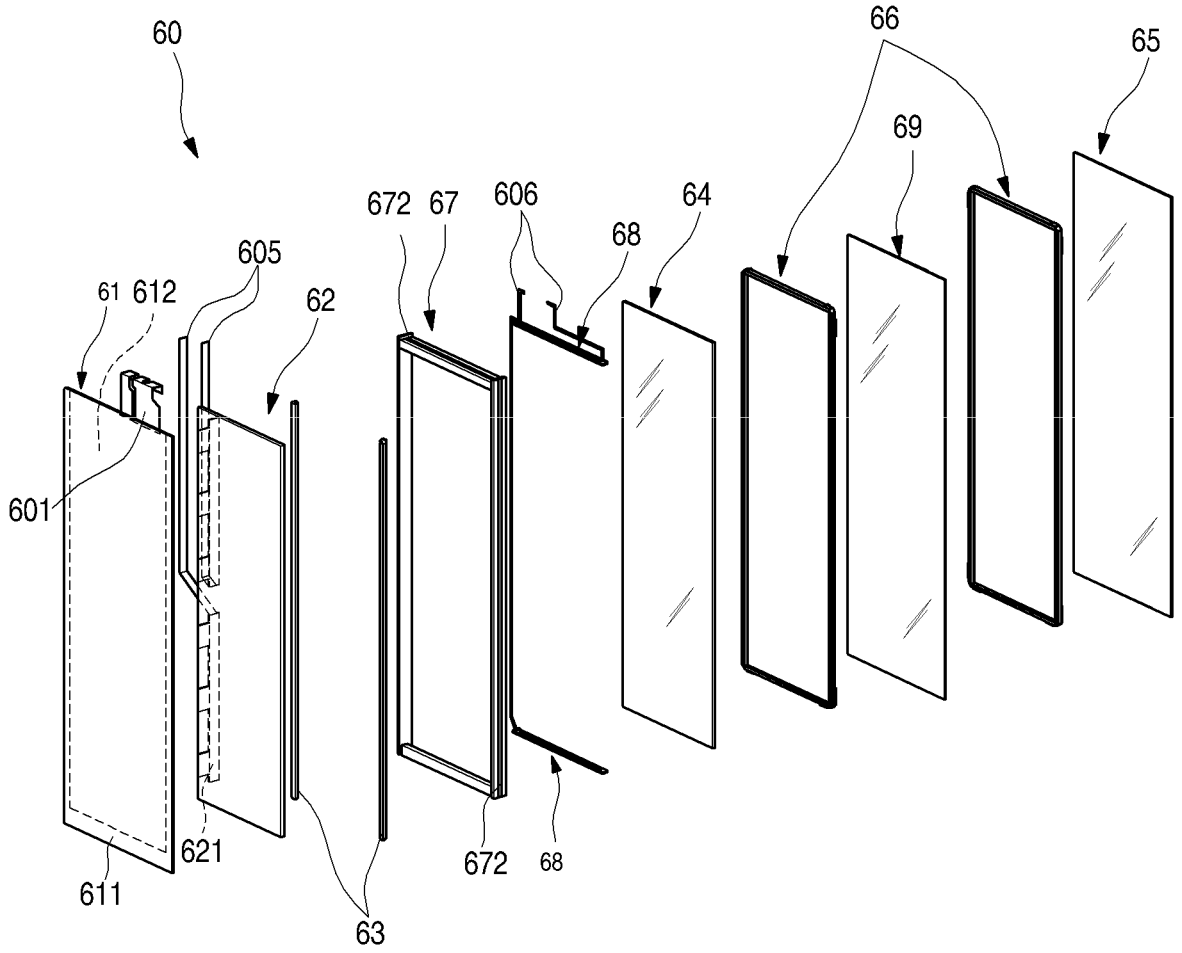
FIG. 9 is an exploded perspective view illustrating the transparent panel assembly.
Figure 10:
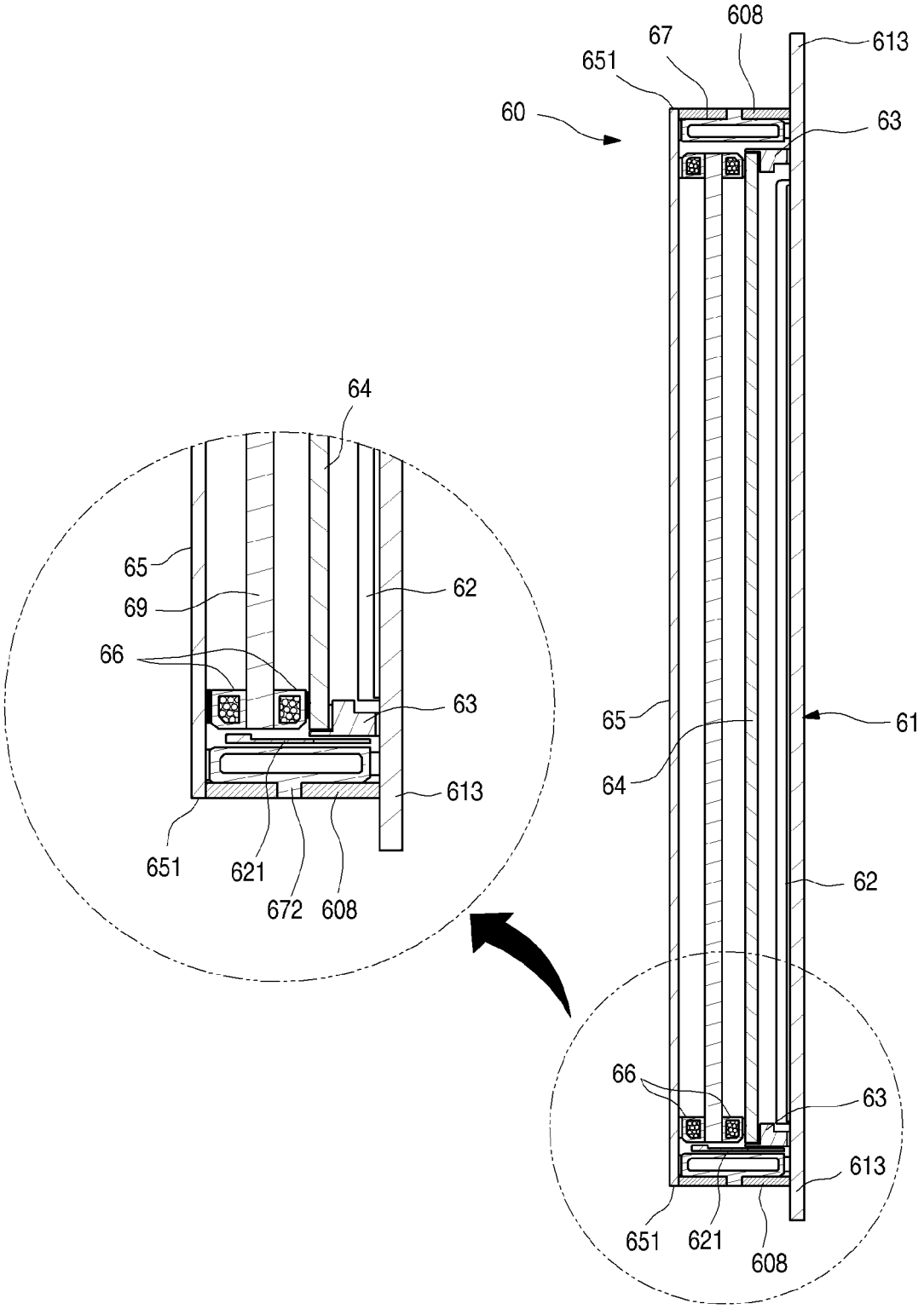
FIG. 10 is a sectional view illustrating the transparent panel assembly.

FIG. 8 is a perspective view illustrating a transparent panel assembly according to the first embodiment of the present disclosure. Further, FIG. 9 is an exploded perspective view illustrating the transparent panel assembly. Further, FIG. 10 is a sectional view illustrating the transparent panel assembly.

As illustrated in the drawings, the transparent panel assembly 60 may be formed to have a size in which the transparent panel assembly 60 may shield the plate opening 511 and the liner opening 561 from the inner side of the sub-door 50. Further, the see-through part 21 may be formed such that a space in the refrigerator 1 may be selectively visualized and the screen may be output.

The transparent panel assembly 60 may be configured by a plurality of panels having a shape of a plate, and may be configured such that the panels are spaced apart from each other by at least one spacer at a specific interval. The transparent panel assembly 60 may include the front panel 61 and the rear panel 65 defining at least the front surface and the rear surface thereof, and a spacer connecting the front panel 61 and the rear panel 65 between the front panel 61 and the rear panel 65, and may have a structure in which an additional panel and an additional spacer are further provided in an internal space defined by the spacer.

The transparent panel assembly 60 will be described with reference to the drawings. The outer shape of the transparent panel assembly 60 may be defined by the front panel 61 and the rear panel 65 defining the front surface and the rear surface of the transparent panel assembly 60, and an outer spacer 67 connecting the front panel 61 and the rear panel 65 to each other.

Further, between the front panel 61 and the rear panel 65, the display 62 and a light guide plate 64 may be arranged, a first spacer 63 configured to support the display 62 and the light guide plate 64 may be further provided, and display lights 68 configured to irradiate light to the light guide plate 64 may be provided.

In more detail, the front panel 61, which defines an outer appearance of the front surface of the transparent panel assembly 60, may be formed of transparent glass (for example, blue glass). Of course, the front panel 61 may be formed of another material through which the interior of the refrigerator may be seen and a touch input may be performed.

Further, a film, through which light selectively passes depending on an ON/OFF state of a light inside the refrigerator 1 or a light provided in the sub-door 50 so that the film may be selectively transparent or opaque, may be arranged on the rear surface of the front panel 61.

The front panel may be formed to have a size corresponding to the size of the plate opening 511, and may be formed to be larger than the size of the frame opening 701. Thus, the periphery of the front panel 61 may be supported by the support frame 70. Further, in a state in which the transparent panel assembly 60 is mounted, an end of the front panel 61 may be in contact with an end of the plate opening 511, and a space may not be formed between the plate opening 511 and the front panel 61.

In detail, the front panel 61 may have a front protrusion 613 formed therein to protrude more outward than the rear panel 65. Due to structural characteristics of the front protrusion 613 inserted into and mounted on the front side of the outer plate 51, the front protrusion 613 may protrude more upward/downward/leftward/rightward than the rear panel 65 and the outer spacer 67. Thus, the front panel 61 defining the front surface of the transparent panel assembly 60 may further extend outward the frame opening 701, and thus may be stably supported by the support frame 70. The rear panel 65 and the like as well as the outer spacer 67 may be inserted into the frame opening 701.

Further, the support frame 70 and the outer spacer 67 of the transparent panel assembly 60 may be fastened and coupled to each other through a separate coupling structure or coupling members 78 such as a screw. Thus, when the transparent panel assembly 60 is mounted, the front protrusion 613 may be supported by the support frame 70, and at the same time, the support frame 70 may be coupled to the outer spacer 67, so that the heavy transparent panel assembly 60 may be maintained in a stably fixed and mounted state even when the sub-door 50 is opened/closed.

Meanwhile, the bezel 611 may be formed along a periphery of the rear surface of the front panel 61. The bezel 611 may be formed by printing with an opaque color such as black, and may be formed to have a predetermined width such that the outer spacer 67, the first spacer 63, the heater 532, and the like may be covered without being exposed to the outside. The bezel 611 may be formed to have a width from an outer end of the front panel 61 to the first spacer 63.

A touch sensor 612 may be arranged on the rear surface of the front panel 61. The touch sensor 612 may be formed on the rear surface of the front panel 61 in a printing scheme, and may be configured to detect a touch operation on the front panel by the user. Of course, the touch sensor 612 may employ various other schemes such as a film bonding scheme not the printing scheme, in which input may be performed through a touch on the front panel 61.

A touch cable 601 connected to the touch sensor 612 may be provided at an upper end of the front panel 61. The touch cable 601 may be a flexible film type cable such as a flexible flat cable (FFC) and a flexible print cable or a flexible print circuit board (FPC), and a printed circuit may be printed on the touch cable 601 to form at least a portion of a touch PCB 603. Further, the touch cable 601 may be connected to the touch PCB 603 provided above the sub-door 50.

The touch cable 601 may be connected to the touch sensor 612 and may extend upwards. Further, the touch cable 601 may be configured such that wires are arranged in a base, such as a film, formed of resin, and may upwards extend along the rear surface of the front panel 61. The touch cable 601 may be formed to have a thin thickness and a wide width, which is similar to a sheet, and thus may be flexibly bent.

Further, the touch cable 601 may be configured in a film type, and may have a structure in which an end of the touch cable 601 is easily inserted into a connector of the touch PCB 603 when the touch cable 601 is connected to the touch PCB 603. To achieve this, the touch cable 601 may be bent several times, and the end of the touch cable 601 may be formed toward the connector on the touch PCB 603. Further, the touch cable 601 is bent to be arranged along a wall surface of the internal space of the sub-door 50, so that the space inside the sub-door 50 may be efficiently arranged.

Further, in addition to the touch cable 601, display cables 605 and display light cables 606 may be formed to have the same structure. In this way, all the cables 601, 605, and 606 formed to have a flat cable shape may extend to an upper end of the transparent panel assembly 60, and may be efficiently arranged on the sub-door 50 having a thin thickness and a wide width. In addition, the cables 601, 605, and 606 may provide a simple connection structure with the PCBs 602, 603, and 604 arranged above the sub-door 50.

Meanwhile, the display 62 may be provided on the rear surface of the front panel 61. The display 62 may be a liquid crystal display (LCD) module configured to output a screen, and may be transparent to be seen through in a state in which the screen is not output.

Source boards 621 may be provided at one end of opposite left and right ends of the display 62. The source boards 621, which are adapted to output the screen of the display 62, may be formed in an assembly state while being connected to the display 62. Further, portions of the source boards 621 may also include a flexible film type cable structure.

Further, the widths of the source boards 621 may be smaller than the thickness of the transparent panel assembly 60, and may be bent while the transparent panel assembly 60 is assembled. At this time, the source boards 621 may be arranged between the outer spacer 67 and the first spacer 63, and may be in contact with an inner surface of the outer spacer 67 while being perpendicular to the front panel 61.

Further, the source boards 621 may be connected to the display cables 605, and the display cables 605 may be connected to the T-CON board 602 above the sub-door 50.

In detail, when the source boards 621 are arranged on the rear surface of the display 62, the source boards 621 may be exposed to the outside through the see-through part 21 due to characteristics of the display 62 which is transparent. Further, when the source boards 621 have a structure protruding sideward, there is a problem in that the size of the sub-door 50 is enlarged.

Thus, the source boards 621 may be formed at a peripheral end of the display 62, and may be provided between the outer spacer 67 and the first spacer 63. Further, the source boards 621 may be formed to have a size corresponding to the outer spacer 67 so as not to depart from the outer spacer 67 in a state in which the source boards 621 are in close contact with the outer spacer 67.

Meanwhile, the two upper and lower source boards 621 may be formed, and may be connected to the pair of display cables 605, respectively. The display cables 605 may have a flexible and flat structure, which is similar to the touch cable 601, and may have a freely-bent structure.

The display cables 605 may extend along a peripheral surface of the transparent panel assembly 60, and may pass through a sealant 608 defining the peripheral surface of the transparent panel assembly 60 to extend to the outside of the transparent panel assembly 60.

Further, the display cables 605 may be bent to extend along the peripheral surface of the transparent panel assembly 60, and may be bent such that ends of the display cables 605 may extend upwards. Thus, the display cables 605 may be coupled to the T-CON board 602 above the sub-door 50.

Meanwhile, opposite ends of the display 62 may be supported by the first spacer 63. The first spacer 63 may be formed to have a rod shape extending from an upper end to a lower end of the display 62, and may be formed of aluminum.

The light guide plate 64 may be located behind the display 62, and may be spaced apart from the display 62 by a predetermined distance by the first spacer 63. Here, a sense of depth of the screen output on the display 62 may differ according to the position of the light guide plate 64.

The light guide plate 64, which is adapted to diffuse or scatter light irradiated by the display lights 68, may be formed of various materials. For example, the light guide plate may be formed of polymer, and may be formed such that a pattern is formed on a surface of the light guide plate 64 or a film is attached to the surface of the light guide plate 64. The light guide plate 64 is configured to illuminate the display 62 on the rear side in a state in which the display lights 68 are switched on. To achieve this, the light guide plate 64 may be formed to have a plate shape having a size that is equal to or slightly larger than the size of the display 62, and the display lights 68 may be provided at locations corresponding to an upper end and a lower end of the light guide plate 64.

Of course, when the display 62 is not provided, a separate glass or a heat insulating glass instead of the light guide plate 64 may be arranged.

The rear panel 65 may be arranged behind the light guide plate 64. The rear panel 65, which defines the rear surface of the transparent panel assembly 60, may be formed to be larger than the light guide plate 64 and to be smaller than the front panel 61. Further, the rear panel 65 may be formed to be larger than the liner opening 561, and may shield the liner opening 561.

Meanwhile, the periphery of the rear panel 65 may protrude more outward than the outer spacer 67, to form a rear panel protrusion 651. The rear panel protrusion 651 may have a protruding portion which may be seated on the door liner 56 when the transparent panel assembly 60 is mounted, and may define a space in which the sealant applied to the periphery of the sub-door 50 may be filled.

For insulation, the rear panel 65 may be formed of low-E glass. Thus, the rear panel 65 may prevent cold air in the refrigerator 1 from being heat-exchanged with the outside through the transparent panel assembly 60.

A pair of second spacer 66 may be provided between the rear panel 65 and the light guide plate 64. The second spacers 66 may be formed to have a shape of a quadrangular frame formed along the periphery of the light guide plate 64, and may adhere to the light guide plate 64 and the rear panel 65 so that the light guide plate 64 and the rear panel 65 may be spaced apart from each other by a predetermined distance. Further, a heat insulating glass 69 may be provided between the pair of second spacer 66. A multi-layered insulating layer may be provided between the light guide plate 64 and the rear panel 65 by the heat insulating glass 69. Of course, a structure in which the light guide plate 64 and the rear panel 65 are fixed to each other by one second spacer 66 without the heat insulating glass 69 may be adopted as needed.

In the embodiment of the present disclosure, all the spacers 63, 66, and 67 have different structures, but perform support to maintain an interval between the neighboring panels 61 and 65 or the light guide plate 64. Further, various forms such as a rod and a form in which a moisture absorbent is accommodated may be applied to the spacers 63, 66, and 67.

The interval between the front panel 61 and the light guide plate 64 is maintained at a fixed interval to output the screen of the display 62. Further, the interval between the light guide plate 64 and the rear panel 65 may be determined based on the thickness of the sub-door 50 or the entire thickness of the transparent panel assembly 60. That is, as the thickness of the second spacers 66 is adjusted, the entire thickness of the transparent panel assembly 60 is determined, and thus the transparent panel assembly 60 may be mounted in accordance with the specification of the sub-door 50.

Meanwhile, the rear panel 65 may be in contact with the door light 57, and a distance between the display 62 and the door lights 57 may be determined based on the position of the rear panel 65. A space behind the transparent panel assembly 60 may be illuminated by the door lights 57, making it possible to visualize the storage space. Further, the door lights 57 may function as auxiliary backlights of the display 62 in a lit state.

A space between the light guide plate 64 and the rear panel 65 may be sealed by the second spacers 66. Thus, a space between the second spacers 66 and the light guide plate 64 is made to be in a vacuum state or an adiabatic gas for insulation, such as argon, is injected into the space, so that insulation performance may be further improved.

In a state in which the rear panel 65 adheres to the second spacers 66, an outer end of the rear panel 65 may extend more outward than the second spacers 66. Further, the outer spacer 67 is mounted to the outer end of the rear panel 65, the rear panel 65 and the front panel 61 may be fixed to each other.

The outer spacer 67 may be formed to have a shape of a rectangular frame, and the outer spacer 67 may connect the rear surface of the front panel 61 and the front surface of the rear panel 65 to each other, and at the same time, may define the peripheral surface of the transparent panel assembly 60.

In detail, the outer spacer 67 defines a periphery of an outer portion of the transparent panel assembly 60, and at the same time, has a structure for connecting the front panel 61 at a specific interval.

A space between the front panel 61 and the rear panel 65, that is, an internal space of the outer spacer 67, may be completely sealed by coupling of the outer spacer 67. Further, the inside of the outer spacer 67 may be further sealed by the sealant 608 applied to the periphery of the outer spacer 67.

The display 62 and the light guide plate 64 ay be spaced forward/rearward apart from each other in the space sealed by the outer spacer 67, and the first spacer 63 and the second spacers 66 for maintaining the interval of the light guide plate 64 may be also provided in the internal space of the outer spacer 67.

Of course, an additional insulation panel or a multi-layered glass structure may be further provided inside the outer spacer 67, and these configurations may be provided inside the space defined by the outer spacer 67.

That is, the overall appearance of the transparent panel assembly 60 may be defined by the front panel 61, the rear panel 65, and the outer spacer 67, and all the other configurations may be provided inside the outer spacer 67. Thus, only the spaces between the outer spacer 67, the front panel 61, and the rear panel 65 are sealed, so that the multi-layered panel structure may be completely sealed.

In particular, even when a plate-shaped structure as well as the light guide plate 64 is further provided inside the outer spacer 67, if only the outermost outer spacer 67 adheres to the front panel 61 and the rear panel 65, a sealing structure of the transparent panel assembly 60 may be completed. Such a sealing structure may maintain the minimum sealing points even in the multi-layered structure by a plurality of panels including the light guide plate 64.

Thus, a probability that external air is introduced into the transparent panel assembly 60 or dew is condensed inside the transparent panel assembly 60 due to moisture permeation may be minimized. Further, the inside of the outer spacer 67 is made to be in a vacuum state or a gas for insulation is injected into the outer spacer 67, a heat insulating layer may be formed in the entire multi-layered structure inside the transparent panel assembly 60, thereby further improving insulation performance.

As a result, as the transparent panel assembly 60 is arranged inside the sub-door 50, the interior of the refrigerator may be seen, the screen may be output, and an insulation structure may be completed in the multi-layered panel structure, so that insulation performance may be ensured.

Further, a space on which the display lights 68 may be mounted may be provided on an inner surface of the outer spacer 67. The display lights 68 may be mounted at an upper end and a lower end of the outer spacer 67, and the light guide plate 64 may be located between the display lights 68 arranged at the upper end and the lower end of the outer spacer 67.

Thus, light irradiated by the display lights 68 may be directed toward an end of the light guide plate 64, and may be moved along the light guide plate 64 so that the light guide plate 64 may emit light from the entire surface thereof.

Meanwhile, the display lights 68 located at an upper end and a lower end of the inside of the transparent panel assembly 60 may be connected to the display light cables 606. The display light cables 606 may be formed to have a flexible and flat shape, which is like the touch cable 601 and the display cables 605.

The display light cables 606 may be connected to the display lights 68 mounted inside the outer spacer 67 and may extend toward the outside of the transparent panel assembly 60.

Further, the display light cables 606 may extend along a periphery of the transparent display 62 so as not to be exposed through the transparent display 62. Further, the display light cables 606 may extend upwards while being in close contact with the rear panel 65, and may be bent while being in contact with the rear surface of the rear panel 65, to be connected to the docking PCB 604 above the sub-door 50 as needed.

Here, the display light cables 606 extends while being in close contact with the peripheral surface of the rear panel protrusion 651 of the rear panel 65, and thus is not exposed through the transparent panel assembly 60 when viewed from the outside of the sub-door 50.

The sealant 608 may be applied to a periphery of the outer spacer 67. The sealant 608 may be applied to form the peripheral surface of the transparent panel assembly 60, and forms a peripheral surface between the front panel 61 and the rear panel 65.

The sealant 608, which performs sealing to prevent air from being introduced into the transparent panel assembly 60, may be formed of polysulfide (referred to as "thiokol"). Of course, if necessary, the sealant 608 may be formed of other sealant materials such as silicone and urethane which may be directly in contact with foam liquid injected to form the insulator 531.

By the sealant 608, the coupling between the outer spacer 67, the front panel 61, and the rear panel 65 may be maintained, and at the same time, connection portions between components may be completely sealed, so that moisture may be prevented from being introduced. Further, the sealant 608, which is a portion directly in contact with the foam liquid when the insulator 531 is formed, may protect the periphery of the transparent panel assembly 60.

Further, the cables 601, 605, and 606 connected to the touch sensor 612, the display panel 62, and the display lights 68 inside the transparent panel assembly 60 may be input/output through the sealant 608. That is, the sealant 608 may block outer surfaces of the cables 601, 605, and 606 when the cables 601, 605, and 606 extend to the outside through the peripheral surface of the transparent panel assembly 60, to prevent water or moisture from being introduced into a space through which the cables 601, 605, and 606 are input/output.

Figure 11:
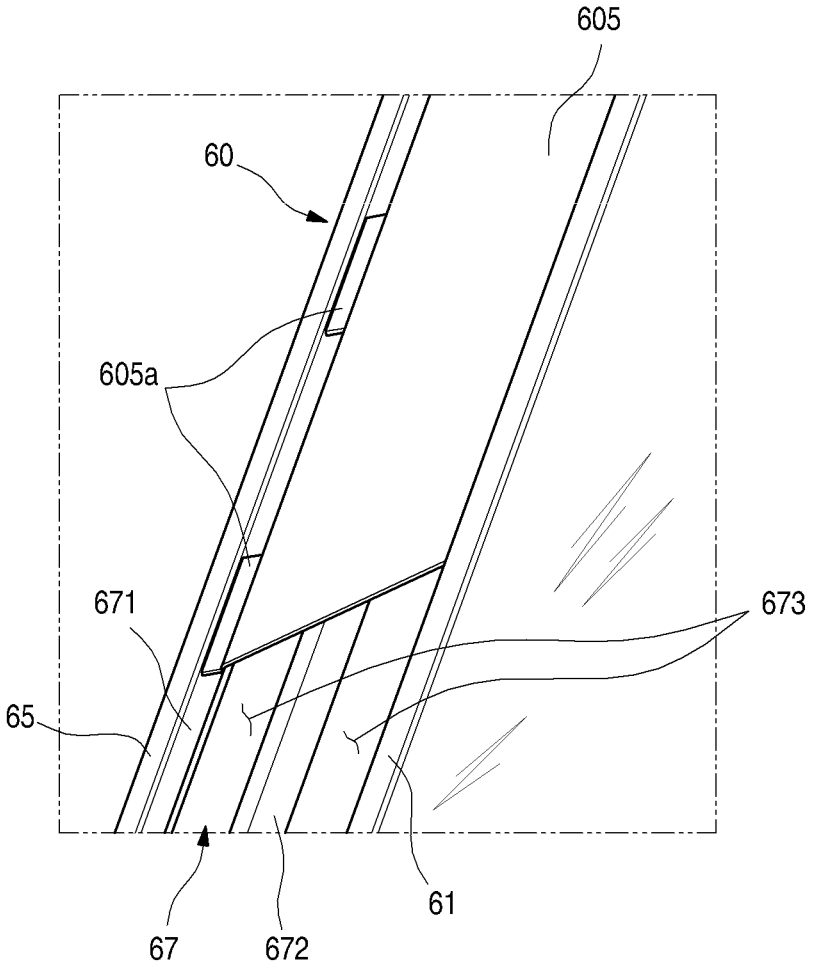
FIG. 11 is a partial perspective view illustrating an arrangement state of a display cable of the transparent panel assembly.

FIG. 11 is a partial perspective view illustrating an arrangement state of a display cable of the transparent panel assembly.

As illustrated in the drawing, the display cables 605 may be connected to the source boards 621 to extend upwards, may extend along a periphery of the side surface of the transparent panel assembly 60, and then may be connected to the T-CON board 602.

The display cables 605 may be connected to the source boards 621 inside the transparent panel assembly 60, and may be guided to the outside of the outer spacer 67 through a space between the rear panel 65 and the outer spacer 67.

In detail, cable connectors 605*a* may be formed in the display cables 605. The cable connectors 605*a* may be introduced into the transparent panel assembly 60 in a space between the rear panel 65 and an end of the outer spacer 67, and may be connected to the source boards 621 in an internal space of the transparent display 62.

The cable connectors 605*a* may be guided to an outer surface of the transparent panel assembly 60 through a space between a gap of an adhesive member 671 allowing the rear panel and the outer spacer 67 to adhere to each other and the sealant 608. Thus, the display cables 605 may pass through the sealed periphery of the sealed transparent panel assembly to be guided to the outside.

In this state, the display cables 605 may extend upwards in a bent state to be in contact with the outer surface of the transparent assembly 60 to which the sealant 608 is applied, and may be bent again to be connected to the T-CON board 602. That is, the display cables 605 may extend to be connected to the T-CON board 602 while being exposed to the outside of the transparent panel assembly 60.

Figure 12:
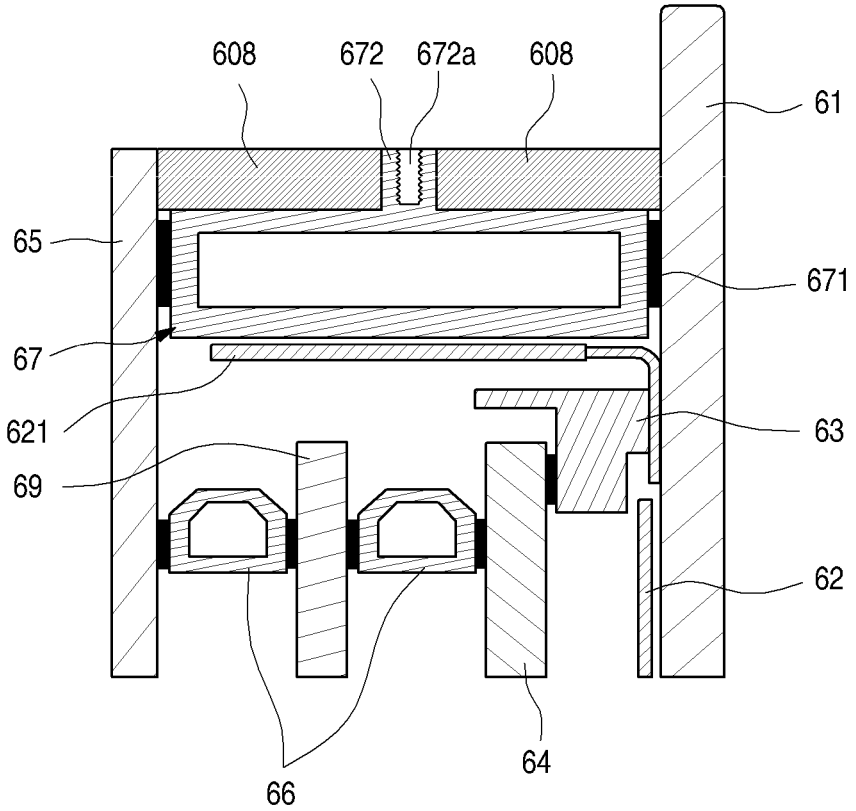
FIG. 12 is a sectional view illustrating a state in which a sealant is applied to opposite ends of the transparent panel assembly.
Figure 13:
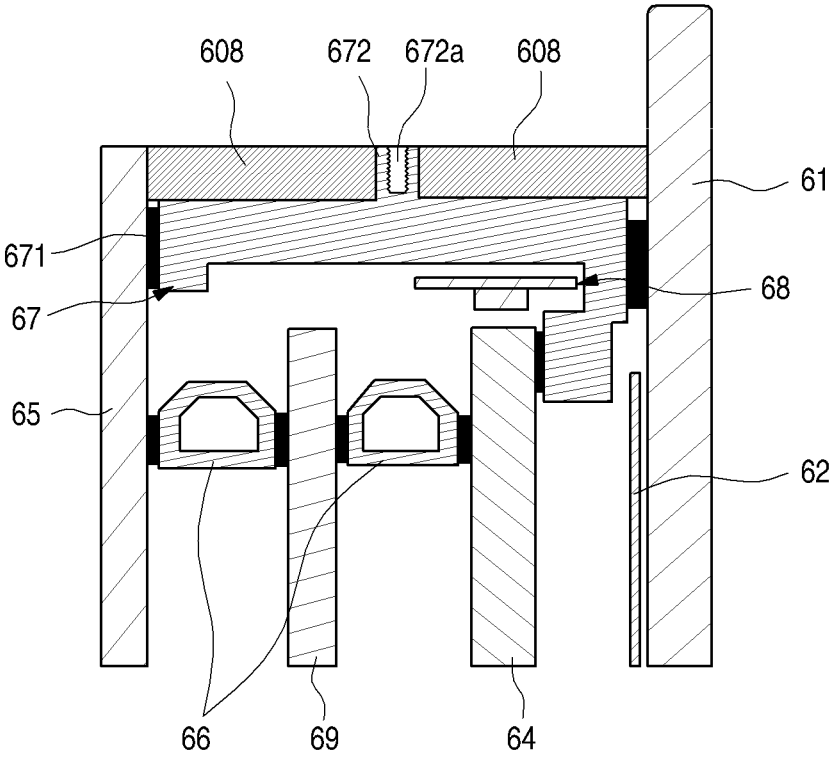
FIG. 13 is a sectional view illustrating a state in which a sealant is applied to upper and lower ends of the transparent panel assembly.
Figure 14:
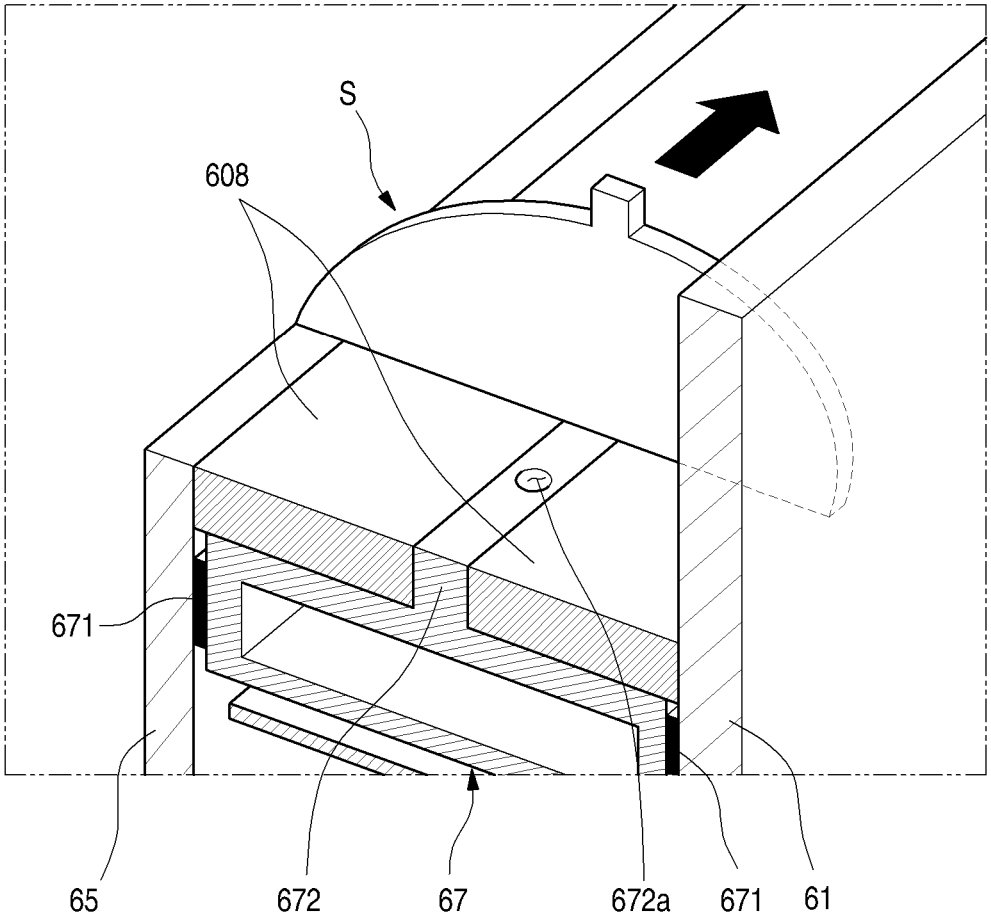
FIG. 14 is a view illustrating a process of applying a sealant to the transparent panel assembly.

FIG. 12 is a sectional view illustrating a state in which a sealant is applied to opposite ends of the transparent panel assembly. Further, FIG. 13 is a sectional view illustrating a state in which a sealant is applied to upper and lower ends of the transparent panel assembly. Further, FIG. 14 is a view illustrating a process of applying a sealant to the transparent panel assembly.

As illustrated in the drawings, the sealant 608 may be applied to the periphery of opposite left and right surfaces and upper and lower surfaces of the transparent panel assembly 60. The sealant 608 may be applied to a gap between the front panel and the rear panel 65, and may be configured to cover the outer side of the outer spacer 67.

The transparent panel assembly 60 may be mounted in a state in which the sealant 608 is applied, and may be supported by the support frame 70. Thus, there is a problem in that when the sealant 608 does not have a uniform surface, if the transparent panel assembly 60 is assembled, the transparent panel assembly 60 may be incorrectly assembled by interference with the support frame 70 or other neighboring components or a failure may occur.

In particular, when an interval between the front panel 61 and the rear panel 65 is large, it is not easy to uniformly apply the sealant 608, and the sealant 608 may be biased to one side or may have an uneven surface in a local section.

To prevent such a problem, a spacer protrusion 672 may be formed on an outer surface of the outer spacer 67. The spacer protrusion 672 may be located at the center in the widthwise direction of the outer spacer 67, and may extend along the lengthwise direction of the outer spacer 67. The spacer protrusion 672 may continuously extend from one end to the other end of the outer spacer 67, and if necessary, the spacer protrusions 672 having a specific length may be continuously arranged at a specific interval.

Further, the spacer protrusion 672 may protrude to a height corresponding to the height of the rear panel 65. Thus, the space between the front panel 61 and the rear panel 65 may be partitioned into two spaces by the spacer protrusion 672, and the sealant 608 may be filled in the two spaces.

Meanwhile, as illustrated in FIG. 14, to allow the sealant 608 to have a uniform height, after the sealant 608 is filled in spaces 673 on opposite sides of the spacer protrusion 672, the level of the sealant 608 may be adjusted using a separate jig or a scraper S.

In detail, when the jig or the scraper S comes into contact with the peripheral surface of the transparent panel assembly 60 in a state in which the sealant 608 is filled in opposite sides of the spacer protrusion 672, a lower end of the jig or the scraper S comes into contact with a protruding upper surface of the spacer protrusion 672 and an end of the rear panel 65, which has the same height as that of the upper surface of the spacer protrusion 672. Further, the other side of the jig or the scraper S is in contact with the rear surface of the front panel 61, and in this state, when the jig or the scraper S moves, the sealant 608 is filled in the spaces on the opposite sides of the spacer protrusion 672 by the height of the spacer protrusion 672 and the rear panel 65, and the remaining portion may be removed by the jig or the scraper S.

Thus, when the jig or the scraper S moves along the periphery of the transparent panel assembly 60, the sealant 608 may be applied to the periphery of the transparent panel assembly at a uniform height. Further, when the transparent panel assembly 60 is mounted, the sealant 608 may not interfere with the support frame 70 or other components.

After the sealant 608 is applied, the spacer protrusion 672 may be exposed to the peripheral surface of the transparent panel assembly 60. Further, a plurality of fastening holes 672*a* may be formed on the exposed outer surface of the spacer protrusion 672. The plurality of fastening holes 672*a*, to which the coupling members 78 are fastened for coupling with the transparent panel assembly 60, may be formed along the spacer protrusion 672. It is preferable that the fastening holes 672*a* are arranged along the spacer protrusion 672, and are located at a lower portion of the outer spacer 67, which is not interfered by the cables 605.

Meanwhile, as illustrated in FIGS. 12 and 13, the spacer protrusion 672 may be formed at the periphery on the opposite left and right surfaces and the upper and lower surface of the transparent panel assembly 60. Thus, the sealant 608 may be applied to the entire periphery of the transparent panel assembly 60, and upper, lower, left, and right portions of the periphery of the transparent panel assembly 60 may be stably fixed to the support frame 70.

Further, although a structure in which the spacer protrusion 672 is arranged in one row between the front panel 61 and the rear panel 65 is illustrated, if necessary, the spacer protrusion 672 may be configured in a plurality of rows.

Figure 15:
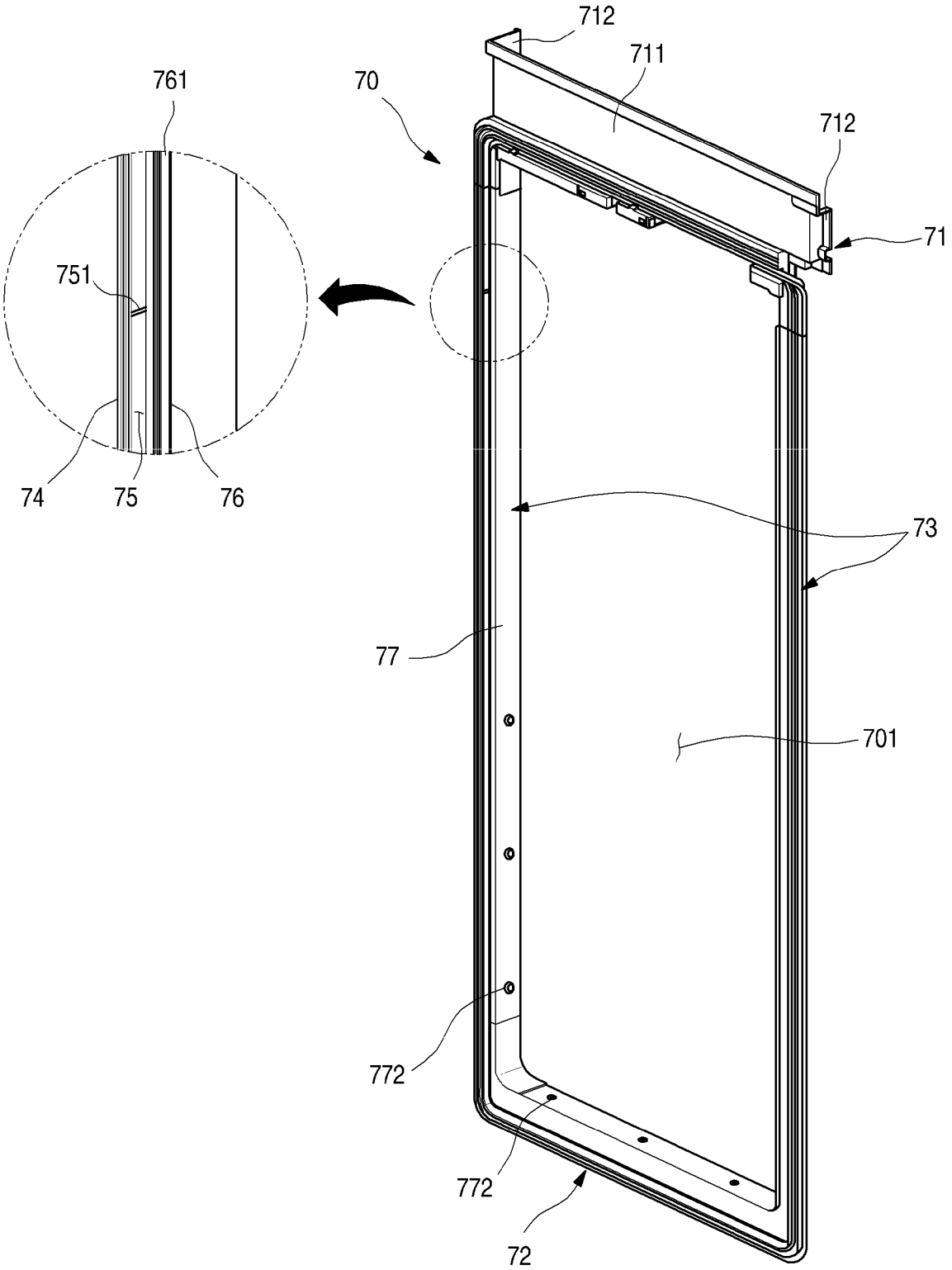
FIG. 15 is a perspective view illustrating a support frame according to the first embodiment of the present disclosure when viewed from the front side.
Figure 16:
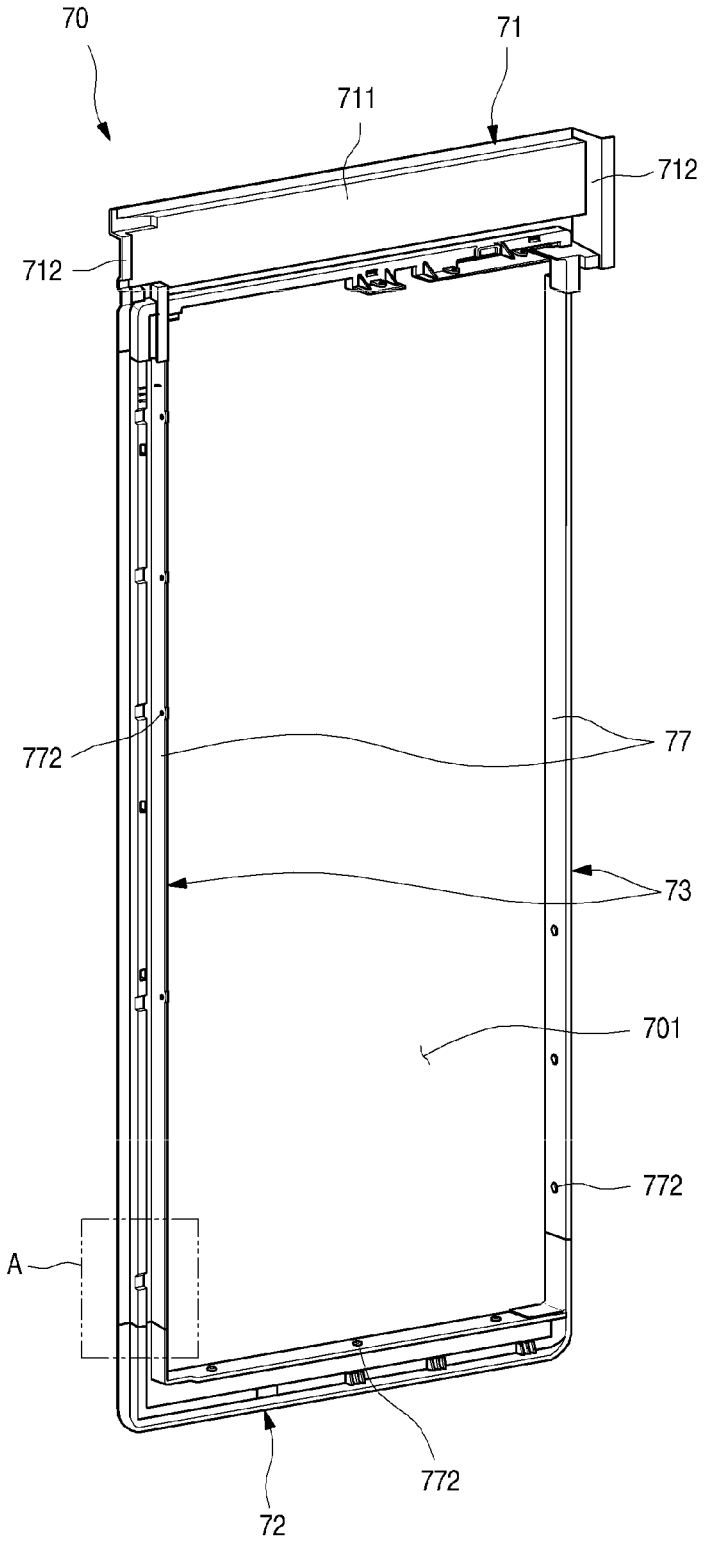
FIG. 16 is a perspective view illustrating the support frame when viewed from the rear side.

FIG. 15 is a perspective view illustrating a support frame according to the first embodiment of the present disclosure when viewed from the front side. Further, FIG. 16 is a perspective view illustrating the support frame when viewed from the rear side.

As illustrated in the drawings, the support frame 70 may be injection-molded using plastic, is formed to have a rectangular frame shape, and has a frame opening 701 formed at the center thereof. Further, the support frame 70 may be formed to have a predetermined width, and may be configured to fix the outer plate 51 and, at the same time, support the transparent panel assembly 60.

The support frame 70 may include an upper frame 71 defining an upper portion thereof, and a lower frame 72 defining a lower portion thereof, and side frames 73 connecting opposite ends of the upper frame 71 and the lower frame 72.

The entire shape of the support frame 70 having a rectangular frame shape may be formed by coupling the upper frame 71, the lower frame 72, and the side frames 73 to each other. In this way, the support frame 70 may be formed by coupling a plurality of components, and thus the components having relatively complex structures may be easily formed.

Meanwhile, the upper frame 71 defines an upper shape of the support frame 70, and may partition an upper space of the sub-door 50 into front and rear spaces. That is, a frame barrier 711 extending to the upper surface of the sub-door 50 may be formed in the upper frame 71, and a space above the sub-door 50 may be partitioned into front and rear spaces by the frame barrier 711.

Further, side barriers 712 may be formed at opposite left and right ends of the frame barrier 711. Thus, the upper side of the sub-door 50 may be partitioned into front and rear spaces by the upper frame 71, and an independent space in which the PCBs 602, 603, and 604 may be accommodated may be provided in the rear space. Further, the space in which the PCBs 602, 603, and 604 are accommodated may communicate with the decoration opening 542 of the upper cap decoration 54. Further, a space in which the insulator 531*a* is accommodated may be formed in the front space.

The lower frame 72 may be coupled to lower ends of the side frames 73, and may be configured to support a lower portion of the outer plate 51 and the lower end of the transparent panel assembly 60.

The side frames 73 define opposite left and right sides of the support frame 70, and vertically extends to connect the upper frame 71 and the lower frame 72 to each other between the upper frame 71 and the lower frame 72. That is, the side frames 73 may be coupled to opposite ends of the upper frame 71 and the lower frame 72.

The entire structure may be configured to have a rectangular frame shape by such coupling between the upper frame 71, the lower frame 72, and the side frames 73. Further, in a state in which the support frame 70 is assembled, the side frames 73, the upper frame 71, and the lower frame 72 are in contact with an end of the plate opening 511 of the outer plate 51 to support the outer plate 51. Further, the side frames 73, the upper frame 71, and the lower frame 72 may be configured to support the peripheral surface of the transparent panel assembly 60.

Further, the opposite left and right ends of the upper frame 71 and the lower frame 72 may extend to the side frames 73, and at this time, the extending portions have a shape corresponding to a sectional shape of the side frames 73, so that a sense of unity is achieved when the frames 71, 72, and 73 are coupled. Thus, a coupling structure of the side frames 73, the upper frame 71, and the lower frame 72 may be easily formed.

In the present embodiment, the support frame 70 is formed by separately forming four parts and then coupling the four parts to each other. However, if necessary, the support frame 70 may be formed by coupling two or more components.

Meanwhile, the support frame 70 has a structure configured to support the outer plate 51 and the front panel 61. In this structure, the upper frame 71, the lower frame 72, and the side frames 73 have the same structure.

Hereinafter, a description will be made based on a structure of the side frames 73, and the same structure may be applied to the upper frame 71 and the lower frame 72.

The support frame 70 may entirely include a plate support 74, a plate accommodating groove 75, a panel support 76, and a heater accommodating groove 761.

The plate support 74, which defines the outermost side of the support frame 70, may have a front surface having a flat surface shape, and may be formed to be in close contact with the rear surface of the outer plate 51. That is, the outermost periphery of the support frame 70 may support the rear surface of the outer plate 51, and may adhere to the rear surface of the outer plate 51 through an adhesive member 692 such as a double-sided tape or an adhesive.

A plurality of convexo-concave parts 741 may be formed in the plate support 74 in contact with the outer plate 51, and thus, a contact rear of the adhesive or the adhesive member 741 for adhesion to the outer plate 51 is increased, so that a coupling force may be improved.

The plate support 74 may be formed in all the upper frame 71, the lower frame 72, and the side frames 73 constituting the support frame 70, and may be formed along the periphery of the support frame 70 to define the front surface of the support frame 70.

The plate accommodating groove 75 may be depressed at an end of the plate support 74, and may be formed such that the bent plate part 514 bent along an opening of the outer plate 51 is inserted thereinto.

Thus, in a state in which the outer plate 51 adheres to the upper frame 71, the bent plate part 514 may be inserted into the plate accommodating groove 75. Further, the bent plate part 514 may be in contact with a peripheral end of the transparent assembly 60 while being inserted into the plate accommodating groove 75. Thus, when viewed from the front side, the outer plate 51 and the front surface of the transparent panel assembly 60 may be in close contact with each other without a gap therebetween.

Guide ribs 751 may be formed inside the plate accommodating groove 75. The guide ribs 751 may allow the bent plate part 514 inserted into the plate accommodating groove 75 to be in close contact with the transparent panel assembly 60, and may guide the bent plate part 514 such that the bent plate part 514 is maintained at an accurate position while being inserted into the plate accommodating groove 75.

The guide ribs 751 may protrude to be in contact with an inner surface of the bent plate part 514, and may extend in a direction perpendicular to an extending direction of the bent plate part 514. The plurality of guide ribs 751 may be arranged to be adjacent to each other, and may be formed at a specific interval to entirely support a periphery of the bent plate part 514.

The guide ribs 751 may extend from one side of the inner surface of the plate accommodating groove 75 to the bottom surface of the plate accommodating groove 75. Further, the guide ribs 751 may form inclined parts 751*a* having a slope to protrude more and more from a point close to the plate support 74. Thus, when the bent plate part 514 is inserted into the plate accommodating groove 75, the bent plate part 514 may be inserted along the inclined parts 751*a*.

Further, vertical parts 751*b* are formed at ends of the inclined parts 751*a*, and the vertical parts 751*b* may be in contact with the inner surface of the bent plate part 514 to support the bent plate part 514. Thus, in a state in which the bent plate part 514 is completely inserted into the plate accommodating groove 75, the bent plate part 514 may be supported by the vertical parts 751*b*.

Thus, while the bent plate part 514 is inserted into the plate accommodating groove 75, the bent plate part 514 is inserted into the plate accommodating groove 75 while moving along the inclined parts 751*a*, and at the same time, moves toward the end of the front panel 61.

Further, when the bent plate part 514 is completely inserted into the plate accommodating groove 75, the bent plate part 514 may be moved to a location in contact with the front panel 61 by the vertical parts 751*b*, and the bent plate part 514 may be supported while being pressed. Thus, the bent plate part 514 inserted into the plate accommodating groove 75 may be maintained in a fixed state, and a state in which the bent plate part 514 is in contact with or close to the end of the front panel 61 may be maintained.

Meanwhile, restraint bosses 752 caught and restrained by one side of the bent plate part 514 may be formed inside the plate accommodating groove 75, and when the bent plate part 514 is mounted, restrainers 514*b* configured to guide the outer plate such that the outer plate 51 may be mounted at an exact position may be further formed.

The panel support 76 may be formed more inward than the plate accommodating groove 75. The panel support 76, which is adapted to support the rear surface of the front panel 61, defining the front surface of the transparent panel assembly 60, may be located behind the plate support 74 and may be stepped with respect to the plate support 74. At this time, the height difference between the panel support 76 and the plate support 74 may correspond to the thickness of the front panel 61.

Thus, in a state in which the transparent panel assembly 60 is seated on the support frame 70, a step or a gap is not formed on the front surface of the sub-door 50. That is, an outer end of the transparent panel assembly 60 and an end of the plate opening 511 of the outer plate 51 may be in contact with each other, and the front surface of the transparent panel assembly 60 and the front surface of the outer plate 51 are located on the same plane, so that the entire front surface of the sub-door 50 is not stepped so as to have a sense of unity. Further, the panel support 76 may be formed along the side frames 73 and the lower frame 72 except for the upper frame 71.

Meanwhile, the heater accommodating groove 761 may be formed in the panel support 76, and the heater 532 may be accommodated inside the heat accommodating groove 761. The heater 532 may heat the rear surface of the front panel 61, particularly, the rear surface of the front panel 61, which protrudes to the outside of the outer spacer 67.

In detail, the heater accommodating groove 761 may be formed on the panel support 76. The heater accommodating groove 761, which prevents dew condensation by heating the periphery of the transparent panel assembly 60 in contact with the panel support 76, may be formed along the panel support 76.

The heater 532, which is adapted to heat the periphery of the front panel 61 vulnerable to insulation, prevents dew condensation from being generated in the periphery of the front panel 61. The heater 532 may be positioned on the vertical line of the gasket 503 inside the bezel 611. Thus, the position in which the heater 532 is installed is an area in which a distance between the door liner 56 and the front panel 61 is close, and is relatively vulnerable to insulation. Thus, the heater 532 is arranged at the corresponding position to prevent dew condensation from being generated on the front surface of the front panel 61. Further, the periphery of the front panel 61, that is, the front protrusion 613, exists between an area which is located inside the sub-door 50 and is filled with the insulator 513 and the heat insulating layer formed in the transparent panel assembly 60, and thus is a portion in which substantially not heat insulation is provided. Thus, the periphery of the front panel 61 may be vulnerable to insulation, and the corresponding region is heated by the heater 523 so that dew condensation may not be generated in the periphery of the front panel 61.

Further, when cold air which may be transferred by the outer plate 51 is transferred to the front panel 61 due to an operation of the heater 532, the end of the front panel 61 is heated so that dew condensation may be prevented from being generated at the end of the front panel 61. The heater 532 may be located in the bezel 611 to heat the portion vulnerable to insulation even without being exposed to the outside so as to effectively prevent dew condensation.

The heater accommodating groove 761 may be formed to have a shape corresponding to the heater 532, and completely accommodates the heater 532, so that when the front panel 61 is mounted, the rear surface of the front panel 61 is seated on the panel support 76, and at this time, the heater 532 is in contact with the rear surface of the front panel 61.

In detail, when the transparent panel assembly 60 is mounted, the periphery of the front panel 61 is in contact with and seated on the panel support 76. Further, the heater 532 mounted on the heater accommodating groove 761 may be located adjacent to the outer spacer 67, and thus, may heat the periphery of the front panel 61.

At this time, it is preferable that the heater 532 is arranged in a region of the bezel 611 of the front panel 61, and thus, when the transparent panel assembly 60 is mounted, the heater 532 in contact with the front panel 61 is not exposed to the outside.

Meanwhile, in a state in which the heater 532 is mounted on the heater accommodating groove 761, an aluminum tape may be attached to shield the heater accommodating groove 761. The aluminum tape may maintain a state in which the heater 532 is fixed and mounted to the heater accommodating groove 761, and heat generated by the heater 532 is uniformly transferred to the periphery of the front panel 61.

The heater 532 may be formed to have a wire shape, and a generally-used sheath heater may be used as the heater 532. The heater 532 may have a diameter at which the heater 532 may be inserted into the heater accommodating groove 761, and may be arranged along a periphery of the frame opening 701.

Meanwhile, a vertically bent blocking part 77 may be formed at an end of the panel support 76. The blocking part 77 may prevent foam liquid for forming the insulator 531 from being introduced toward the transparent panel assembly 60. Further, the blocking part 77 is coupled to the outer spacer 67 through the coupling members 78 to fix the transparent panel assembly 60.

Figure 17:
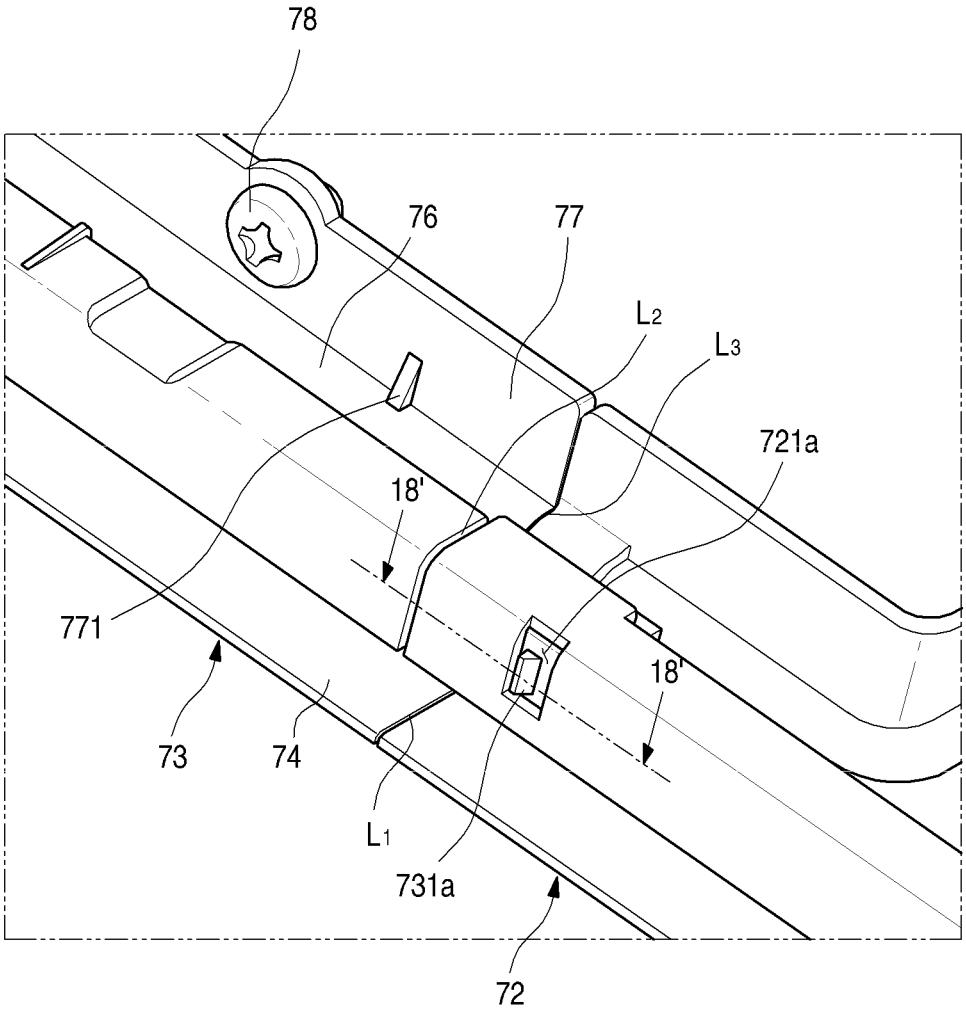
FIG. 17 is a view illustrating a coupling state of part A of FIG. 16.
Figure 18:
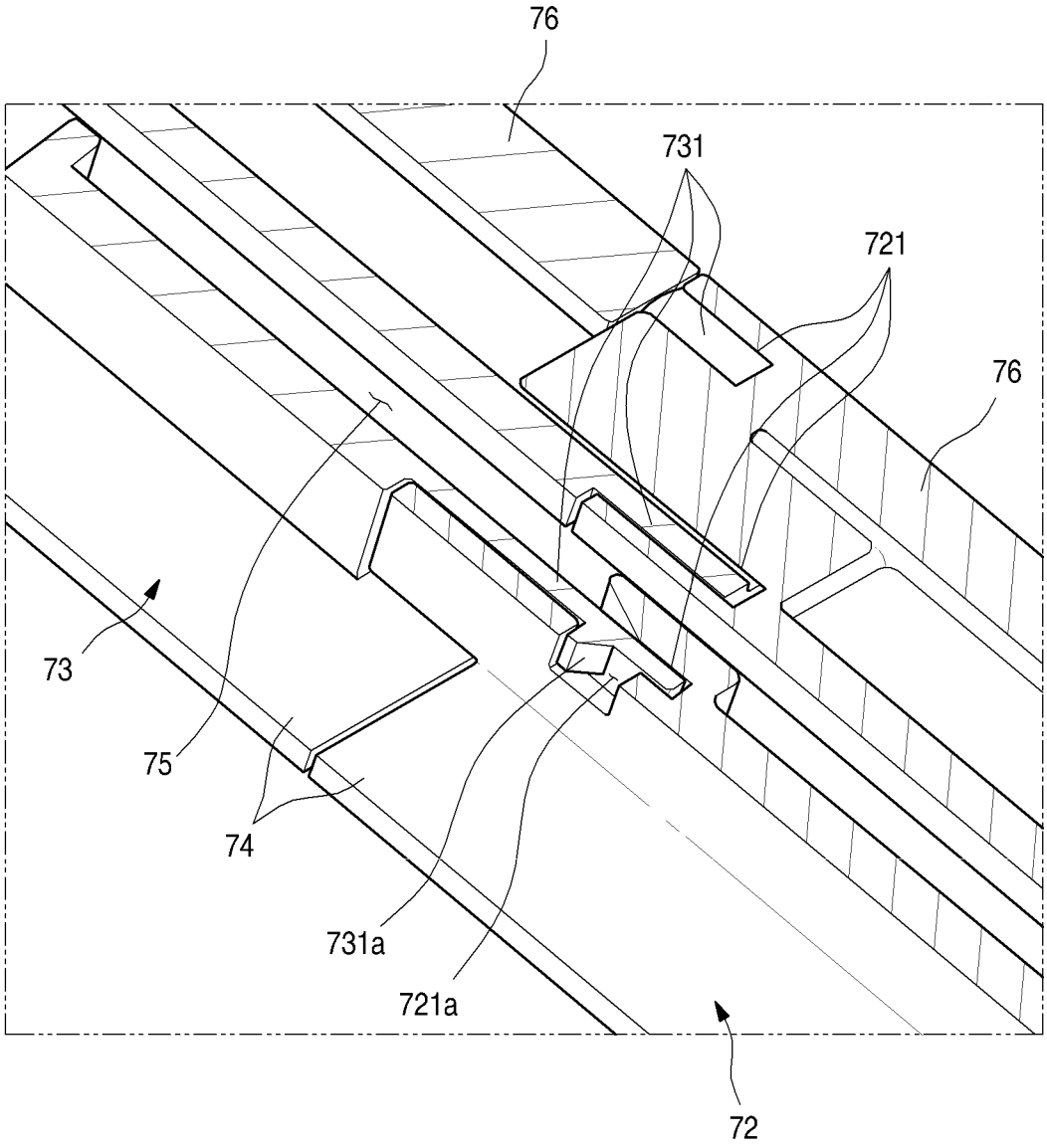
FIG. 18 is a sectional view taken along line 18-18' of FIG. 17.
Figure 19:
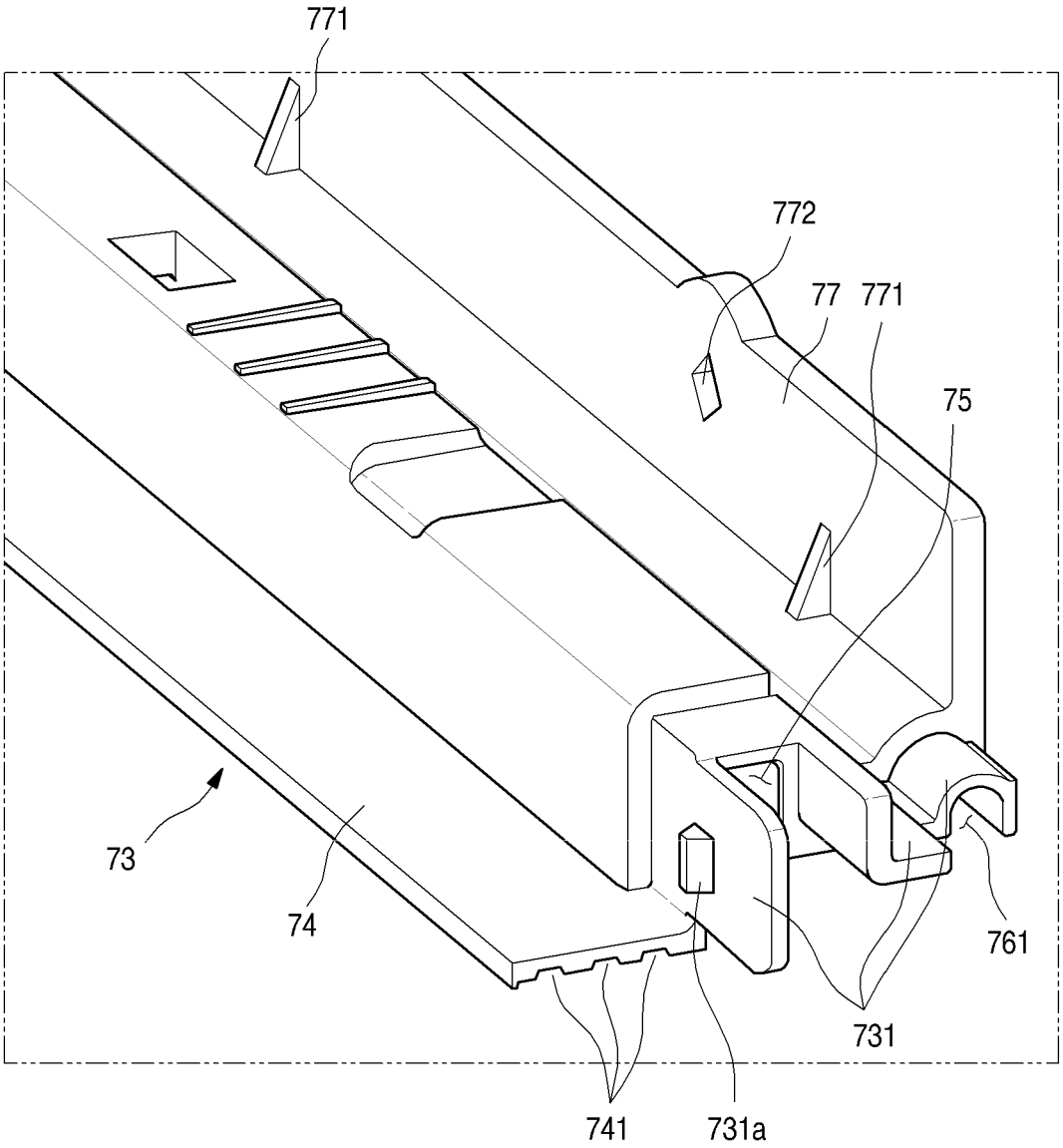
FIG. 19 is a partial perspective view illustrating a side frame constituting the support frame.
Figure 20:
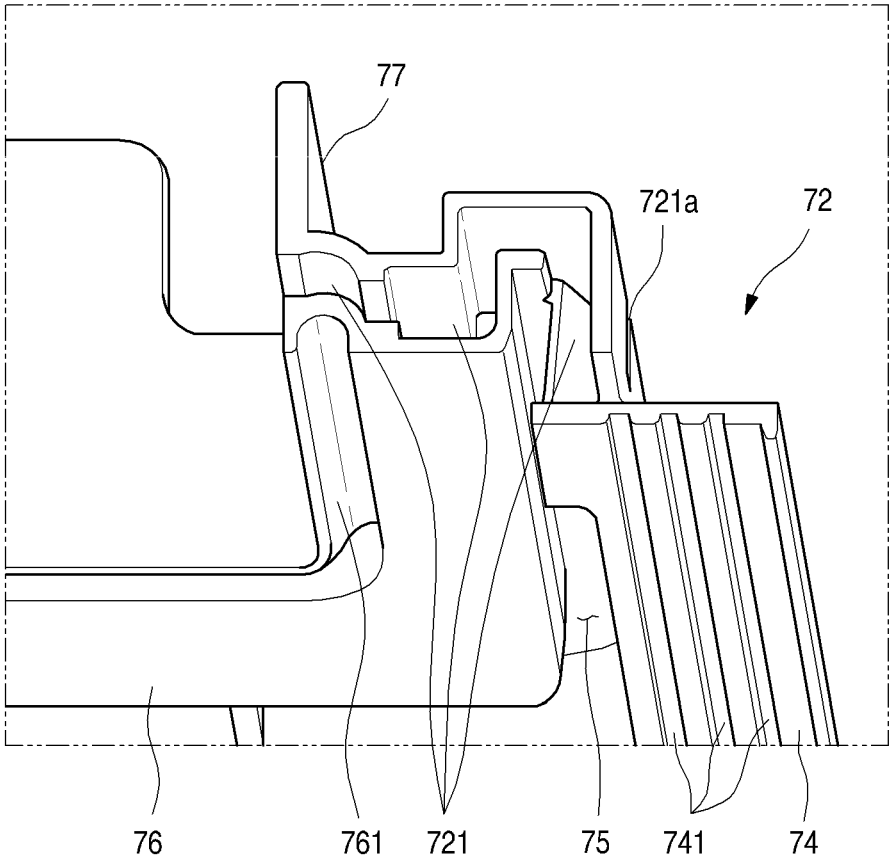
FIG. 20 is a partial perspective view illustrating a lower frame constituting the support frame.

FIG. 17 is a view illustrating a coupling state of part A of FIG. 16. Further, FIG. 18 is a sectional view taken along line 18-18' of FIG. 17. Further, FIG. 19 is a partial perspective view illustrating a side frame constituting the support frame. Further, FIG. 20 is a partial perspective view illustrating a lower frame constituting the support frame.

The front frame has a structure in which opposite ends of the upper frame 71 and opposite ends of the lower frame 72 are coupled to opposite ends of the side frames 73. Coupling structures thereof are identical to each other, and only locations thereof is different from each other. Thus, hereinafter, a description will be made with reference to part A of FIG. 16 in the support frame 70.

As illustrated, a lower end of the side frame 73 may be coupled to an upper end of the lower frame 72. To achieve this, frame coupling bosses 731 may be formed at the lower end of the side frame 73, and frame coupling grooves 721 may be formed at the upper end of the lower frame 72, which corresponds thereto.

In more detail, the frame coupling bosses 731 may protrude from the lower end of the side frame 73, and may extend from opposite sides of the plate accommodating groove 75, the panel support 76, and an end of the heater accommodating groove 761.

Further, the frame coupling grooves 721 may define predetermined spaces in which the frame coupling bosses 731 may be accommodated, and may be formed in the plate accommodating groove 75, the panel support 76, and the heater accommodating groove 761 on the lower frame 72.

Meanwhile, a frame catching boss 731*a* may be formed in one of the frame coupling bosses 731. Further, a frame catching groove 721*a* into which the frame catching boss 731*a* may be inserted may be formed in one of the frame coupling grooves 721. In a state in which the frame coupling bosses 731 and the frame coupling grooves 721 are coupled to each other, the frame catching boss 731*a* may be coupled to the frame catching groove 721*a*, and thus, a state in which the side frame 73 and the lower frame 72 are completely coupled to each other may be maintained.

The frame coupling bosses 731 and the frame coupling grooves 721 are formed along the plate accommodating groove 75, the panel support 76, and the heater accommodating groove 761, and at least portions of the frame coupling bosses 731 and the frame coupling grooves 721 are bent or extend to be perpendicular to each other, so that even when a torsional moment or a local load is applied to the support frame 70 in a state in which the frame coupling bosses 731 and the frame coupling grooves 721 are coupled to each other, a stable coupling state of the frame coupling bosses 731 and the frame coupling grooves 721 may be maintained.

Further, when the side frame 73 and the lower frame 72 are coupled to each other, parting lines $L_1$, $L_2$, and $L_3$ of the ends in contact with each other may be arranged to be offset from each other. That is, the parting line L1 at a position where portions of the plate support 74 which belong to the side frame 73 and the lower frame 72 are in contact with each other, the parting line L2 at a position where portions of the plate accommodating groove 75 which belong to the side frame 73 and the lower frame 72 are in contact with each other, the parting line L3 at a position where portions of the panel support 76 and the blocking part 77 which belong to the side frame 73 and the lower frame 72 are in contact with each other may be offset from each other or may be stepped with respect to each other.

Thus, when foam liquid is injected into the sub-door 50 to form the insulator 531, the foam liquid permeates along the parting lines L1, L2, and L3, so that the transparent panel assembly 60 may be prevented from being polluted. That is, even when the foam liquid injected into the sub-door 50 flows along the parting line L1 of the plate support 74, it is difficult to introduce the foam liquid along the parting lines L2 and L3 of the plate accommodating groove 75 and the panel support 76, which are arranged to be offset from each other. Thus, finally, the foam liquid may be prevented from being introduced toward the transparent panel assembly 60.

Further, the blocking part 77 may be bent to be perpendicular to an inner end of the panel support 76, and may extend to the rear side in which the door liner 56 is located. The blocking part 77 extends from a position away from the periphery of the transparent panel assembly 60 to a position adjacent to the rear panel 65 or the door liner 56, to prevent the foam liquid from being introduced toward the transparent panel assembly 60.

A reinforcement rib 771 may be formed at a lower end of the blocking part 77, and deformation or damage of the blocking part 77 coupled to the transparent panel assembly 60 is prevented by the reinforcement rib 771. Further, coupling holes 772 passing through the coupling members 78 may be formed in the blocking part 77.

Figure 21:
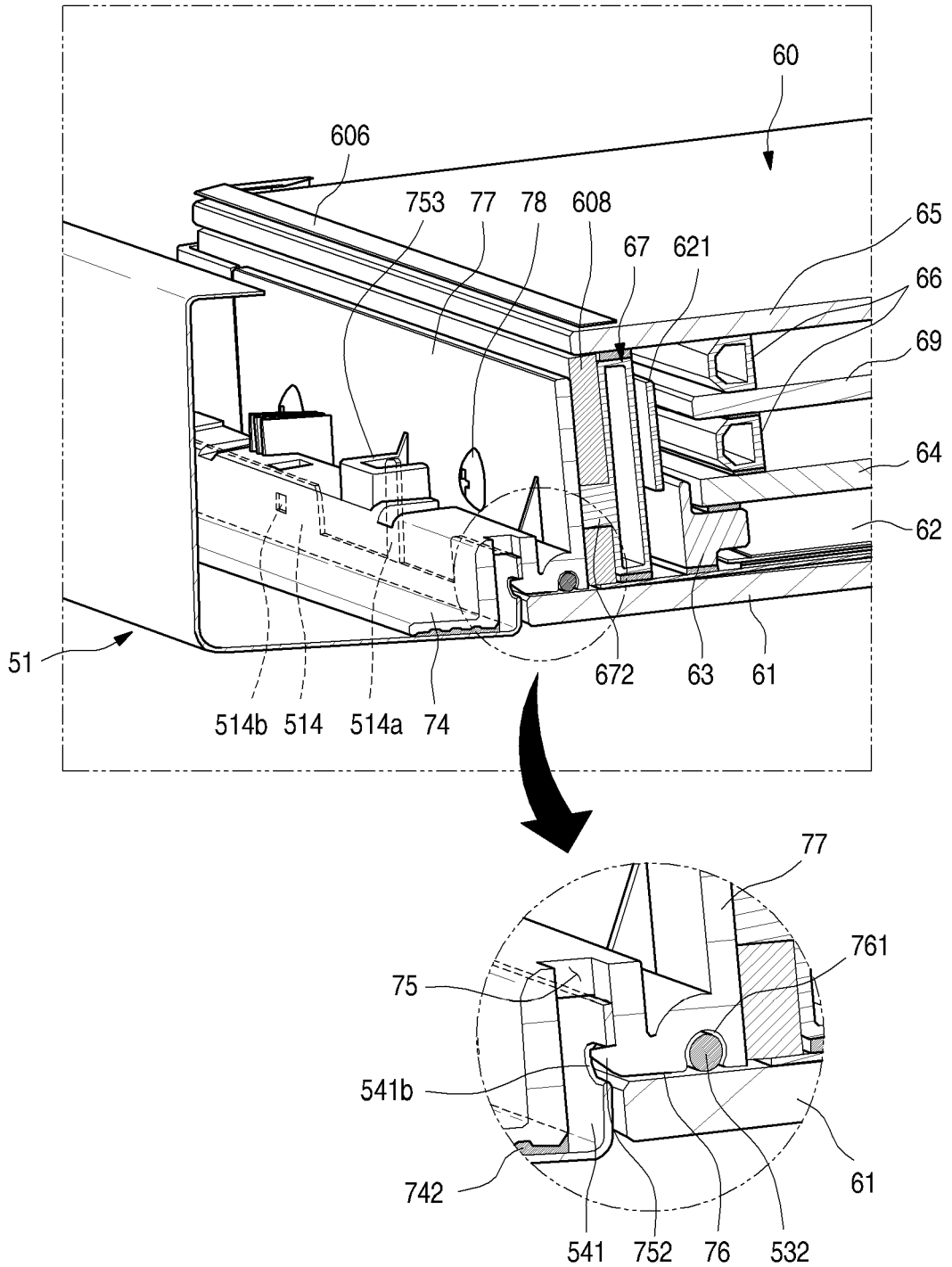
FIG. 21 is a cutaway perspective view illustrating a state in which an out plate and the support frame are coupled to each other according to the first embodiment of the present disclosure.
Figure 22:
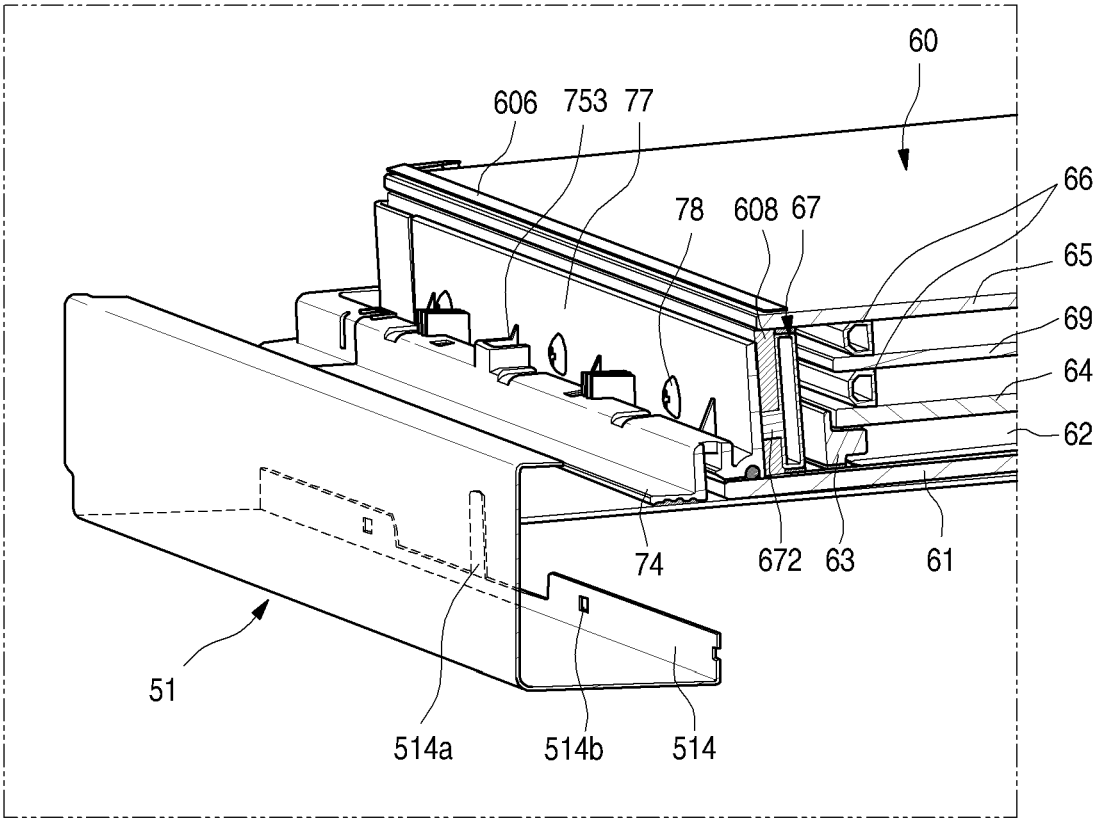
FIG. 22 is an exploded cutaway perspective view illustrating a coupling structure of the out plate and the support frame.

FIG. 21 is a cutaway perspective view illustrating a state in which an out plate and the support frame are coupled to each other according to the first embodiment of the present disclosure. Further, FIG. 22 is an exploded cutaway perspective view illustrating a coupling structure of the out plate and the support frame.

A coupling structure of the support frame 70 and the outer plate 51 will be described in more detail with reference to the drawings. The bent plate part 514 may be bent along the plate opening 511 at the center of the outer plate 51.

The support frame 70 may be mounted on the rear surface of the outer plate 51. The support frame 70 may be arranged along the periphery of the plate opening 511.

The side frames 73 may be arranged at opposite left and right ends of the plate opening 511. At this time, the bent plate part 514 may be inserted into the plate accommodating groove 75.

Meanwhile, guide ribs 751 including the vertical parts 751*b* and the inclined parts 751*a* may be formed inside the plate accommodating groove 75. Thus, while the bent plate part 514 is inserted into the plate accommodating groove 75, the bent plate part 514 may be inserted while moving along the inclined parts 751*a*, and the inner surface of the bent plate part 514 may be supported by the vertical parts 751*b*.

The bent plate part 514 may be guided toward the inside of the plate opening 511 by the guide ribs 751, and may maintain a position thereof in a state in which the bent plate part 514 is completely inserted into the plate accommodating groove 75. At this time, the guide ribs 751 may support the bent plate part 514 may support the bent plate part 514 in a manner to slightly press the bent plate part 514 from the inner side, and may prevent separation or flow of the outer plate 51.

Thus, as illustrated in FIG. 21, in a state in which the transparent panel assembly 60 is mounted, the bent plate part 514 is located inside the plate accommodating groove 75, and may be maintained to be in close contact with the outer end of the front panel 61. Due to such a structure, an interval or gap between the transparent panel assembly 60 and the outer plate 51 on the front surface of the sub-door 50 cannot be virtually seen, and a boundary of the transparent panel assembly 60 and a boundary of the outer plate 51 is completely in close contact with each other, so that the entire outer appearance of the front surface of the sub-door 50 may have a sense of unity.

Meanwhile, guide insertion parts 514*a* may be formed on one side of the bent plate part 514 such that the outer plate 51 may be mounted on the support frame 70 at an accurate position. The guide insertion parts 514*a* may be formed at an end of the bent plate part 514 so as to have a predetermined width, and may pass through the support frame 70.

Further, insertion guide holes 753 through the guide insertion parts 514*a* pass may be formed in the support frame 70. The insertion guide holes 753 may be formed on the bottom surface of the plate accommodating groove 75, and may have a size allowing the guide insertion parts 514*a* to pass therethrough.

Thus, when the outer plate 51 and the support frame 70 are coupled to each other, the outer plate 51 and the support frame 70 may be aligned with each other such that the guide insertion parts 514*a* may pass through the insertion guide holes 753, and the bent plate part 514 may be arranged inside the plate accommodating groove 75 at an accurate position.

Meanwhile, when the bent plate part 514 is inserted into the plate accommodating groove 75 at an accurate position, the restraint bosses 752 formed inside the plate accommodating groove 75 may be coupled to the restrainers 514*b* formed in the bent plate part 514. In a state in which the bent plate part 514 is completely inserted into and fixed to the plate accommodating groove 75, the restraint bosses 752 and the restrainers 514*b* are coupled to each other, so that the bent plate part 514 may be maintained in an inserted state.

The plurality of guide insertion parts 514*a* and the plurality of restrainers 514*b* may be formed in the bent plate part 514 at a specific interval. Further, the plurality of guide insertion parts 514*a* and the plurality of restrainers 514*b* may be formed throughout the bent plate part 514.

In this state, an adhesive or an adhesive member 742 can be applied to the plate support 74, so that a state in which the plate support 74 is fixed and mounted to the rear surface of the outer plate 51 may be maintained. Thus, even in a situation in which the foam liquid is injected into the sub-door 50, a position at which the support frame 70 is fixed and mounted onto the outer plate 51 may be maintained.

Meanwhile, in a state in which the support frame 70 is mounted on the outer plate 51, the transparent panel assembly 60 may be inserted and mounted from the front side to the rear side of the plate opening 511. At this time, in a state in which the rear panel 65 having a narrow width is firstly inserted and the transparent panel assembly 60 is inserted, the rear surface of the front panel 161 may be seated on the panel support 76.

Further, in a state in which the transparent panel assembly 60 is completely inserted and mounted, the coupling members 78 fastened while passing through the blocking part 77 may be fastened to the fastening holes 672*a* of the outer spacer 67. The periphery of the transparent panel assembly 60 may be coupled to the blocking part 77 by the plurality of coupling members 78, and the transparent panel assembly 60 may be fixed and mounted.

Thus, the transparent panel assembly 60 may be firmly mounted even in a state in which an adhesive structure of the periphery of the front panel 61 and the panel support 76 is not provided, and may be maintained in a stable mounted state even when an impact is applied thereto while the sub-door 50 is opened/closed.

Due to such a structure, when a problem occurs in the transparent panel assembly 60, and thus a follow-up service is required, the transparent panel assembly 60 may be easily disassembled. Further, when the transparent panel assembly 60 is disassembled, an adhesive or an adhesive member is not applied to the bezel 611 on the periphery of the front panel 61. Thus, the transparent panel assembly 60 is easily separated, and the bezel 611 is prevented from being damaged by the adhesive or the adhesive member as well. Thus, the follow-up service is easily performed, and the not-damaged transparent panel assembly 60 having a high price may be reused after the follow-up service.

Figure 23:
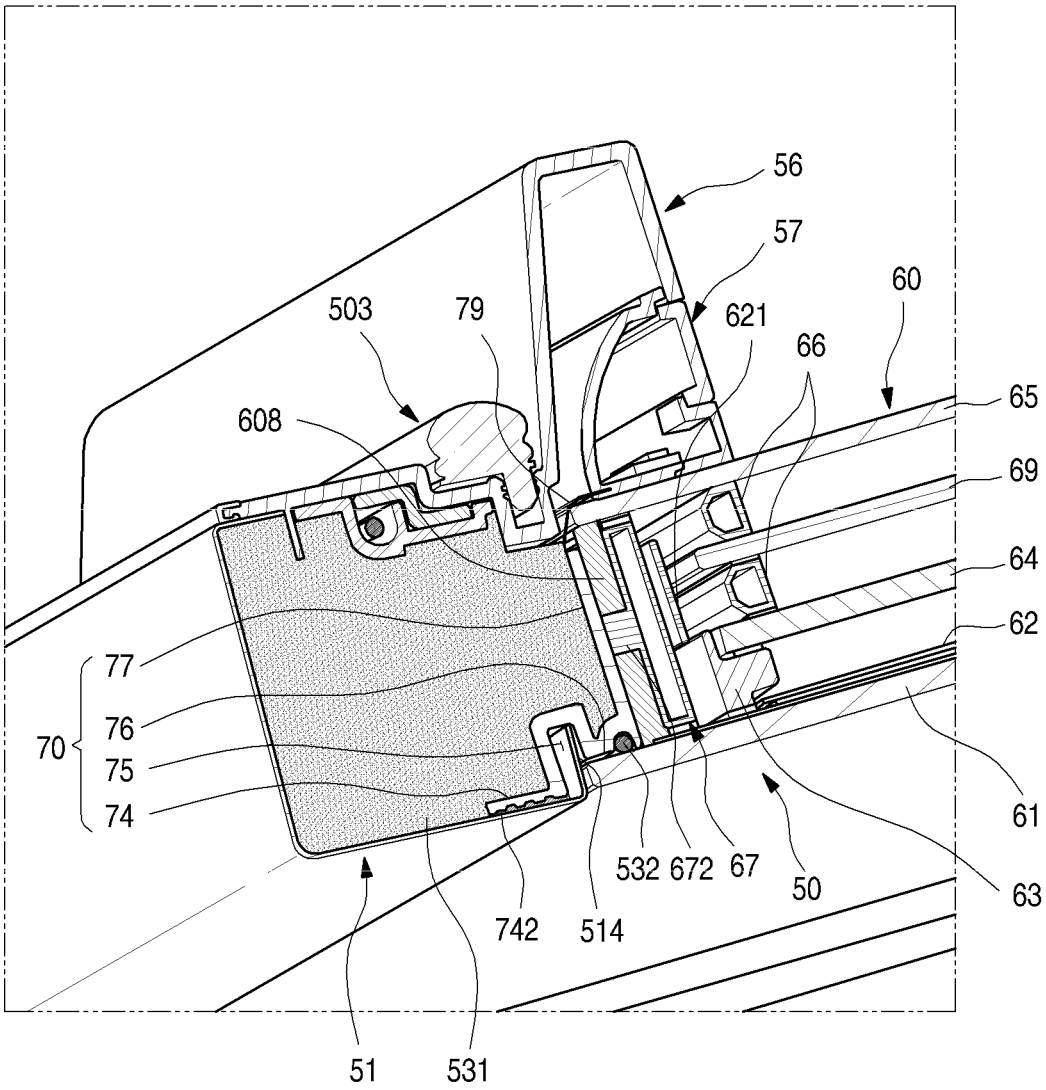
FIG. 23 is a cutaway perspective view taken along line 23-23' of FIG. 5.
Figure 24:
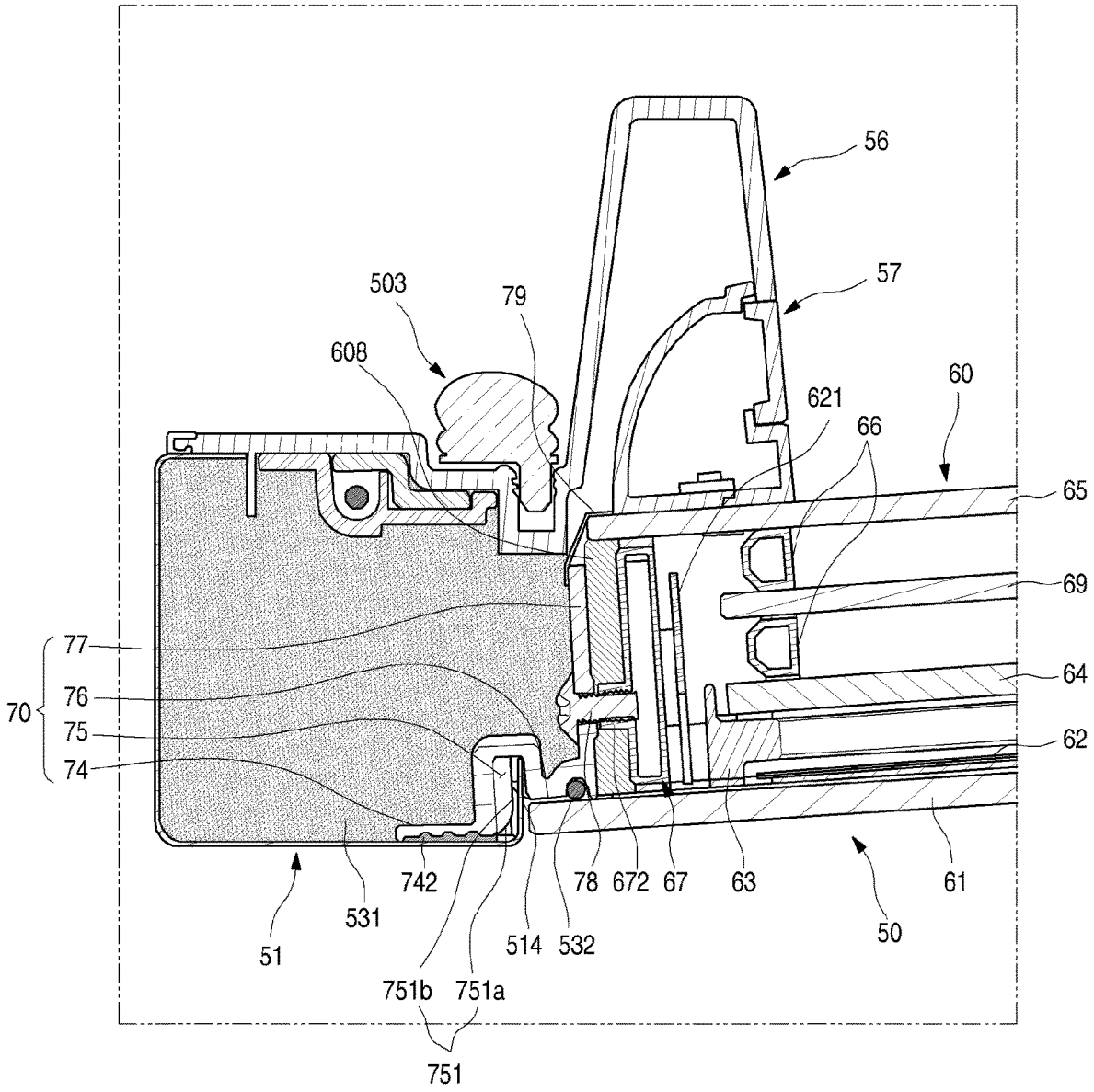
FIG. 24 is a sectional view taken along line 24-24' of FIG. 5.

FIG. 23 is a cutaway perspective view taken along line 23-23' of FIG. 5. Further, FIG. 24 is a sectional view taken along line 24-24' of FIG. 5.

As illustrated in the drawings, in a state in which the outer plate 51 and the transparent panel assembly 60 are mounted on the support frame 70, the transparent panel assembly 60 may be fixed and mounted onto the support frame 70 through the coupling member 78. Further, the door liner 56 is coupled, and the door lights 57 and the gasket 503 are mounted, so that the sub-door 50 is assembled.

The insulator 531 may be filled inside the assembled sub-door 50, and the insulator 531 is filled in the outer side of the transparent panel assembly 60 to insulate a peripheral space of the sub-door 50. Further, between the front panel 61 and the rear panel 65 of the transparent panel assembly 60, an insulation panel 69 is provided or a sealed insulation layer is formed, so that the front panel 61 and the rear panel 65 may be insulated from each other. Thus, the insulation may be achieved throughout the entire surface of the sub-door 50.

Meanwhile, the foam liquid is injected into the sub-door 50, the foam liquid may be prevented from being introduced toward the periphery of the transparent panel assembly 60, by the blocking part 77. To achieve this, the blocking part 77 may extend rearward from the end of the panel support 76, and may extend to a position that is adjacent to the door liner 56 or the rear panel 65. Further, if necessary, a shielding member 79 may be attached to the blocking part 77 and the door liner 56 or the rear panel 65.

The shielding member 79 is formed of an attachable material such as a tape, to completely block a gap between the shielding member 79 and the door liner 56 or the rear panel 65. Thus, the foam liquid filled inside the sub-door 50 may be completely prevented from being introduced toward the transparent panel assembly 60.

Due to the prevention of the introduction of the foam liquid by the shielding member 79, the foam liquid may be prevented from being polluted or being stained with the display cables 605 guided along the peripheral surface of the transparent panel assembly 60, that is, an outer surface of the sealant 608. That is, the display cables 605 may be located between the blocking part 77 and the sealant 608. Thus, even when the foam liquid is injected into the sub-door 50, the foam liquid is prevented from being introduced toward the display cables 605 by the blocking part 77. Further, the foam liquid is not stained with the display cables 605, and thus, even when the transparent panel assembly 60 is replaced or is separated for the follow-up service, the display cables 605 may be reused without being damaged.

Hereinafter, lighting states of the display lights and the door lights will be described in more detail with reference to the accompanying drawings.

Figure 25:
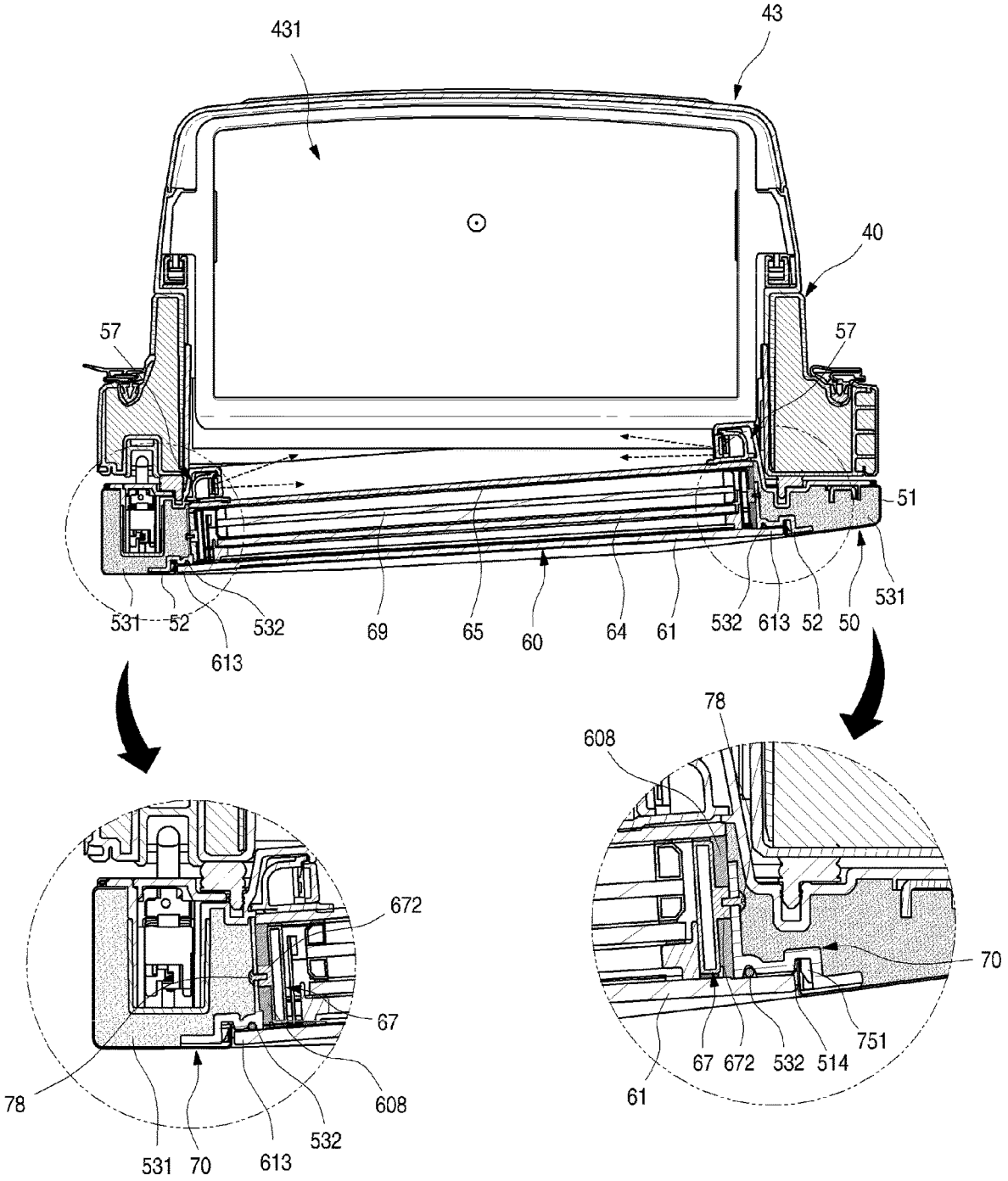
FIG. 25 is a cross sectional view illustrating the main door and the sub door.
Figure 26:
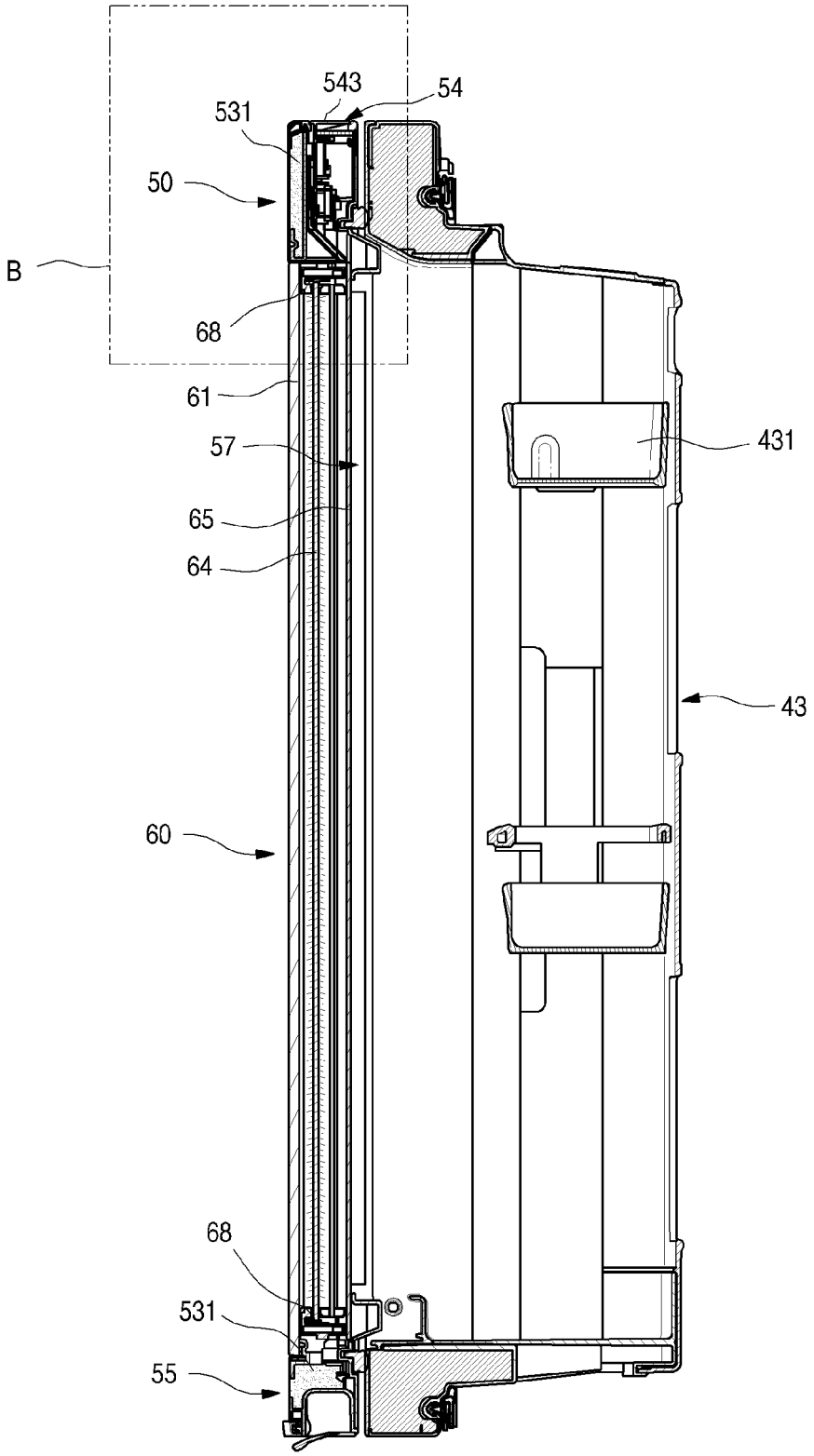
FIG. 26 is a longitudinal sectional view illustrating the main door and the sub door.
Figure 27:
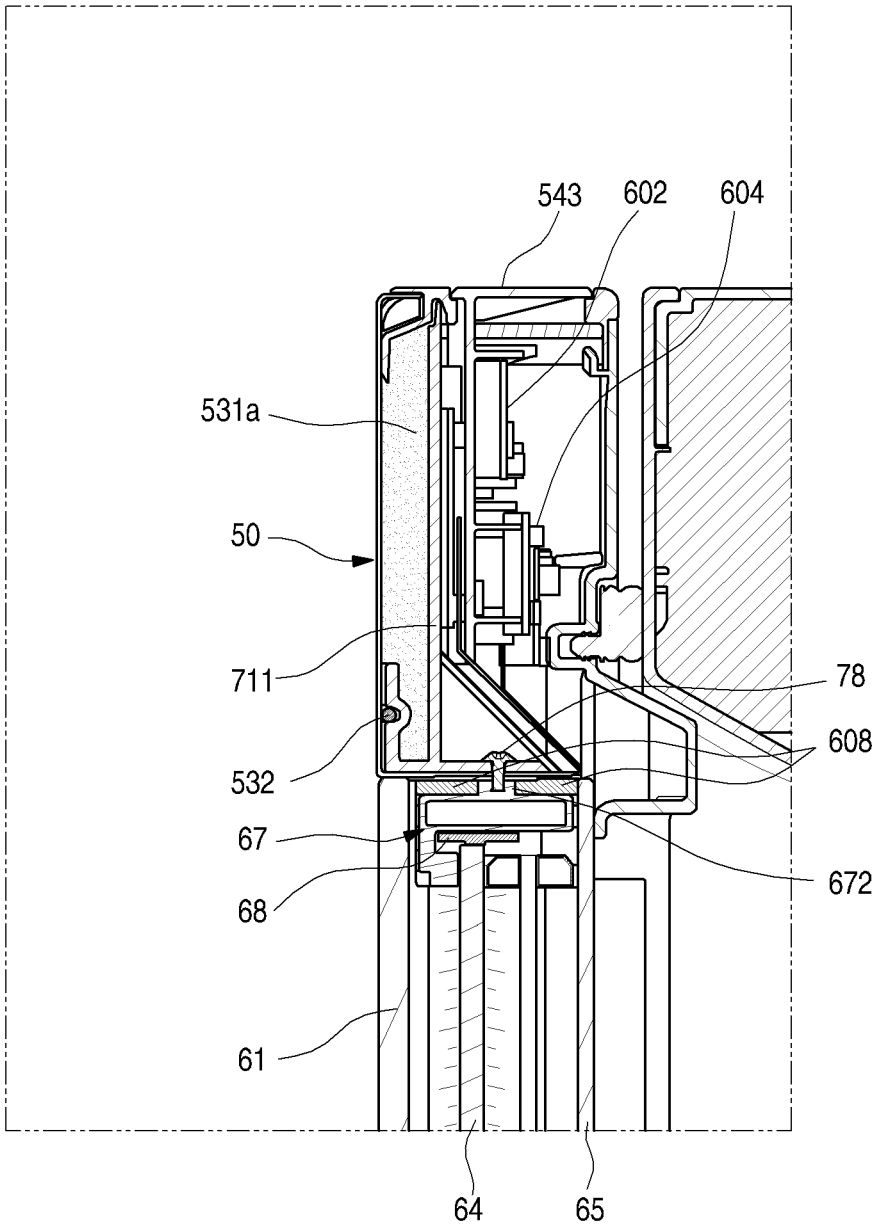
FIG. 27 is an enlarged view illustrating part B of FIG. 26.
Figure 28:
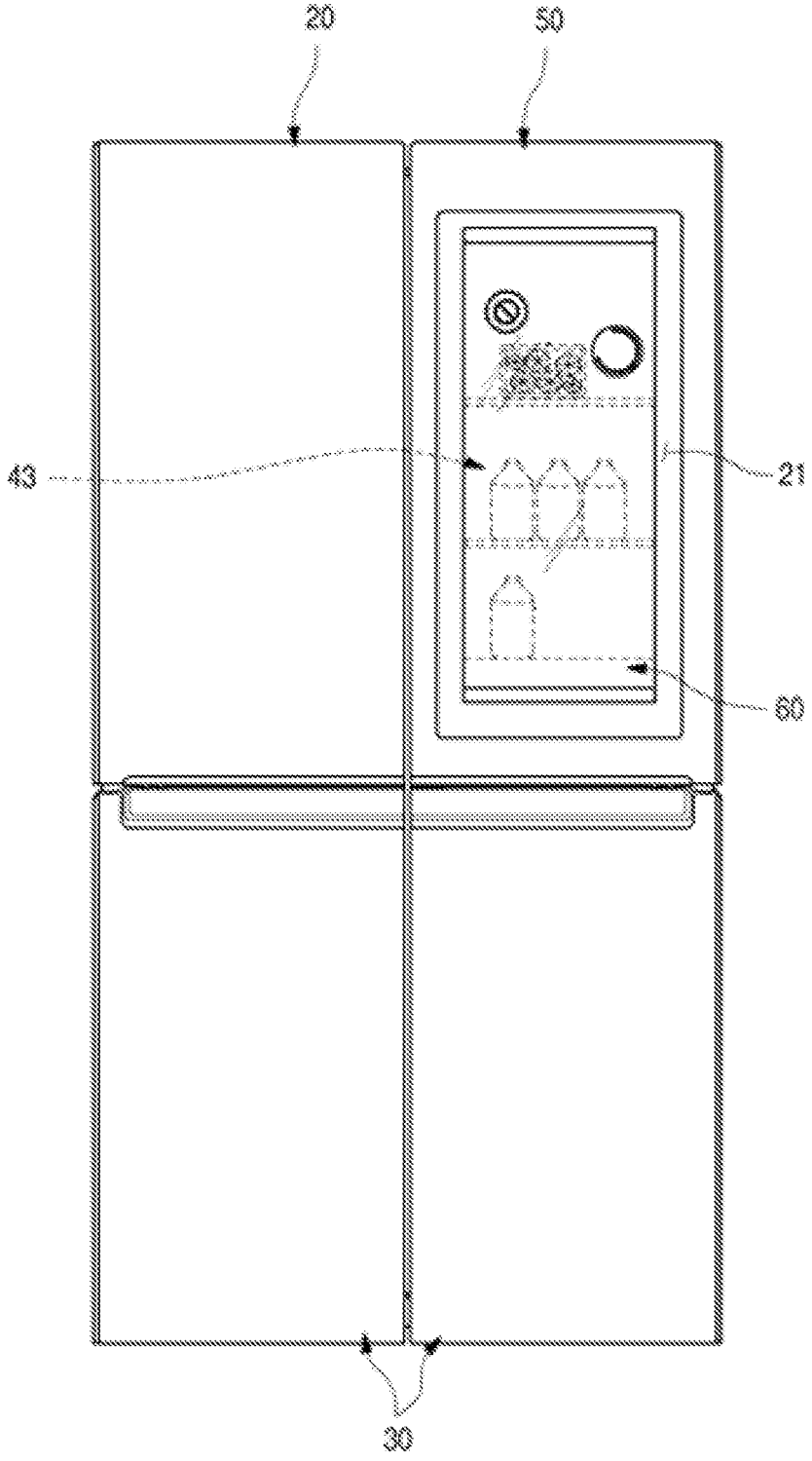
FIG. 28 illustrates a state in which an interior of the refrigerator is visible through the transparent panel assembly.
Figure 29:
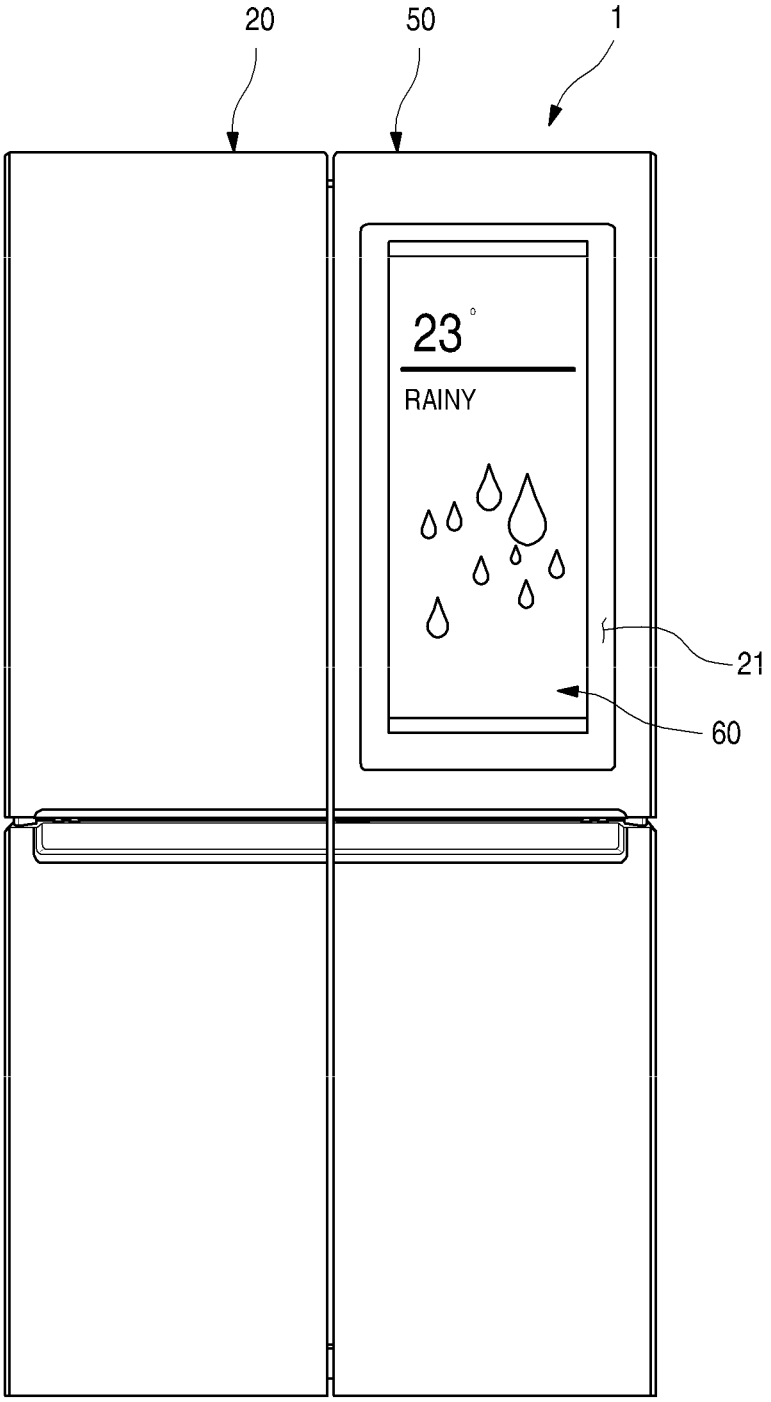
FIG. 29 illustrates a state in which a screen is output through the transparent panel assembly.

FIG. 25 is a cross sectional view illustrating the main door and the sub door. Further, FIG. 26 is a longitudinal sectional view illustrating the main door and the sub door. Further, FIG. 27 is an enlarged view illustrating part B of FIG. 26. Further, FIG. 28 illustrates a state in which an interior of the refrigerator may be seen through the transparent panel assembly. Further, FIG. 29 illustrates a state in which a screen is output through the transparent panel assembly.

As illustrated in the drawings, in a state in which the locking member 593 of the opening device 59 is inserted into a latch hole 421, a state in which the sub-door 50 is closed is maintained. In this state, a state in which the door lights 57 is switched off is maintained. An opened/closed state of the sub-door 50 may be detected through a separately provided door switch.

As illustrated in FIG. 1, in a state in which the door lights 57 are switched off, the rear space of the sub-door 50 becomes dark, so that the interior of the refrigerator 1 cannot be seen through the see-through part 21. Thus, when there is no separate manipulation in a state in which the sub-door 50 is closed, the door lights 57 are continuously switched off, and thus, the interior of the refrigerator 1 cannot be seen through the see-through part 21.

In this state, the user touches the front panel 51 to switch off the door lights 57. When the door lights 57 are switched on, light beams irradiated by lighting modules 575 are irradiated from opposite left and right sides to the central side of the rear side of the rear panel 65 to face each other.

The door lights 57 may extend an upper end to a lower end of the rear panel 65. That is, the light beams irradiated by the door lights 57 may illuminate the entire rear region of the rear panel 65 on the opposite left and right sides of the rear panel 65.

At this time, when the display lights 86 are switched on together, light beams may be irradiated from the upper side and the lower side by the display lights 68, and the light beams may be irradiated from the left side and the right side by the door lights 57. As a result, the light beams may be irradiated from all the upper, lower, left, and right sides of the see-through part 21, and a region of the see-through part 21 may be illuminated in the maximum brightness.

The door lights 57 irradiates the light beams in a direction in which the light beams face each other, while being adjacent to the rear panel 65. The light beams irradiated by the door lights 57 may illuminate the internal space of the storage case 43, and may illuminate the front side via the rear panel 65 as well. Thus, as illustrated in FIG. 28, the door lights 57 may serve as lights configured to illuminate a space inside the refrigerator 1, which is seen through the see-through part 21, and at the same time, may serve as auxiliary backlights through which the display 62 may be seen more clearly.

That is, in a state in which the screen is output through the display 62, the space inside the refrigerator 1, that is, a space behind the sub-door 50, may be selectively seen through the see-through part 21. To allow the space behind the sub-door 50 to be seen through the see-through part 21, the door lights 57 may be switched on.

Of course, various representations may be achieved through a combination of ON/OFF states of the display lights 68 and the door lights 57 according to a degree to which the inside of the storage case 43 is visualized through the see-through part 21.

Further, when the user manipulates the front panel 61 on the front surface of the refrigerator 1, the display lights 68 are switched on, the display 62 is switched on, and thus, the transparent panel assembly 60 may output the screen, as illustrated in FIG. 29. At this time, the manipulation of the front panel 61 may correspond to input of any one of a specific position, the number of times of touches, and a pattern. Of course, if necessary, the manipulation by the user may be detected using a separate physical button or a sensor.

The display 62 may output the screen for displaying a state of the refrigerator 1 and performing manipulation, and may also output various screens for performing the Internet, outputting an image, performing output using an external input device, and displaying information on received food.

In detail, the display lights 68 arranged at an upper end and a lower end of the light guide plate 64 may be switched on together with the display 62 by the manipulation by the user. The display lights 68 are switched on, and thus the light guide plate 64 diffusely reflects and diffuses light of the display lights 68, so that the light may be irradiated toward the display 62 on the front side in a wholly uniform brightness.

The light is irradiated from the rear side of the display 62 toward the display 62 by the light guide plate 64, and at the same time, the screen is output based on image information input from the display 62. Thus, the user may identify the clearly output screen through the see-through part 21.

Meanwhile, the operation of the display 62 and the operations of the door lights 57 may be controlled by the PCBs 602, 603, and 604 such as the T-CON board 602 or the docking PCB 604 above the sub-door 50. Further, these PCBs 602, 603, and 604 may be arranged on the rear space of the sub-door 50, which is partitioned by the barrier 711 defining the upper end of the support frame 70. Further, the insulator 531*a* may be filled in a front space of the sub-door 50, which is partitioned by the barrier 711, and thus dew condensation may be prevented from being generated on an upper side of the front surface of the sub-door 50.

Meanwhile, various other embodiments in addition to the above-described embodiments may be applied to the refrigerator according to the present disclosure.

In a second embodiment of the present disclosure, the support frame configured to support the outer case and the transparent panel assembly such that ends of the outer case and the transparent panel assembly are in contact with each other is provided, and the support frame is coupled to any one of the plurality of spacers.

In description of the second embodiment of the present disclosure, the same configurations according to the above-described embodiments will be designated by the same reference numerals, and detailed descriptions thereof will be omitted. Further, not-illustrated reference numerals will be the same as the configurations of the drawings in the above-described embodiments.

Figure 30:
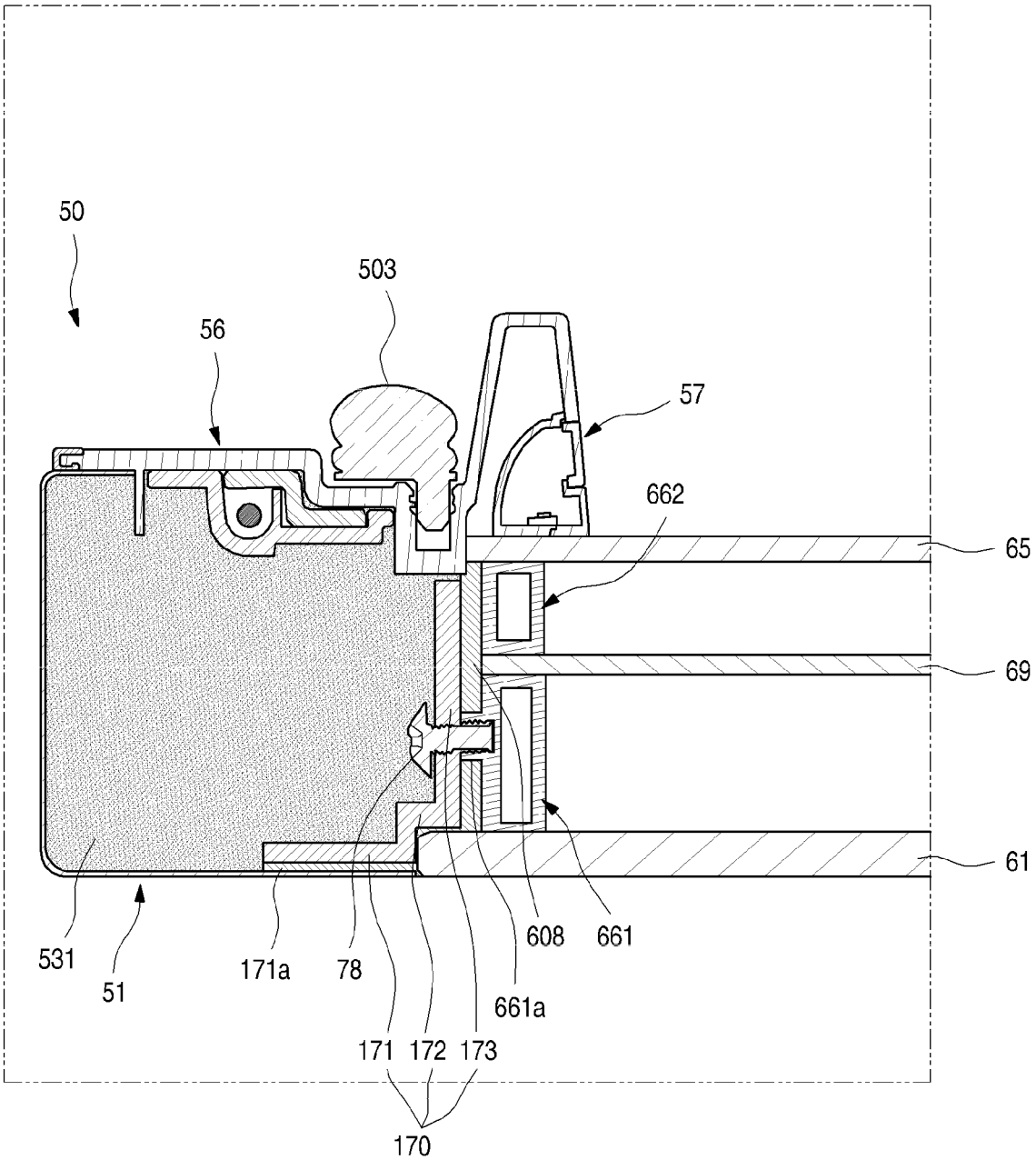
FIG. 30 is a sectional view illustrating a door according to a second embodiment of the present disclosure.

FIG. 30 is a sectional view illustrating a door according to a second embodiment of the present disclosure.

Referring to the drawing, an outer peripheral shape of the door 50 may be defined by the bent outer plate 51 formed of metal. The outer plate 51 may define the front surface and a periphery of the side surfaces of the door 50. Further, the door liner 56 defining the rear surface of the door 50 is coupled to the outer plate 51, and the transparent panel assembly 60 is provided in openings of the outer plate 51 and the door liner 56, so that the interior of the refrigerator 1 may be selectively seen.

The transparent panel assembly 60 may include the front panel 61 defining the front surface thereof, the rear panel 65 defining the rear surface thereof, and the insulation panel 69 between the front panel 61 and the rear panel 65. A metal deposition layer or a film layer through which light is selectively passes may be formed on the rear surface of the front panel 61, and thus the interior of the refrigerator 1 may be selectively visualized according to whether the door lights 57 or a lamp in the refrigerator 1 is switched on or off.

The display 62 may be provided in the transparent panel assembly 60 as in the above-described first embodiment, and at this time, the light guide plate 64 may be further provided. Further, the light guide plate 64 may be provided instead of the insulation panel 69.

The front panel 61, the insulation panel 69, and the rear panel 65 may be arranged at a set interval by a third spacer 661 and a fourth spacer 662, and sealed insulation spaces may be formed between the panels.

Further, a spacer protrusion 661*a* may be formed on one side of the third spacer 661, and the coupling members 78 such as screws may be fastened to the spacer protrusion 661*a*. The coupling members 78 may be fastened through a support frame 170 configured to support the outer plate 51 and the transparent panel assembly 60, and thus the transparent panel assembly 60 may be fixed and mounted onto the support frame 170.

The sealant 608 may be applied to spaces on opposite sides with respect to the spacer protrusion 661*a*. The sealant 608 may be applied along the periphery of the transparent panel assembly 60, and may protrude to the same height as that of the spacer protrusion 661*a*.

Meanwhile, the support frame 170 may include a plate support 171 configured to support the outer plate 51, a panel support 172 configured to support the periphery of the front panel 61, and a blocking part 173 configured to prevent the foam liquid from permeating along the peripheral surface of the transparent panel assembly 60.

The plate support 171 may adhere to the rear surface of the outer plate 51 by an adhesive member 171*a*. At this time, an end of the plate support 171 may be situated at a position corresponding to an end defining the opening of the outer plate 51.

Further, the panel support 172 is stepped with respect to the plate support 171, and thus the periphery of the front panel 61 further protruding outward may be seated on the panel support 172. At this time, the panel support 172 may be stepped with respect to the plate support 171 by the thickness of the front panel 61.

Thus, in a state in which the transparent panel assembly 60 is mounted, the outer plate 51 and the front surface of the front panel 61 may be located at the same height and may be located on the same plane. Further, the end of the outer plate 51 and the outer end of the front panel 61 are in contact with each other, and thus when viewed from the outside, a gap between the outer plate 51 and the front panel 61 cannot be viewed.

Meanwhile, a heater accommodating groove on which the heater 532 is mounted may be formed in the panel support 172 as in the above-described first embodiment.

The blocking part 173 may extend from the panel support 172, and may vertically extend from the end of the panel support 172 to the door liner 56. Thus, the foam liquid filled to form the insulator 531 formed inside the sub-door 50 may be prevented from being introduced toward the transparent panel assembly 60. At this time, the blocking part 173 may extend to be in contact with the door liner 56, and when the blocking part 173 is spaced apart from the door liner 56, the shielding member 79 for preventing the introduction of the foam liquid may be provided at an end of the blocking part 173 as in the above-described first embodiment.

Meanwhile, the coupling members 78 such as screws may be fastened to the blocking part 173, and the coupling members 78 may pass through the blocking part 173 to be coupled to the spacer protrusion 661*a*. Thus, the transparent panel assembly 60 may adhere to the support frame 170 without a separate configuration such as adhesive.

That is, the transparent penal assembly 60 may be fixed and mounted onto the support frame 170 by the blocking part 173. Thus, the transparent panel assembly 60 may be firmly fixed, the transparent panel assembly 60 may be separated, and serviceability may be improved. Further, a separate configuration for adhesion is not provided in the bezel 611 at the periphery of the front panel 61, so that even when the transparent panel assembly 60 is separated, the bezel 611 may be prevented from being damaged.

Further, as the foam liquid is prevented from being introduced by the blocking part 173, the transparent panel assembly 60 may be separated, and serviceability may be improved. The cables connected to the electric components for operating the transparent panel assembly 60 are arranged along the periphery of the transparent panel assembly 60, so that the cables may be prevented from being polluted or damaged by the foam liquid.

Meanwhile, various other embodiments in addition to the above-described embodiments may be applied to the refrigerator according to the present disclosure.

In a third embodiment, a single spacer configured to support the outer case and a plurality of panels of the transparent panel assembly is provided, and is coupled to the support frame configured to support the outer plate and the front panel, by the coupling members.

In description of the third embodiment of the present disclosure, the same configurations according to the above-described embodiments will be designated by the same reference numerals, and detailed descriptions thereof will be omitted.

Figure 31:
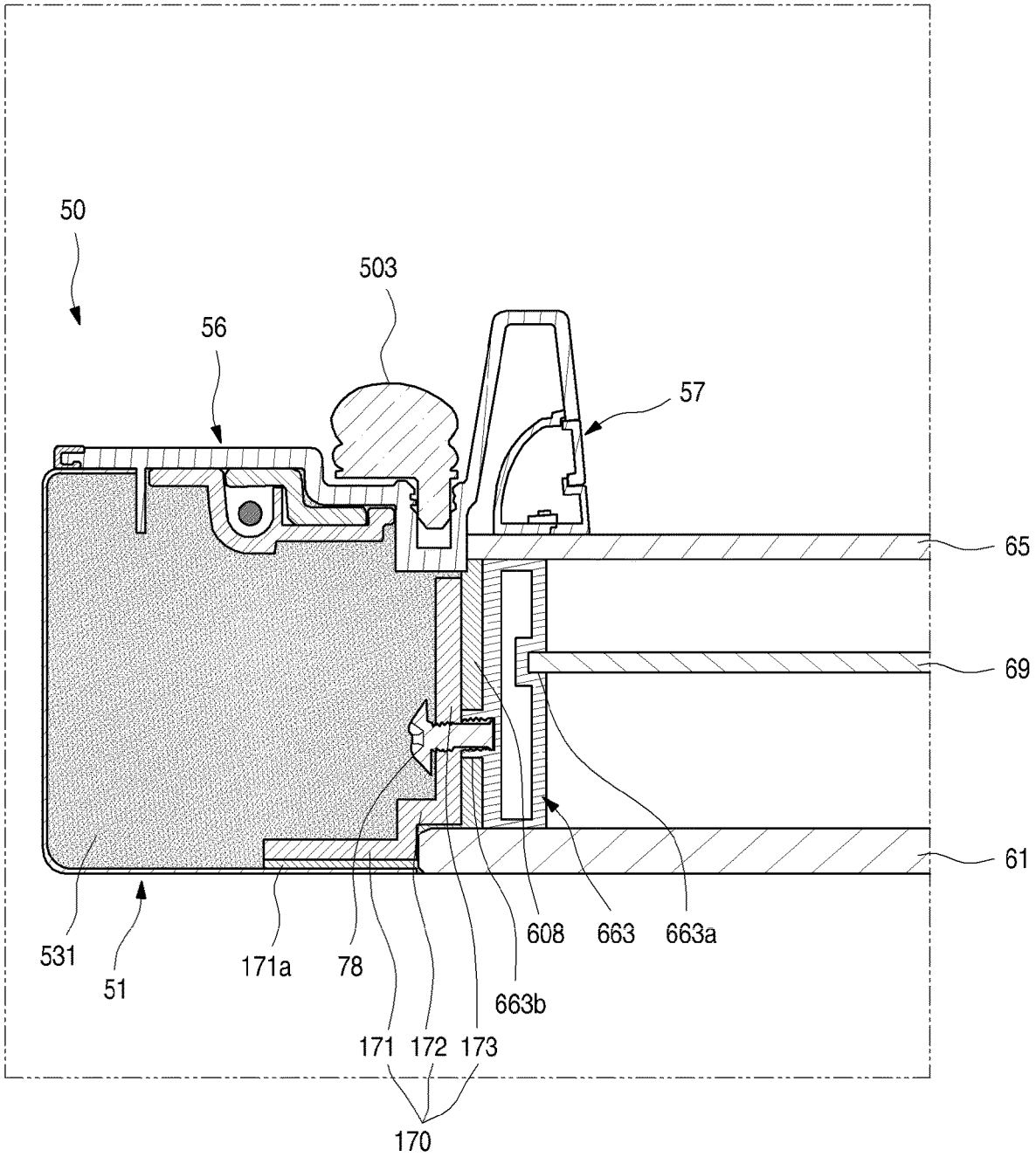
FIG. 31 is a sectional view illustrating a door according to a third embodiment of the present disclosure.

FIG. 31 is a sectional view illustrating a door according to a third embodiment of the present disclosure.

Referring to the drawing, the door 50 may be configured by the outer plate 51, the door liner 56, and the transparent panel assembly 60.

The transparent panel assembly 60 may include the front panel 61 defining the front surface thereof, the rear panel 65 defining the rear surface thereof, and the insulation panel 69 between the front panel 61 and the rear panel 65. A metal deposition layer or a film layer through which light is selectively passes may be formed on the rear surface of the front panel 61, and thus the interior of the refrigerator 1 may be selectively visualized according to whether the door lights 57 or a lamp in the refrigerator 1 is switched on or off.

The front panel 61, the insulation panel 69, and the rear panel 65 may be arranged at a set interval by a fifth spacer 663, and sealed insulation spaces may be formed between the panels.

The fifth spacer 663, which is a single configuration, configures the outermost side of the transparent panel assembly 6, and allows the insulation panel 69 to be fixed between the front panel 61 and the rear panel 65.

In detail, a depressed panel accommodating groove 663*a* accommodating an end of the insulation panel 69 may be formed at the center of the inner surface of the fifth spacer 663. In a state in which the insulation panel 69 is mounted inside the panel accommodating groove 663*a*, the front panel 61 and the rear panel 65 are mounted on the front surface of the rear surface of the fifth spacer 663, so that the insulation panel 69, the front panel 61, and the rear panel 65 may be arranged at a set interval, and a sealed insulation space may be formed.

Meanwhile, a spacer protrusion 663*b* may be formed on an outer surface of the fifth spacer 663, and the coupling members 78 such as screws may be fastened to the spacer protrusion 663*b*. The coupling members 78 may be fastened through the support frame 170 configured to support the outer plate 51 and the transparent panel assembly 60, and thus the transparent panel assembly 60 may be fixed and mounted onto the support frame 170.

The sealant 608 may be applied to spaces on opposite sides with respect to the spacer protrusion 663*b*. The sealant 608 may be applied along the periphery of the transparent panel assembly 60, and may protrude to the same height as that of the spacer protrusion 663*b*.

Meanwhile, the support frame 170 may include a plate support 171 configured to support the outer plate 51, a panel support 172 configured to support the periphery of the front panel 61, and a blocking part 173 configured to prevent the foam liquid from permeating along the peripheral surface of the transparent panel assembly 60.

The front surface of the outer plate 51 and the front surface of the front panel 61 may be located on the same plane by the support frame 170 so as not to be stepped with respect to each other. Further, the end defining the opening of the outer plate 51 is in contact with the outer end of the front panel 61, so that a gap between the outer plate 51 and the front panel 61 is not exposed.

Further, the transparent penal assembly 60 may be fixed and mounted onto the support frame 170 by the blocking part 173. Thus, the transparent panel assembly 60 may be firmly fixed, the transparent panel assembly 60 may be separated, and serviceability may be improved. Further, a separate configuration for adhesion is not provided in the bezel 611 at the periphery of the front panel 61, so that even when the transparent panel assembly 60 is separated, the bezel 611 may be prevented from being damaged.

Meanwhile, various other embodiments in addition to the above-described embodiments may be applied to the refrigerator according to the present disclosure.

A fourth embodiment of the present disclosure is characterized in that the outer plate and the front panel may be mounted to be in contact with each other by the support frame configured to support the outer plate and the front panel.

In description of the fourth embodiment of the present disclosure, the same configurations according to the above-described embodiments will be designated by the same reference numerals, and detailed descriptions thereof will be omitted.

Figure 32:
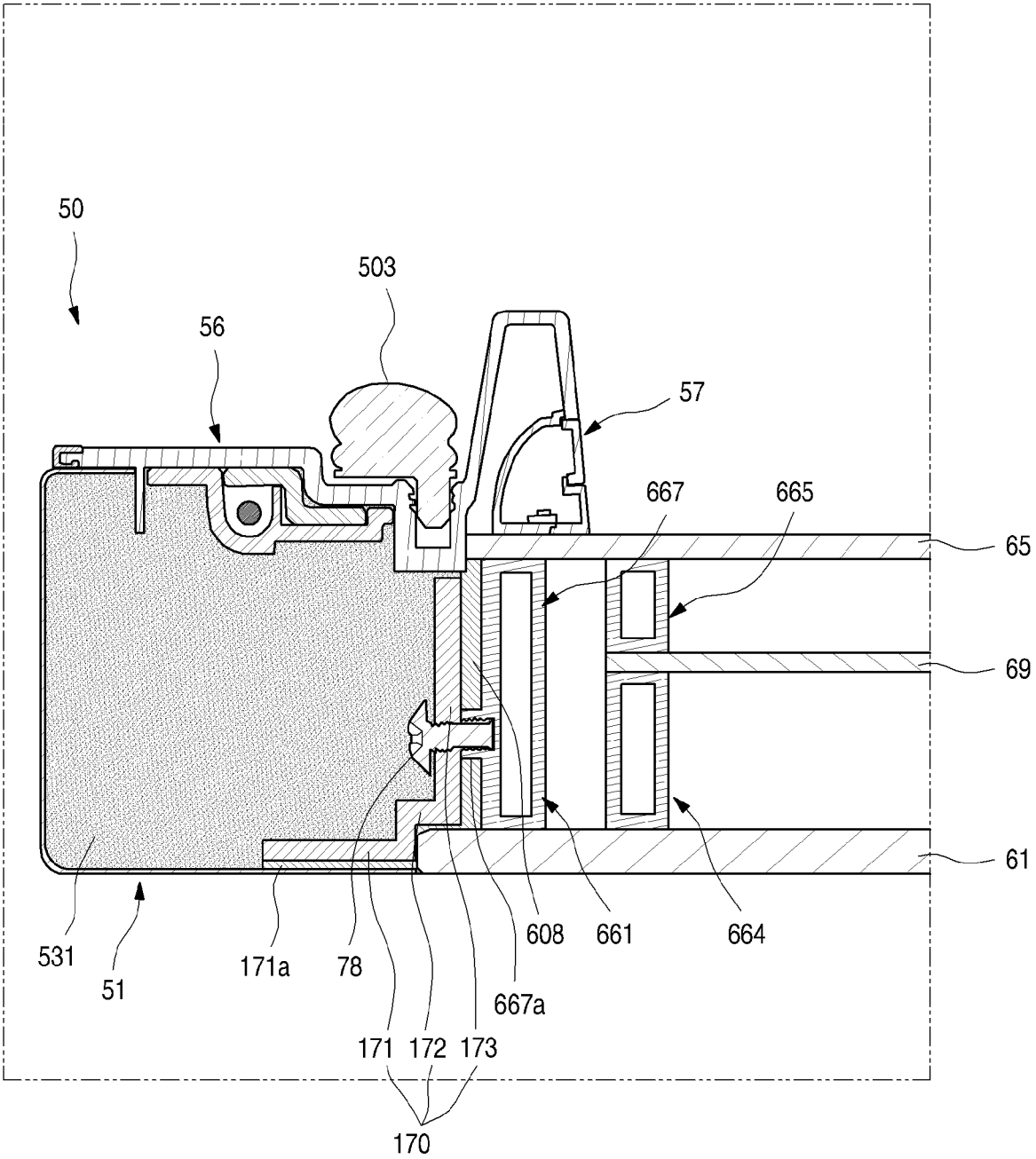
FIG. 32 is a sectional view illustrating a door according to a fourth embodiment of the present disclosure.

FIG. 32 is a sectional view illustrating a door according to a fourth embodiment of the present disclosure.

Referring to the drawing, the door 50 may be configured by the outer plate 51, the door liner 56, and the transparent panel assembly 60.

The transparent panel assembly 60 may include the front panel 61 defining the front surface thereof, the rear panel 65 defining the rear surface thereof, and the insulation panel 69 between the front panel 61 and the rear panel 65. A metal deposition layer or a film layer through which light is selectively passes may be formed on the rear surface of the front panel 61, and thus the interior of the refrigerator 1 may be selectively visualized according to whether the door lights 57 or a lamp in the refrigerator 1 is switched on or off.

Meanwhile, a sixth spacer 664 may be provided between the front panel 61 and the insulation panel 69, and a seventh spacer 665 may be provided between the insulation panel 69 and the rear panel 65. The front panel 61, the insulation panel 69, and the rear panel 65 may be arranged at a specific interval by the sixth spacer 664 and the seventh spacer 665.

Further, an outer spacer 667 may be provided outside the insulation panel 69. The outer spacer 667 connects the front panel 61 and the rear panel 65 between the front panel 61 and the rear panel 65, and the insulation panel 69, the sixth spacer 664, and the seventh spacer 665 may be provided in an internal sealed space. Thus, a space between the front panel 61 and the rear panel 65 is sealed due to the sealing of the outer spacer 667, to form an insulation layer.

Meanwhile, a spacer protrusion 667*a* may be formed on an outer surface of the outer spacer 667, and the coupling members 78 such as screws may be fastened to the spacer protrusion 667*a*. The coupling members 78 may be fastened through the support frame 170 configured to support the outer plate 51 and the transparent panel assembly 60, and thus the transparent panel assembly 60 may be fixed and mounted onto the support frame 170.

The sealant 608 may be applied to spaces on opposite sides with respect to the spacer protrusion 667*a*. The sealant 608 may be applied along the periphery of the transparent panel assembly 60, and may protrude to the same height as that of the spacer protrusion 667*a*.

Meanwhile, the support frame 170 may include a plate support 171 configured to support the outer plate 51, a panel support 172 configured to support the periphery of the front panel 61, and a blocking part 173 configured to prevent the foam liquid from permeating along the peripheral surface of the transparent panel assembly 60.

The front surface of the outer plate 51 and the front surface of the front panel 61 may e located on the same plane by the support frame 170 so as not to be stepped with respect to each other. Further, the end defining the opening of the outer plate 51 is in contact with the outer end of the front panel 61, so that a gap between the outer plate 51 and the front panel 61 is not exposed.

Further, the transparent penal assembly 60 may be fixed and mounted onto the support frame 170 by the blocking part 173. Thus, the transparent panel assembly 60 may be firmly fixed, the transparent panel assembly 60 may be separated, and serviceability may be improved. Further, a separate configuration for adhesion is not provided in the bezel 611 at the periphery of the front panel 61, so that even when the transparent panel assembly 60 is separated, the bezel 611 may be prevented from being damaged.

Meanwhile, various other embodiments in addition to the above-described embodiments may be applied to the refrigerator according to the present disclosure.

A fifth embodiment of the present disclosure is characterized in that the transparent panel assembly may be supported by the outer plate, and by the blocking part formed in the outer plate, the transparent panel assembly may be fixed, and permeation of the foam liquid may be prevented.

In description of the fifth embodiment of the present disclosure, the same configurations according to the above-described embodiments will be designated by the same reference numerals, and detailed descriptions thereof will be omitted.

Figure 33:
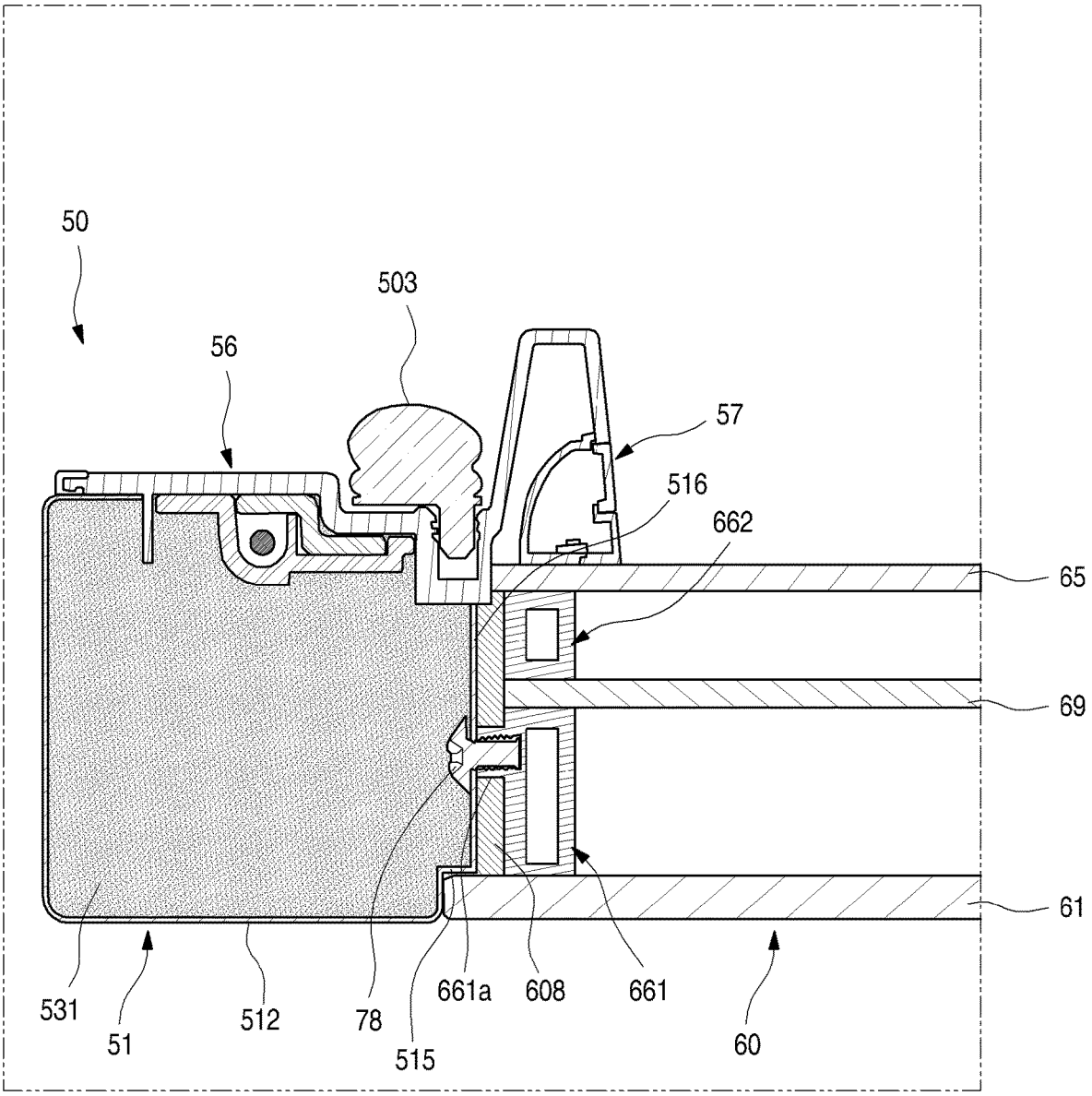
FIG. 33 is a sectional view illustrating a door according to a fifth embodiment of the present disclosure.

FIG. 33 is a sectional view illustrating a door according to a fifth embodiment of the present disclosure.

Referring to the drawing, an outer peripheral shape of the door 50 may be defined by the bent outer plate 51 formed of metal. The outer plate 51 may define the front surface and a periphery of the side surfaces of the door 50. Further, the door liner 56 defining the rear surface of the door 50 is coupled to the outer plate 51, and the transparent panel assembly 60 is provided in openings of the outer plate 51 and the door liner 56, so that the interior of the refrigerator 1 may be selectively seen.

The transparent panel assembly 60 may include the front panel 61 defining the front surface thereof and configured to selectively visualize the interior of the refrigerator 1, the rear panel 65 defining the rear surface thereof, and the insulation panel 69 between the front panel 61 and the rear panel 65.

The front panel 61, the insulation panel 69, and the rear panel 65 may be arranged at a set interval by a third spacer 661 and a fourth spacer 662, and sealed insulation spaces may be formed between the panels.

Further, a spacer protrusion 661*a* may be formed on one side of the third spacer 661, and the coupling members 78 such as screws may be fastened to the spacer protrusion 661*a*. The sealant 608 may be applied to spaces on opposite sides with respect to the spacer protrusion 661*a*. The sealant 608 may be applied along the periphery of the transparent panel assembly 60, and may protrude to the same height as that of the spacer protrusion 661*a*.

Meanwhile, an opening into which the transparent panel assembly 60 is inserted from the front side may be formed on the front surface part 512 defining the front surface of the outer plate 51. Further, a mounting part 515 and the blocking part 516 may be formed at an inner end of the front surface part 512, and an inner surface of the opening passing through the door 50 may be formed by the mounting part 515 and the blocking part 516.

In detail, the mounting part 515 may be inward stepped with respect to an end of the front surface part 512. At this time, the mounting part 515 may be stepped with respect to the front surface part 512 by the thickness of the front panel 61.

Thus, in a state in which the transparent panel assembly 60 is mounted, the outer plate 51 and the front surface of the front panel 61 may be located at the same height and may be located on the same plane. Further, the end of the front surface part 512 and the outer end of the front panel 61 are in contact with each other, and thus when viewed from the outside, a gap between the outer plate 51 and the front panel 61 cannot be viewed.

Meanwhile, the heater 532 may be mounted on the rear surface of the mounting part 515 as in the above-described first embodiment, and may heat the periphery of the front panel 61, thereby preventing dew condensation.

The blocking part 516 may vertically extend from the mounting part 515 to the door liner 56. Thus, the foam liquid filled to form the insulator 531 formed inside the sub-door 50 may be prevented from being introduced toward the transparent panel assembly 60. At this time, the blocking part 516 may extend to be in contact with the door liner 56, and when the blocking part 516 is spaced apart from the door liner 56, the shielding member 79 for preventing the introduction of the foam liquid may be provided at an end of the blocking part 173 as in the above-described first embodiment.

Meanwhile, the coupling members 78 such as screws may be fastened to the blocking part 516, and the coupling members 78 may pass through the blocking part 516 to be coupled to the spacer protrusion 661*a*. Thus, the transparent panel assembly 60 may adhere to the outer plate 51 without a separate configuration such as adhesive.

That is, the transparent penal assembly 60 may be fixed and mounted onto the outer plate 51 by the blocking part 516. Thus, the transparent panel assembly 60 may be firmly fixed, the transparent panel assembly 60 may be separated, and serviceability may be improved. Further, a separate configuration for adhesion is not provided in the bezel 611 at the periphery of the front panel 61, so that even when the transparent panel assembly 60 is separated, the bezel 611 may be prevented from being damaged.

Further, as the foam liquid is prevented from being introduced by the blocking part 516, the transparent panel assembly 60 may be separated, and serviceability may be improved. The cables connected to the electric components for operating the transparent panel assembly 60 are arranged along the periphery of the transparent panel assembly 60, so that the cables may be prevented from being polluted or damaged by the foam liquid.

Meanwhile, various other embodiments in addition to the above-described embodiments may be applied to the refrigerator according to the present disclosure.

A sixth embodiment of the present disclosure is characterized in that the transparent panel assembly may be supported by the outer plate, and by coupling between a single-structural spacer and the blocking part formed in the outer plate, the transparent panel assembly may be fixed, and permeation of the foam liquid may be prevented.

In description of the sixth embodiment of the present disclosure, the same configurations according to the above-described embodiments will be designated by the same reference numerals, and detailed descriptions thereof will be omitted.

Figure 34:
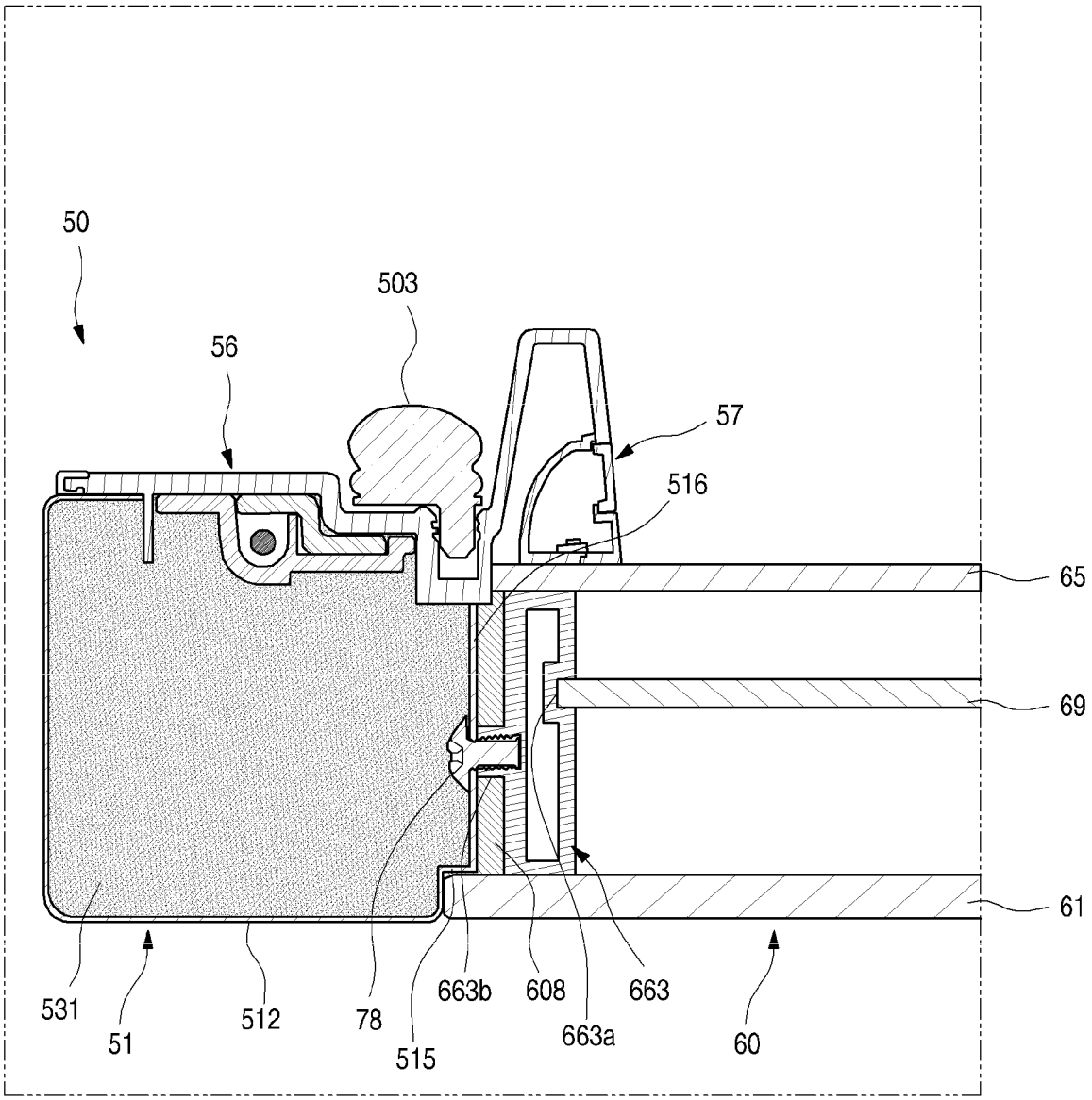
FIG. 34 is a sectional view illustrating a door according to a sixth embodiment of the present disclosure.

FIG. 34 is a sectional view illustrating a door according to a sixth embodiment of the present disclosure.

Referring to the drawing, an outer peripheral shape of the door 50 may be defined by the bent outer plate 51 formed of metal. The outer plate 51 may define the front surface and a periphery of the side surfaces of the door 50. Further, the door liner 56 defining the rear surface of the door 50 is coupled to the outer plate 51, and the transparent panel assembly 60 is provided in openings of the outer plate 51 and the door liner 56, so that the interior of the refrigerator 1 may be selectively seen.

The transparent panel assembly 60 may include the front panel 61 defining the front surface thereof and configured to selectively visualize the interior of the refrigerator 1, the rear panel 65 defining the rear surface thereof, and the insulation panel 69 between the front panel 61 and the rear panel 65.

The front panel 61, the insulation panel 69, and the rear panel 65 may be arranged at a set interval by a fifth spacer 663, and sealed insulation spaces may be formed between the panels.

The fifth spacer 663, which is a single configuration, configures the outermost side of the transparent panel assembly 6, and allows the insulation panel 69 to be fixed between the front panel 61 and the rear panel 65.

In detail, a depressed panel accommodating groove 663*a* accommodating an end of the insulation panel 69 may be formed at the center of the inner surface of the fifth spacer 663. In a state in which the insulation panel 69 is mounted inside the panel accommodating groove 663*a*, the front panel 61 and the rear panel 65 are mounted on the front surface of the rear surface of the fifth spacer 663, so that the insulation panel 69, the front panel 61, and the rear panel 65 may be arranged at a set interval, and a sealed insulation space may be formed.

Meanwhile, a spacer protrusion 663*b* may be formed on an outer surface of the fifth spacer 663, and the coupling members 78 such as screws may be fastened to the spacer protrusion 663*b*. The coupling members 78 may be fastened through the blocking part 516, and thus the transparent panel assembly 60 may be fixed and mounted onto the outer plate 51.

The sealant 608 may be applied to spaces on opposite sides with respect to the spacer protrusion 663*b*. The sealant 608 may be applied along the periphery of the transparent panel assembly 60, and may protrude to the same height as that of the spacer protrusion 663*b*.

Meanwhile, the front surface part 512 defining the front surface of the outer plate 51 may be formed on the outer plate 51, and the mounting part 515 and the blocking part 516 may be formed at an inner end of the front surface part 512 having an opening formed therein.

In detail, the mounting part 515 may be inward stepped with respect to an end of the front surface part 512. At this time, the mounting part 515 may be stepped with respect to the front surface part 512 by the thickness of the front panel 61.

Thus, in a state in which the transparent panel assembly 60 is mounted, the outer plate 51 and the front surface of the front panel 61 may be located at the same height and may be located on the same plane. Further, the end of the front surface part 512 and the outer end of the front panel 61 are in contact with each other, and thus when viewed from the outside, a gap between the outer plate 51 and the front panel 61 cannot be viewed.

The blocking part 516 may vertically extend from the mounting part 515 to the door liner 56. Thus, the foam liquid filled to form the insulator 531 formed inside the sub-door 50 may be prevented from being introduced toward the transparent panel assembly 60. At this time, the blocking part 516 may extend to be in contact with the door liner 56, and when the blocking part 516 is spaced apart from the door liner 56, the shielding member 79 for preventing the introduction of the foam liquid may be provided at an end of the blocking part 173 as in the above-described first embodiment.

The coupling members 78 such as screws may be fastened to the blocking part 516, and the coupling members 78 may pass through the blocking part 516 to be coupled to the spacer protrusion 663*b*. Thus, the transparent panel assembly 60 may adhere to the outer plate 51 without a separate configuration such as adhesive.

Meanwhile, various other embodiments in addition to the above-described embodiments may be applied to the refrigerator according to the present disclosure.

A seventh embodiment of the present disclosure is characterized in that the transparent panel assembly may be supported by the outer plate, and by coupling between double-structural spacers and the blocking part formed in the outer plate, the transparent panel assembly may be fixed, and permeation of the foam liquid may be prevented.

In description of the seventh embodiment of the present disclosure, the same configurations according to the above-described embodiments will be designated by the same reference numerals, and detailed descriptions thereof will be omitted.

Figure 35:
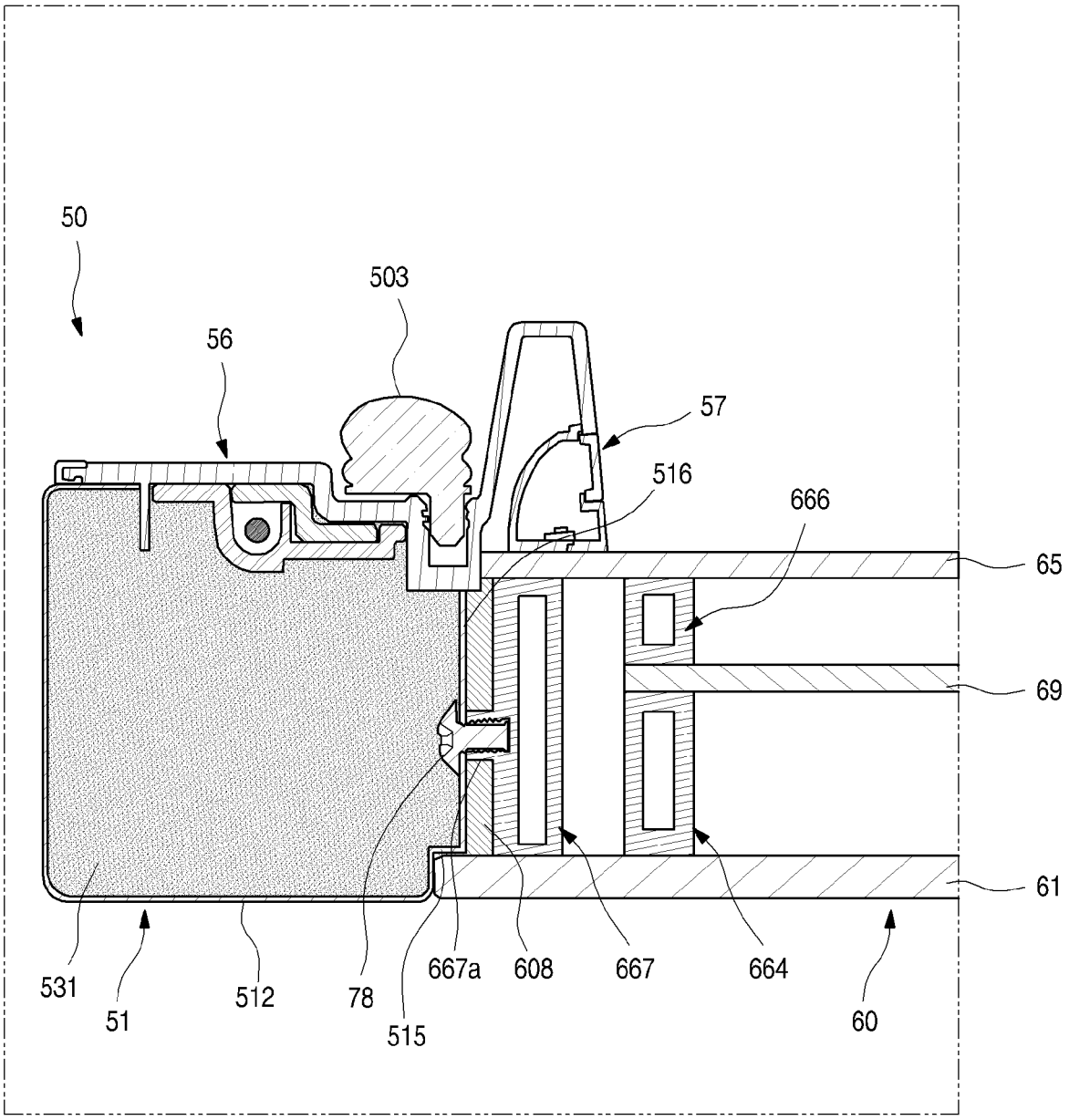
FIG. 35 is a sectional view illustrating a door according to a seventh embodiment of the present disclosure.

FIG. 35 is a sectional view illustrating a door according to a seventh embodiment of the present disclosure.

Referring to the drawing, an outer peripheral shape of the door 50 may be defined by the bent outer plate 51 formed of metal. The outer plate 51 may define the front surface and a periphery of the side surfaces of the door 50. Further, the door liner 56 defining the rear surface of the door 50 is coupled to the outer plate 51, and the transparent panel assembly 60 is provided in openings of the outer plate 51 and the door liner 56, so that the interior of the refrigerator 1 may be selectively seen.

The transparent panel assembly 60 may include the front panel 61 defining the front surface thereof and configured to selectively visualize the interior of the refrigerator 1, the rear panel 65 defining the rear surface thereof, and the insulation panel 69 between the front panel 61 and the rear panel 65.

Meanwhile, a sixth spacer 664 may be provided between the front panel 61 and the insulation panel 69, and a seventh spacer 665 may be provided between the insulation panel 69 and the rear panel 65. The front panel 61, the insulation panel 69, and the rear panel 65 may be arranged at a specific interval by the sixth spacer 664 and the seventh spacer 665.

Further, an outer spacer 667 may be provided outside the insulation panel 69. The outer spacer 667 connects the front panel 61 and the rear panel 65 between the front panel 61 and the rear panel 65, and the insulation panel 69, the sixth spacer 664, and the seventh spacer 665 may be provided in an internal sealed space. Thus, a space between the front panel 61 and the rear panel 65 is sealed due to the sealing of the outer spacer 667, to form an insulation layer.

Meanwhile, a spacer protrusion 667*a* may be formed on an outer surface of the outer spacer 667, and the coupling members 78 such as screws may be fastened to the spacer protrusion 667*a*. The coupling members 78 may be fastened through the blocking part 516, and thus the transparent panel assembly 60 may be fixed and mounted onto the outer plate 51.

The sealant 608 may be applied to spaces on opposite sides with respect to the spacer protrusion 667*a*. The sealant 608 may be applied along the periphery of the transparent panel assembly 60, and may protrude to the same height as that of the spacer protrusion 667*a*.

Meanwhile, the front surface part 512 defining the front surface of the outer plate 51 may be formed on the outer plate 51, and the mounting part 515 and the blocking part 516 may be formed at an inner end of the front surface part 512 having an opening formed therein.

In detail, the mounting part 515 may be inward stepped with respect to an end of the front surface part 512. At this time, the mounting part 515 may be stepped with respect to the front surface part 512 by the thickness of the front panel 61.

Thus, in a state in which the transparent panel assembly 60 is mounted, the outer plate 51 and the front surface of the front panel 61 may be located at the same height and may be located on the same plane. Further, the end of the front surface part 512 and the outer end of the front panel 61 are in contact with each other, and thus when viewed from the outside, a gap between the outer plate 51 and the front panel 61 cannot be viewed.

The blocking part 516 may vertically extend from the mounting part 515 to the door liner 56. Thus, the foam liquid filled to form the insulator 531 formed inside the sub-door 50 may be prevented from being introduced toward the transparent panel assembly 60. At this time, the blocking part 516 may extend to be in contact with the door liner 56, and when the blocking part 516 is spaced apart from the door liner 56, the shielding member 79 for preventing the introduction of the foam liquid may be provided at an end of the blocking part 173 as in the above-described first embodiment.

The coupling members 78 such as screws may be fastened to the blocking part 516. The coupling members 78 may be fastened through the blocking part 516, and thus the transparent panel assembly 60 may be fixed and mounted onto the outer plate 51 without a separate configuration such as adhesive.

Meanwhile, various other embodiments in addition to the above-described embodiments may be applied to the refrigerator according to the present disclosure.

An eighth embodiment of the present disclosure is characterized in that an opening is formed in the door, and the transparent panel assembly is mounted on the rear side of the opening, and is fixed and mounted by the support frame mounted on the door liner.

In description of the eighth embodiment of the present disclosure, the same configurations according to the above-described embodiments will be designated by the same reference numerals, and detailed descriptions thereof will be omitted.

Figure 36:
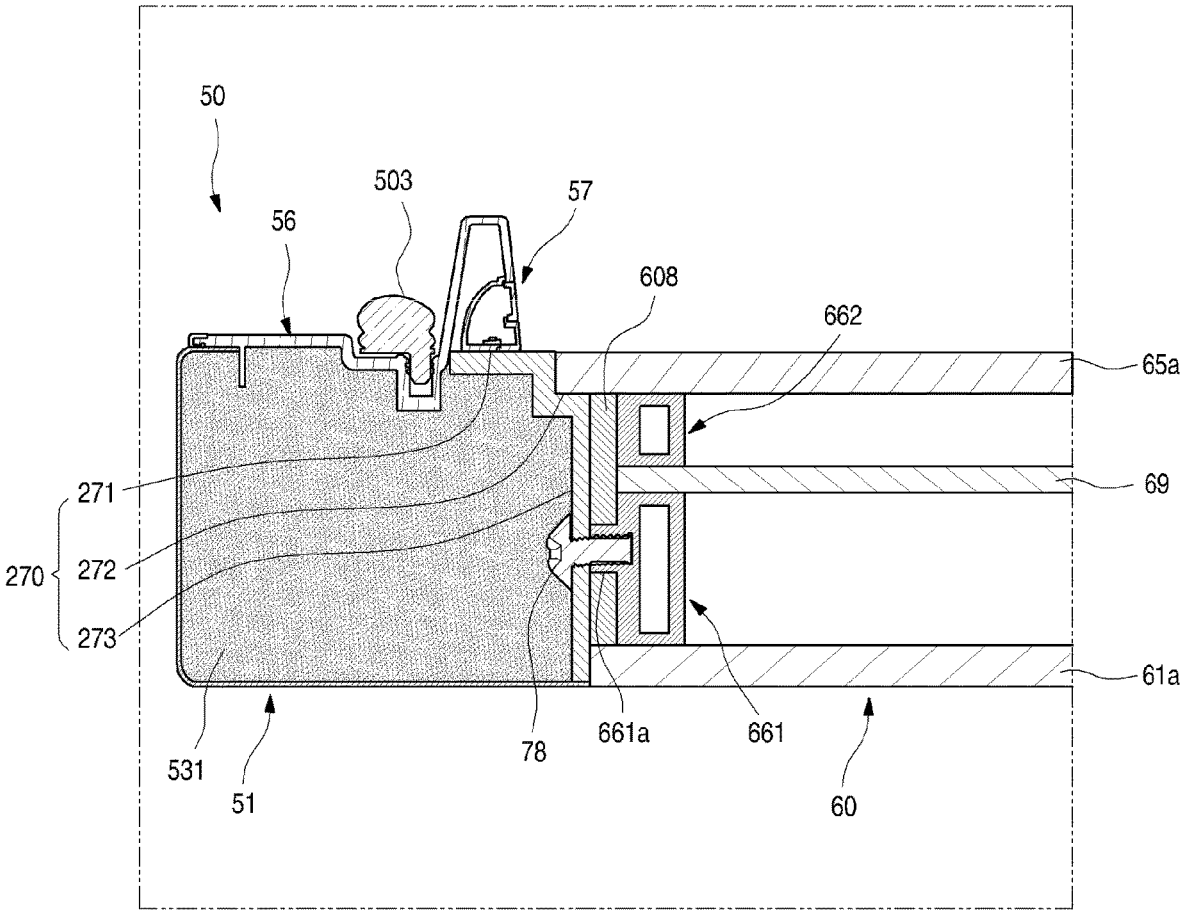
FIG. 36 is a sectional view illustrating a door according to an eighth embodiment of the present disclosure.

FIG. 36 is a sectional view illustrating a door according to an eighth embodiment of the present disclosure.

Referring to the drawing, an outer peripheral shape of the door 50 may be defined by the bent outer plate 51 formed of metal. The outer plate 51 may define the front surface and a periphery of the side surfaces of the door 50. Further, the door liner 56 defining the rear surface of the door 50 is coupled to the outer plate 51, and the transparent panel assembly 60 is provided in openings of the outer plate 51 and the door liner 56, so that the interior of the refrigerator 1 may be selectively seen.

The transparent panel assembly 60 may include the front panel 61*a* defining the front surface thereof and configured to selectively visualize the interior of the refrigerator 1, the rear panel 65*a* defining the rear surface thereof, and the insulation panel 69 between the front panel 61*a* and the rear panel 65*a*.

At this time, the front panel 61*a* is formed to be smaller than the opening, and the rear panel 65*a* is formed to correspond to the size of the opening, and thus may be formed to be larger than the front panel 61*a*. Thus, the transparent panel assembly 60 may be mounted while being inserted from the rear side of the door 50.

The front panel 61*a*, the insulation panel 69, and the rear panel 65*a* may be arranged at a set interval by the third spacer 661 and the fourth spacer 662, and sealed insulation spaces may be formed between the panels.

Further, a spacer protrusion 661*a* may be formed on one side of the third spacer 661, and the coupling members 78 such as screws may be fastened to the spacer protrusion 661*a*. The coupling members 78 may be fastened through a support frame 270 configured to support the outer plate 51 and the transparent panel assembly 60, and thus the transparent panel assembly 60 may be fixed and mounted onto the support frame 270.

The sealant 608 may be applied to spaces on opposite sides with respect to the spacer protrusion 661*a*. The sealant 608 may be applied along the periphery of the transparent panel assembly 60, and may protrude to the same height as that of the spacer protrusion 661*a*.

Meanwhile, the support frame 270 may include a liner support 271 configured to support the door liner 56, a panel support 272 configured to support the periphery of the rear panel 65*a*, and a blocking part 273 configured to prevent the foam liquid from permeating along the peripheral surface of the transparent panel assembly 60.

The liner support 271 may adhere to the rear surface of the door liner 56 by an adhesive member. At this time, an end of the liner support 271 may be situated at a position corresponding to an end defining the opening of the door liner 56. Further, the panel support 272 is stepped with respect to the plate support 271, and thus the periphery of the rear panel 65*a* further protruding outward may be seated on the panel support 272.

The blocking part 273 may extend from the panel support 272, and may vertically extend from the end of the panel support 272 to the front panel 61*a*. Thus, the foam liquid filled to form the insulator 531 formed inside the sub-door 50 may be prevented from being introduced toward the transparent panel assembly 60. At this time, the blocking part 273 may extend to be in contact with the front panel 61*a* or the outer plate 51, and when the blocking part 273 is spaced apart from the front panel 61*a* or the outer plate 51, the shielding member 79 for preventing the introduction of the foam liquid may be provided at the end of the blocking part 173 as in the above-described first embodiment.

Meanwhile, the coupling members 78 such as screws may be fastened to the blocking part 273. Thus, the coupling members 78 may pass through the blocking part 273 to be coupled to the spacer protrusion 661*a*. Thus, the transparent panel assembly 60 may adhere to the support frame 270 without a separate configuration such as adhesive. Thus, the transparent panel assembly 60 may be firmly fixed, and may be easily separated, and serviceability may be improved.

Further, as the foam liquid is prevented from being introduced by the blocking part 273, the transparent panel assembly 60 may be separated, and serviceability may be improved. The cables connected to the electric components for operating the transparent panel assembly 60 are arranged along the periphery of the transparent panel assembly 60, so that the cables may be prevented from being polluted or damaged by the foam liquid.

In a state in which the transparent panel assembly 60 is fixed and mounted onto the support frame 270 by the coupling members 78, the front surface of the outer plate 51 and the front surface of the front panel 61*a* may be arranged on the same plane. That is, the stepped height of the panel support 272 may be formed such that the front panel 61*a* may be located to coincide with the front surface of the outer plate 51.

Further, the outer end of the front panel 61*a* may be arranged to be in contact with the end of the outer plate 51. Thus, when the front surface of the door 50 is viewed, the outer plate 51 and the front panel 61*a* may be stepped with respect to each other or a gap between the outer plate 51 and the front panel 61 may not be generated.

Meanwhile, various other embodiments in addition to the above-described embodiments may be applied to the refrigerator according to the present disclosure.

A ninth embodiment of the present disclosure is characterized in that an opening is formed in the door, the transparent panel assembly is fixed and mounted onto the rear side of the opening, and the door liner is fixed and supported by the transparent panel assembly.

In description of the ninth embodiment of the present disclosure, the same configurations according to the above-described embodiments will be designated by the same reference numerals, and detailed descriptions thereof will be omitted.

Figure 37:
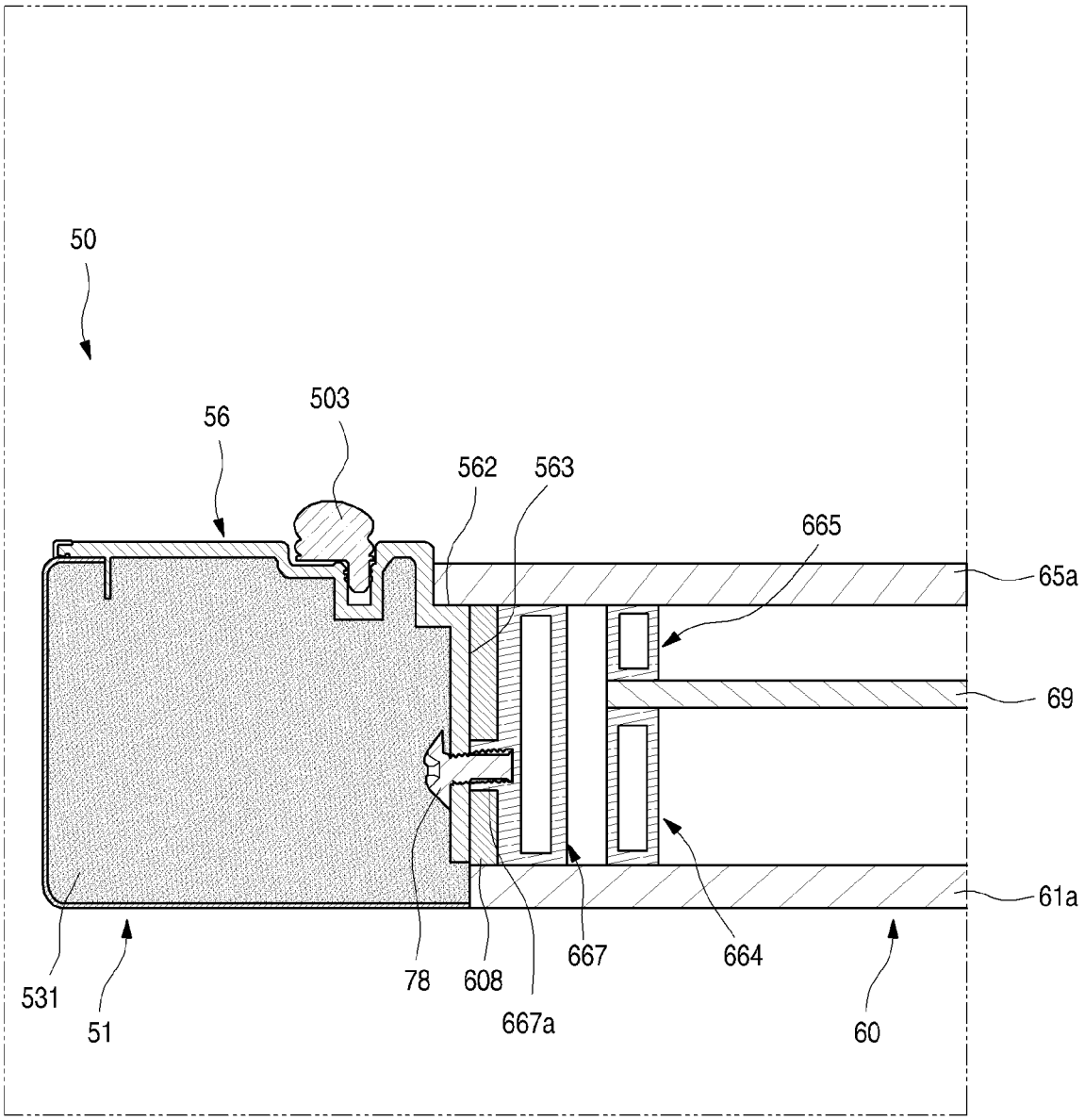
FIG. 37 is a sectional view illustrating a door according to a ninth embodiment of the present disclosure.

FIG. 37 is a sectional view illustrating a door according to a ninth embodiment of the present disclosure.

Referring to the drawing, an outer peripheral shape of the door 50 may be defined by the bent outer plate 51 formed of metal. The outer plate 51 may define the front surface and a periphery of the side surfaces of the door 50. Further, the door liner 56 defining the rear surface of the door 50 is coupled to the outer plate 51, and the transparent panel assembly 60 is provided in openings of the outer plate 51 and the door liner 56, so that the interior of the refrigerator 1 may be selectively seen.

The transparent panel assembly 60 may include the front panel 61*a* defining the front surface thereof and configured to selectively visualize the interior of the refrigerator 1, the rear panel 65*a* defining the rear surface thereof, and the insulation panel 69 between the front panel 61*a* and the rear panel 65*a*.

At this time, the front panel 61*a* may be formed to be smaller than the opening, and the rear panel 65*a* may be formed to correspond to the opening and thus to be larger than the front panel 61*a*. Thus, the transparent panel assembly 60 may be mounted while being inserted from the rear side of the door 50.

Meanwhile, the sixth spacer 664 may be provided between the front panel 61*a* and the insulation panel 69, and the seventh spacer 665 may be provided between the insulation panel 69 and the rear panel 65*a*. The front panel 61*a*, the insulation panel 69, and the rear panel 65*a* may be arranged at a specific interval by the sixth spacer 664 and the seventh spacer 665.

Further, the outer spacer 667 may be provided outside the insulation panel 69. The outer spacer 667 connects the front panel 61*a* and the rear panel 65*a* between the front panel 61 and the rear panel 65, and the insulation panel 69, the sixth spacer 664, and the seventh spacer 665 may be provided in an internal sealed space. Thus, a space between the front panel 61*a* and the rear panel 65*a* is sealed due to the sealing of the outer spacer 667, to form an insulation layer.

Meanwhile, the spacer protrusion 667*a* may be formed on the outer surface of the outer spacer 667, and the coupling members 78 such as screws may be fastened to the spacer protrusion 667*a*. The coupling members 78 may be fastened through the blocking part 563, and thus the transparent panel assembly 60 may be fixed and mounted onto the door liner 56.

The sealant 608 may be applied to spaces on opposite sides with respect to the spacer protrusion 667*a*. The sealant 608 may be applied along the periphery of the transparent panel assembly 60, and may protrude to the same height as that of the spacer protrusion 667*a*.

Meanwhile, the door liner 56 may be formed on the rear surface of the door 50, and the gasket 503 may be mounted to the door liner 56. Further, a mounting part 562 and a blocking part 563 on which the rear panel 65*a* is seated may be formed in the door liner 56.

The mounting part 562 may be formed at an end of the door liner 56 in which the opening is formed, and may be stepped such that the outer end of the rear panel 65*a* may be seated thereon. Further, when the rear panel 65*a* is mounted on the mounting part 562, the mounting part 562 may have a height at which the front surface of the front panel 61*a* may be located at the same position as that of the front surface of the outer plate 51.

Further, the outer end of the front panel 61*a* may be arranged to be in contact with the end of the outer plate 51. Thus, when the front surface of the door 50 is viewed, the outer plate 51 and the front panel 61*a* may be stepped with respect to each other or the gap between the outer plate 51 and the front panel 61 may not be generated.

The blocking part 563 may extend from the mounting part 562, and may vertically extend from the end of the mounting part 562 to the front panel 61*a*. Thus, the foam liquid filled to form the insulator 531 formed inside the sub-door 50 may be prevented from being introduced toward the transparent panel assembly 60. At this time, the blocking part 563 may extend to be in contact with the front panel 61*a* or the outer plate 51, and when the blocking part 563 is spaced apart from the front panel 61*a* or the outer plate 51, the shielding member 79 for preventing the introduction of the foam liquid may be provided at the end of the blocking part 173 as in the above-described first embodiment.

Meanwhile, the coupling members 78 such as screws may be fastened to the blocking part 563, and the coupling members 78 may pass through the blocking part 563 to be coupled to the spacer protrusion 667*a*. Thus, the transparent panel assembly 60 may adhere to the door liner 56 without a separate configuration such as adhesive. Thus, the transparent panel assembly 60 may be firmly fixed, and may be easily separated, and serviceability may be improved.

Further, the foam liquid is prevented from being introduced by the blocking part 563, so that the transparent panel assembly 60 may be easily separated and a service may be easily performed. Further, cables connected to electric components for operating the transparent panel assembly 60 are arranged along the periphery of the transparent panel assembly 60, so that the cables may be prevented from being polluted or damaged by the foam liquid.

Meanwhile, various other embodiments in addition to the above-described embodiments may be applied to the present disclosure.

Tenth to twelfth embodiments of the present disclosure is characterized in that the doors according to the above-described embodiments may be applied to refrigerators having various structures.

In the following embodiments, there is merely a difference only in the position and the size of the doors, and the structures of the doors according to the above-described embodiments may be applied. Thus, the same reference numerals will be used and the detailed descriptions thereof will be omitted.

Figure 38:
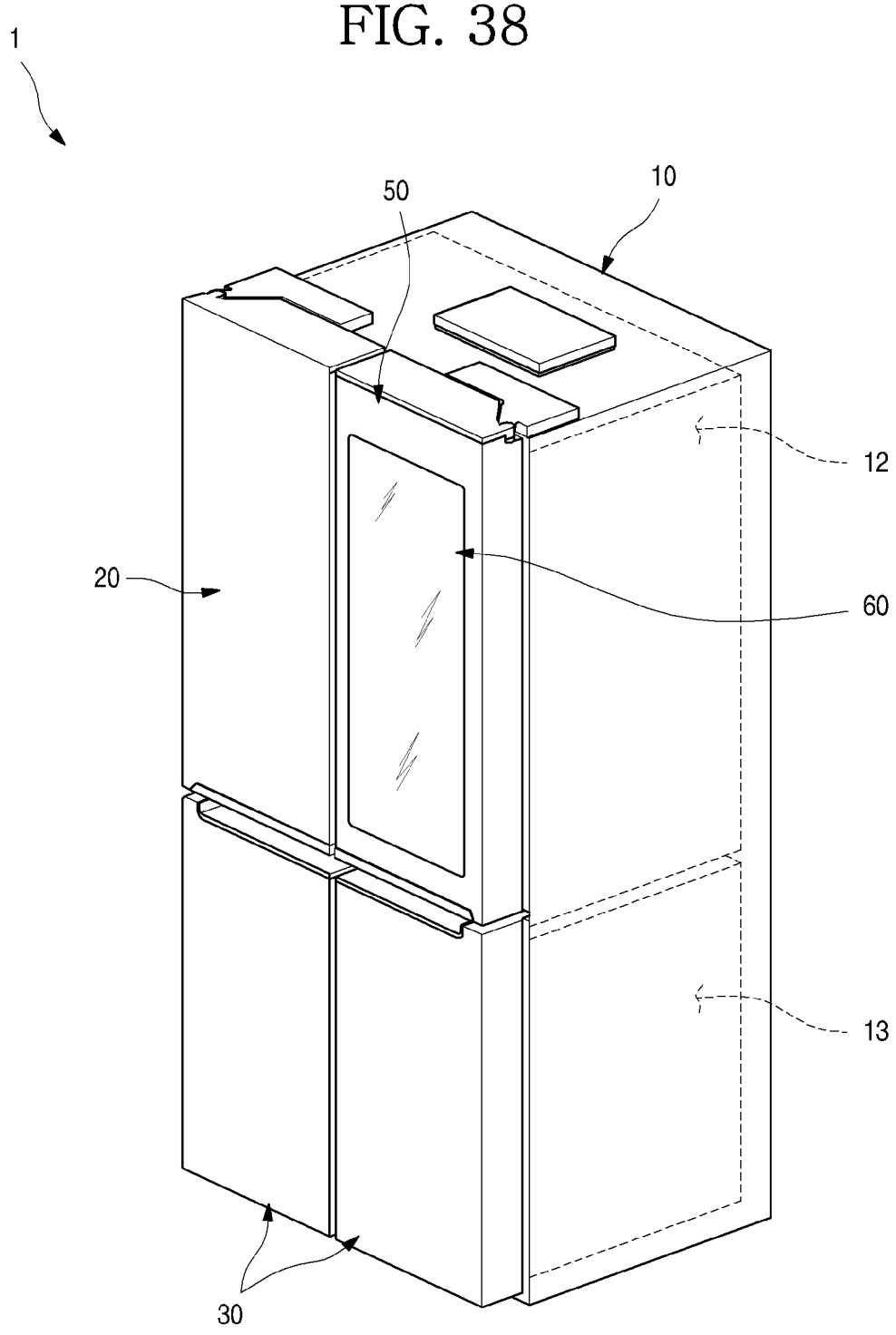
FIG. 38 is a perspective view illustrating a refrigerator according to a tenth embodiment of the present disclosure.

FIG. 38 is a perspective view illustrating a refrigerator according to a tenth embodiment of the present disclosure.

As illustrated, a refrigerator 1 according to the tenth embodiment of the present disclosure may be formed by a cabinet 10 in which a storage space is formed, and a plurality of doors 20, 30, and 50 configured to open/close the storage space. A first storage space 12 and a second storage space 13 may be vertically partitioned inside the cabinet 10. Further, the first storage space 12 and the second storage space 13 may be controlled to be operated at different temperatures, and may be configured as, for example, a refrigerating chamber and a freezing chamber. The first storage space 12 and the second storage space 13 may be opened/closed by the pair of doors 20, 30, and 50.

The pair of doors 20 and 50 configured to open/close the first storage space 12 may be rotatably mounted on the cabinet 10. Further, the pair of doors 20 and 50 may include the door 20 configured to shield the left side of the first storage space 12 and the door 50 configured to shield the right side of the first storage space 12.

The door 50 may include a see-through part allowing an inside to be selectively seen, and the see-through part may be configured by the transparent panel assembly 60. Meanwhile, the door 50 may be configured to be identical to any one of the doors according to the above-described embodiments, and the detailed descriptions thereof will be omitted.

Meanwhile, lighting members may be further provided in the door 50 and/or the first storage space 12, and when the lighting members are switched on, the transparent panel assembly 60 becomes transparent so that a space inside the refrigerator 1 can be seen. Further, when the lighting members are switched off, the transparent panel assembly 60 becomes opaque so that the space inside the refrigerator cannot be seen.

Figure 39:
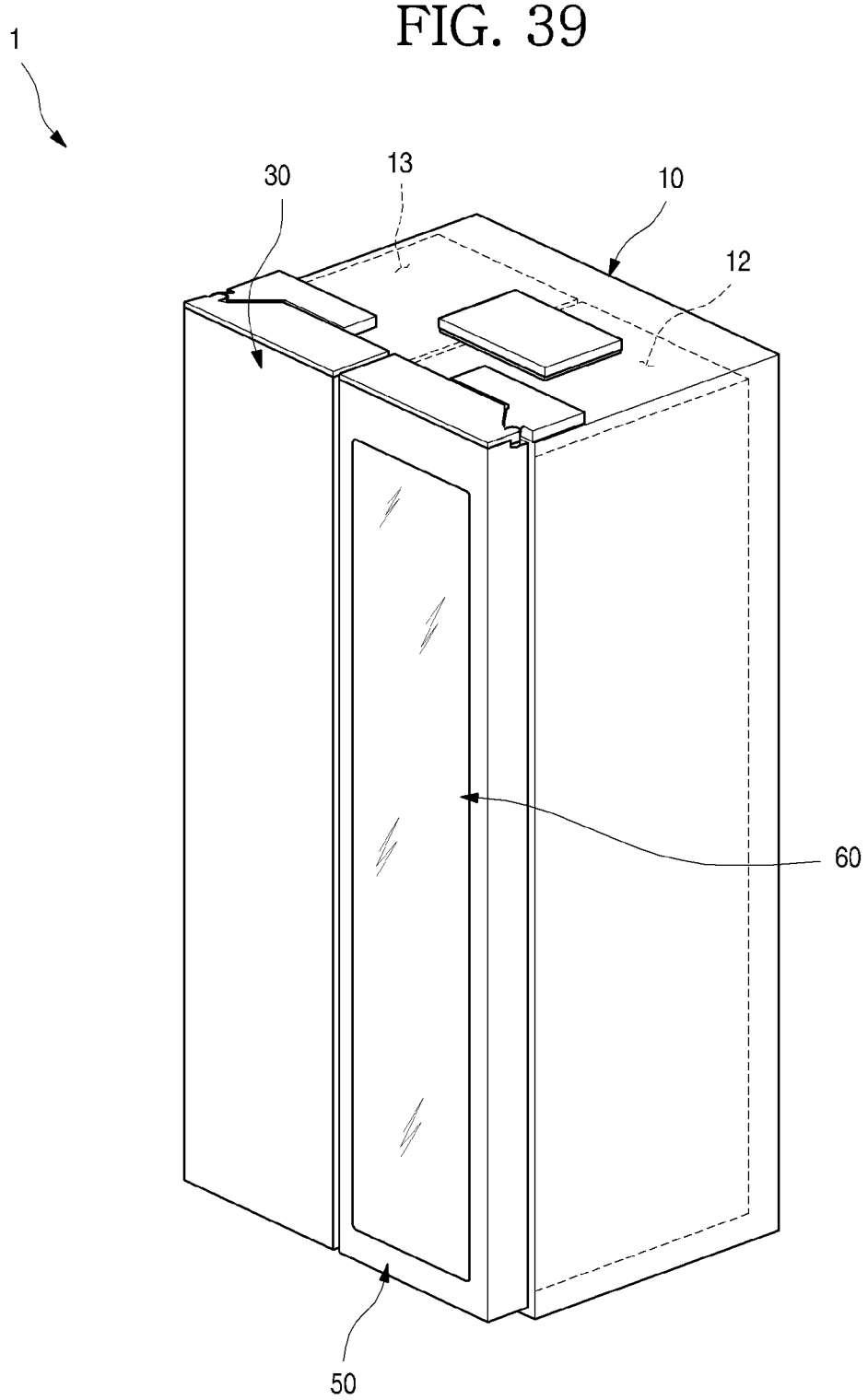
FIG. 39 is a perspective view illustrating a refrigerator according to an eleventh embodiment of the present disclosure.

FIG. 39 is a perspective view illustrating a refrigerator according to an eleventh embodiment of the present disclosure.

As illustrated, a refrigerator 1 according to the eleventh embodiment of the present disclosure may be formed by a cabinet 10 in which a storage space is formed, and a pair of doors 30 and 50 configured to open/close the storage space. A first storage space 12 and a second storage space 13 may be transversely partitioned inside the cabinet 10. Further, the first storage space 12 and the second storage space 13 may be controlled to be operated at different temperatures, and may be configured as, for example, a refrigerating chamber and a freezing chamber. The first storage space 12 and the second storage space 13 may be opened/closed by the pair of doors 30 and 50, respectively.

The pair of doors 30 and 50 may be rotatably mounted on the cabinet 10. Further, the pair of doors 30 and 50 may include the door 30 configured to shield the left second storage space 13 and the door 50 configured to shield the right first storage space 12.

The door 50 may include a see-through part allowing an inside thereof to be selectively seen, and the see-through part may be configured by the transparent panel assembly 60. Meanwhile, the door 50 may be configured to be identical to any one of the doors according to the above-described embodiments, and the detailed descriptions thereof will be omitted.

Meanwhile, lighting members may be further provided in the door 50 and/or the first storage space 12, and when the lighting members are switched on, the transparent panel assembly 60 becomes transparent so that a space inside the refrigerator 1 can be seen. Further, when the lighting members are switched off, the transparent panel assembly 60 becomes opaque so that the space inside the refrigerator cannot be seen.

Figure 40:
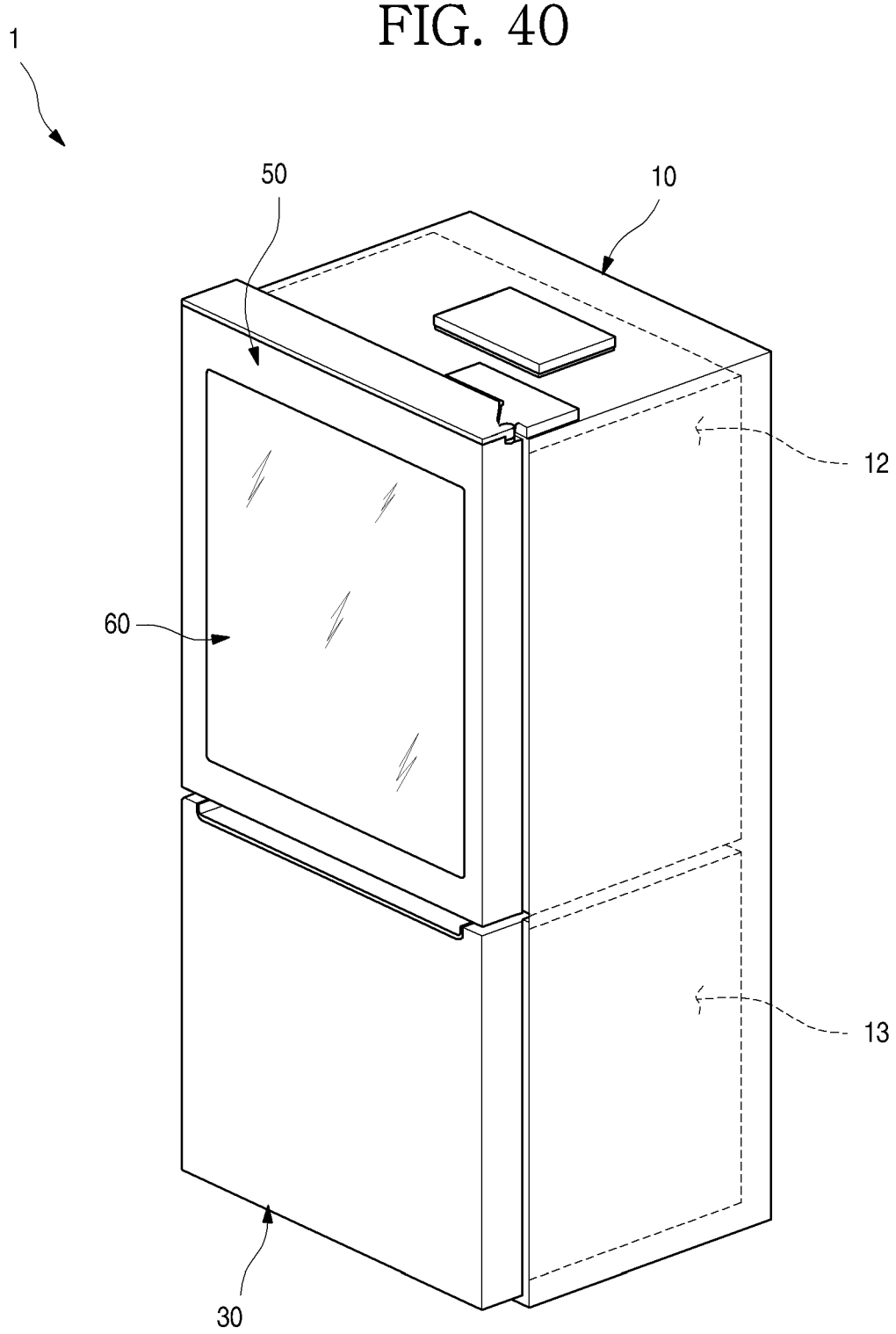
FIG. 40 is a perspective view illustrating a refrigerator according to a twelfth embodiment of the present disclosure.

FIG. 40 is a perspective view illustrating a refrigerator according to a twelfth embodiment of the present disclosure.

As illustrated, a refrigerator 1 according to the twelfth embodiment of the present disclosure may be formed by a cabinet 10 in which a storage space is formed, and a pair of doors 30 and 50 configured to open/close the storage space. A first storage space 12 and a second storage space 13 may be vertically partitioned inside the cabinet 10. Further, the first storage space 12 and the second storage space 13 may be controlled to be operated at different temperatures, and may be configured as, for example, a refrigerating chamber and a freezing chamber. The first storage space 12 and the second storage space 13 may be opened/closed by the pair of doors 30 and 50, respectively.

The pair of doors 30 and 50 may be rotatably mounted on the cabinet 10. Further, the pair of doors 30 and 50 may include the door 50 configured to shield the first storage space 12 and the door 50 configured to shield the second storage space 13.

The door 50 may include a see-through part allowing an inside thereof to be selectively seen, and the see-through part may be configured by the transparent panel assembly 60. Meanwhile, the door 50 may be configured to be identical to any one of the doors according to the above-described embodiments, and the detailed descriptions thereof will be omitted.

Meanwhile, lighting members may be further provided in the door 50 and/or the first storage space 12, and when the lighting members are switched on, the transparent panel assembly 60 becomes transparent so that a space inside the refrigerator 1 can be seen. Further, when the lighting members are switched off, the transparent panel assembly 60 becomes opaque so that the space inside the refrigerator cannot be seen.

The present disclosure may be applied to all types of refrigerators having a door configured to shield at least a portion of a storage space, regardless of types of refrigerators.

What is claimed is:

1. A refrigerator comprising:

a cabinet that defines a storage space; and a door configured to open and close at least a portion of the storage space, the door comprising:

an outer plate that defines a front surface of the door, the outer plate having an opening, a door liner that defines a rear surface of the door, a transparent panel assembly disposed in the opening, the transparent panel assembly comprising a front panel, a rear panel, and a spacer disposed between the front panel and the rear panel, an insulator disposed in a space defined by the outer plate and the door liner, and a blocking part that is disposed between the insulator and the transparent panel assembly and separates the insulator and the transparent panel assembly from each other.

2. The refrigerator of claim 1, wherein the spacer is disposed at peripheries of the front panel and the rear panel, and wherein the blocking part is disposed at a periphery of the spacer.

3. The refrigerator of claim 1, further comprising a coupler that fixes the blocking part to the spacer.

4. The refrigerator of claim 3, wherein the coupler comprises a screw.

5. The refrigerator of claim 3, further comprising a sealant disposed at a periphery of the transparent panel assembly and configured to seal an inner space defined by the front panel, the rear panel, and the spacer.

6. The refrigerator of claim 5, wherein the sealant is disposed between the spacer and the blocking part.

7. The refrigerator of claim 5, wherein the coupler passes through the sealant and the blocking part.

8. The refrigerator of claim 1, further comprising a support frame that is disposed at a periphery of the opening of the outer plate and supports the outer plate and the transparent panel assembly, wherein the support frame comprises the blocking part.

9. The refrigerator of claim 8, wherein the support frame has a bent portion that supports a rear surface of the outer plate and a rear surface of the transparent panel assembly.

10. The refrigerator of claim 8, wherein the support frame further comprises:

a plate support that is disposed at a rear surface of the outer plate; and an adhesive disposed at the plate support and attached to the plate support and the outer plate.

11. The refrigerator of claim 10, wherein the support frame further comprises a panel support disposed at a rear surface of the front panel, wherein the blocking part extends rearward relative to the panel support and covers a periphery of the spacer.

12. The refrigerator of claim 11, wherein the door further comprises a heater disposed at the rear surface of the front panel, and wherein the panel support defines a heater groove that receives the heater.

13. The refrigerator of claim 11, wherein the support frame defines a plate accommodating groove between the plate support and the panel support, and wherein the outer plate comprises a bent plate part that is received in the plate accommodating groove and that extends rearward relative to the front panel, the bent plate part extending along the opening of the outer plate.

14. The refrigerator of claim 3, wherein the transparent panel assembly further comprises a spacer protrusion that protrudes from the spacer toward the blocking part, the spacer protrusion defining a hole that receives the coupler.

15. The refrigerator of claim 3, wherein the door further comprises an insulation panel disposed between the front panel and the rear panel, wherein the spacer comprises a first spacer that supports the insulation panel and the front panel, and a second spacer that supports the insulation panel and the rear panel, and wherein the coupler is coupled to the first spacer or the second spacer.

16. The refrigerator of claim 1, wherein the door further comprises an insulation panel disposed between the front panel and the rear panel, and wherein the spacer defines a groove that receives an end portion of the insulation panel.

17. The refrigerator of claim 1, wherein the outer plate comprises:

a front surface part that defines a portion of the front surface of the door; and a mounting part that is stepped rearward from an end of the front surface part and supports the front panel, and wherein the blocking part extends from an end of the mounting part toward the rear panel.

18. The refrigerator of claim 1, wherein the door further comprises a support frame, the support frame comprising a liner support that supports the door liner, and a panel support that supports a periphery of the rear panel, and wherein the blocking part extends forward relative to the panel support.

19. The refrigerator of claim 1, wherein the door liner defines a liner opening, wherein the door further comprises a mounting part that is stepped from the door liner and supports the rear panel, the mounting part defining a periphery of the liner opening, and wherein the blocking part extends from an end of the mounting part toward the front panel.

20. The refrigerator of claim 5, wherein the transparent panel assembly further comprises:

a display disposed between the front panel and the rear panel and configured to output screen information; and a cable connected to the display and arranged along a periphery of the spacer, the cable passing through the sealant.

* * * * *